US008055154B2

(12) United States Patent
Iikura et al.

(10) Patent No.: US 8,055,154 B2
(45) Date of Patent: Nov. 8, 2011

(54) PROTECTION COVER, AND PROCESS CARTRIDGE AND IMAGE FORMING APPARATUS USING THE SAME

(75) Inventors: Kazuaki Iikura, Saitama (JP); Toshiyuki Matsui, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 735 days.

(21) Appl. No.: 12/076,506

(22) Filed: Mar. 19, 2008

(65) Prior Publication Data

US 2009/0080935 A1 Mar. 26, 2009

(30) Foreign Application Priority Data

Sep. 20, 2007 (JP) ..... 2007-243152
Sep. 20, 2007 (JP) ..... 2007-243153
Sep. 20, 2007 (JP) ..... 2007-243154

(51) Int. Cl.
*G03G 21/18* (2006.01)

(52) U.S. Cl. ..... 399/111; 399/114

(58) Field of Classification Search ..... 399/110, 399/111, 114
See application file for complete search history.

(56) References Cited

U.S. PATENT DOCUMENTS

| | | | | |
|---|---|---|---|---|
| 4,655,578 | A | 4/1987 | Kurtz et al. | |
| 7,532,841 | B2 * | 5/2009 | Tanaka | 399/114 |
| 2007/0206972 | A1 | 9/2007 | Tanaka | |

FOREIGN PATENT DOCUMENTS

| | | |
|---|---|---|
| JP | A-04-066961 | 3/1992 |
| JP | A 08-292706 | 11/1996 |
| JP | A-2002-132011 | 5/2002 |
| JP | A-2002-132120 | 5/2002 |
| JP | A-2003-084534 | 3/2003 |
| JP | D 1291022 | 1/2007 |
| JP | D 1291461 | 1/2007 |

OTHER PUBLICATIONS

Nov. 23, 2009 Office Action issued in Australian Patent Application No. 2008201357.
Dec. 3, 2009 Office Action issued in Japanese Patent Application No. 2007-243152 (with English Translation).
Dec. 3, 2009 Office Action issued in Japanese Patent Application No. 2007-243154 (with English Translation).

* cited by examiner

*Primary Examiner* — William J Royer
(74) *Attorney, Agent, or Firm* — Oliff & Berridge, PLC

(57) ABSTRACT

A protection cover includes a cover base that covers and protects an external exposure portion of a photosensitive member and that comes into contact with an image forming apparatus housing body to movably guide a process cartridge; an extrusion member that is disposed in the cover base on a side opposite to an insertion direction of the process cartridge to the image forming apparatus housing body and that moves in the insertion direction of the process cartridge to extrude the process cartridge from the cover base; and a restriction portion that is disposed in the extrusion member to restrict the process cartridge in the cover base in a state where the process cartridge is located in the cover base and to release the process cartridge from the cover base in a state where the process cartridge is inserted and mounted to the image forming apparatus housing body.

8 Claims, 48 Drawing Sheets

PROTECTION COVER, AND PROCESS CARTRIDGE AND IMAGE FORMING APPARATUS USING THE SAME

CROSS-REFERENCE TO RELATED APPLICATIONS

This application is based on and claims priority under 35 USC 119 from Japanese Patent Application Nos. 2007-243152, 2007-243153, and 2007-243154 filed on Sep. 19, 2007, Sep. 19, 2007, and Sep. 20, 2007, respectively.

BACKGROUND

Technical Field

The present invention relates to a protection cover, and a process cartridge and an image forming apparatus using the same.

SUMMARY

According to an aspect of the invention, there is provided a protection cover, which is detachably disposed in a process cartridge that is detachably inserted and mounted to an image forming apparatus housing body and that includes a photosensitive member; protects an external exposure portion of the photosensitive member before the process cartridge is inserted and mounted to the image forming apparatus housing body; and which detaches from the process cartridge with the process cartridge being inserted and mounted to the image forming apparatus housing body, the protection cover including: a cover base that covers and protects the external exposure portion of the photosensitive member and that comes into contact with the image forming apparatus housing body to movably guide the process cartridge at the time the process cartridge is inserted to the image forming apparatus housing body; an extrusion member that is disposed in the cover base on a side opposite to an insertion direction of the process cartridge to the image forming apparatus housing body and that moves in the insertion direction of the process cartridge to extrude the process cartridge from the cover base; and a restriction portion that is disposed in the extrusion member to restrict the process cartridge in the cover base in a state where the process cartridge is located in the cover base and to release the process cartridge from the cover base in a state where the process cartridge is inserted and mounted to the image forming apparatus housing body.

BRIEF DESCRIPTION OF THE DRAWINGS

Exemplary embodiment(s) of the present invention will be described in detail based on the following figures, wherein.

DETAILED DESCRIPTION

A. Outline of Exemplary Embodiment

First, an outline of an exemplary embodiment of the invention will be described.

Figure 1A:
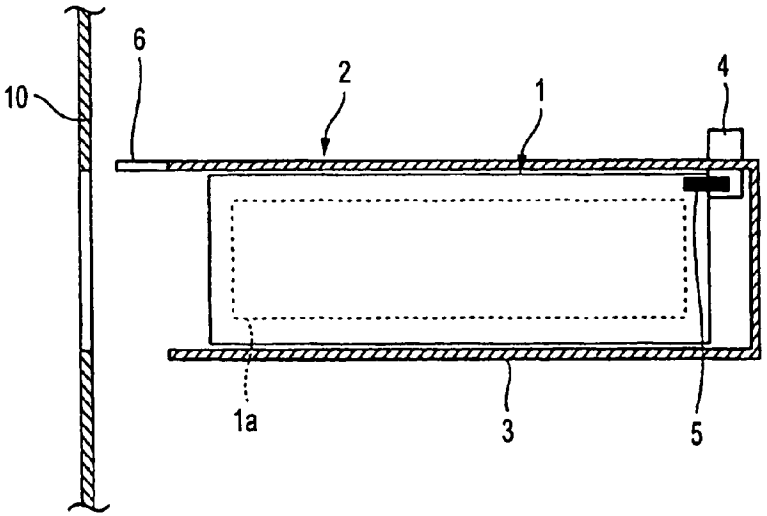
FIG. 1A is a view illustrating an outline of a protection cover, a process cartridge, and an image forming apparatus before an inserting/mounting operation of a process cartridge according to an exemplary embodiment of the invention.
Figure 1B:
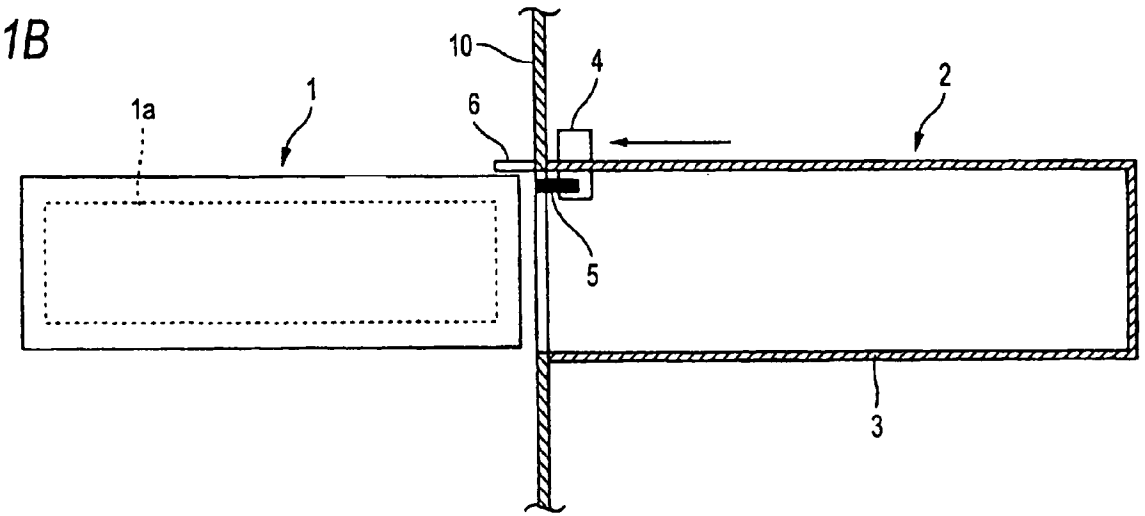
FIG. 1B is a view illustrating an outline thereof at the time of the inserting/mounting operation of the process cartridge.

FIGS. 1A and 1B schematically illustrate an outline of a protection cover 2, a process cartridge 1, and an image forming apparatus according to the embodiment of the invention.

In the same drawing, the protection cover 2 according to the embodiment is detachably inserted and mounted to an image forming apparatus housing body 10, and is detachably mounted to the process cartridge 1 which contains at least a photosensitive member 1*a*. The protection cover 2 protects an external exposure portion of the photosensitive member 1*a* before the process cartridge 1 is inserted and mounted to the image forming apparatus housing body 10, and is detached from the process cartridge 1 when the process cartridge 1 is inserted and mounted to the image forming apparatus housing body 10. The protection cover 2 includes a cover base 3 which covers the external exposure portion of the photosensitive member 1*a* of the process cartridge 1 to be protected and which comes into contact with the image forming apparatus housing body 10 to movably guide the process cartridge 1 at the time the process cartridge 1 is inserted to the image forming apparatus housing body 10; an extrusion member 4 which is disposed in the cover base 3 on the opposite side of the insertion direction where the process cartridge 1 is inserted to the image forming apparatus housing body 10 and which moves in the insertion direction of the process cartridge 1 to extrude the process cartridge 1 from the cover base 3; and a restriction portion 5 which is disposed in the extrusion member 4 so that the process cartridge 1 is restricted in the cover base 3 in the state where the process cartridge 1 is located in the cover base 3 and the process cartridge 1 is released from the cover base 3 in the state where the process cartridge 1 is inserted and mounted to the image forming apparatus housing body 10.

Additionally, FIG. 1A is a schematic view illustrating a state just before the process cartridge 1 is inserted and mounted to the image forming apparatus housing body 10, and FIG. 1B is a schematic view illustrating a state after the process cartridge 1 is inserted and mounted to the image forming apparatus housing body 10.

In such technical means, the process cartridge 1 is integrally formed with a unit containing at least the photosensitive member 1*a* to thereby form a cartridge. The cartridge unit is configured to be detachably mounted to the image forming apparatus housing body 10.

Additionally, in order to mainly protect the photosensitive member 1*a* from deterioration or a damage, an example of the protection cover 2 includes a protection cover that protects at least the external exposure portion of the photosensitive member 1*a* before the process cartridge 1 is inserted and mounted to the image forming apparatus housing body 10 and is detached from the process cartridge 1 after the process cartridge 1 is inserted and mounted thereto.

At this time, "at least the external exposure portion of the photosensitive member 1*a* is protected" means that the external exposure portion of the photosensitive member 1*a* is included as a protection target to be protected by the protection cover 2. Examples of the protection cover 2 include a protection cover that covers the whole external exposure portion of the photosensitive member 1*a* and a protection cover that covers a part of the external exposure portion of the photosensitive member 1*a* and a protection member (sheet or film) disposed in the protection cover 2 may cover the rest of the external exposure portion of the photosensitive member 1*a*.

Additionally, "before the process cartridge 1 is inserted and mounted to the image forming apparatus housing body 10" broadly means a state before the process cartridge 1 is inserted and mounted to the image forming apparatus housing body 10. Examples thereof include a case where the process cartridge 1 is shipped and conveyed, and a case where the process cartridge 1 is inserted and mounted. Further, "inserting/mounting operation" indicates that an inserting operation is carried out to thereby realize a mounting operation. As a time point of mounting the protection cover 2 to the process cartridge 1, an example of the time point include, of course, a case where the protection cover 2 is mounted to the process cartridge 1 at the time the process cartridge 1 is shipped and conveyed, but the time point is not limited thereto. For example, an example of the time point includes a case where the process cartridge 1 is protected by a protection sheet other than the protection cover 2 at the time of a shipment/conveyance of the process cartridge 1 and the protection sheet are detached therefrom just before the process cartridge 1 is inserted and mounted to the image forming apparatus 10 to mount the protection cover 2 to the process cartridge 1.

In addition, the protection cover 2 may include the cover base 3, the extrusion member 4, and the restriction portion 5.

At this time, examples of the cover base 3 include a cover base that entirely surrounds the process cartridge 1 and an appropriate cover base so long as the cover base 3 covers at least the photosensitive member 1*a* and comes into contact with the image forming apparatus housing body 10 to movably guide the process cartridge 1 at the time the process cartridge 1 is inserted to the image forming apparatus housing body 10.

In addition, examples of a guide portion of the process cartridge 1 include a guide portion with a rail shape and a guide portion that appropriately uses a wall surface of the cover base 3 so long as the process cartridge 1 engages with the guide portion so as to move relatively.

An example of the extrusion member 4 includes an extrusion member that is disposed on the opposite side of the insertion direction where the process cartridge 1 is inserted to the image forming apparatus housing body 10 so as to extrude the process cartridge 1 in the insertion direction, which is used as an operation member at the time the process cartridge 1 is inserted and mounted to the image forming apparatus housing body 10.

An example of the restriction portion 5 includes a restriction portion that restricts the process cartridge 1 in the cover base 3 in a state where the process cartridge 1 is located in the cover base 3, that is, a state just before the process cartridge 1 is inserted and mounted to the image forming apparatus housing body 10 and releases the restriction state after the process cartridge 1 is inserted and mounted thereto.

A desirable example of the protection cover 2 for realizing the restriction and release of the restriction portion 5 includes a protection cover that has a guide surface on which the extrusion member 4 is guided such that at least a part of the guide surface has an ascending slope portion in the insertion direction where the process cartridge 1 is inserted to the image forming apparatus housing body 10 so as to change a relative position between the restriction portion 5 and the process cartridge 1.

Additionally, the release operation of the restriction portion 5 by the use of the extrusion member 4 can be carried out not only by the method of using the slope portion described above, but also by a method of releasing the restriction state between the process cartridge 1 and the restriction portion 5 at a position where the process cartridge 1 is inserted and mounted to the image forming apparatus housing body 10. In this example, it is not important whether the extrusion member 4 is detached from the protection cover 2.

A desirable example of the protection cover 2 includes a protection cover that can position and hold the protection cover 2 to the image forming apparatus housing body 10.

An example of a positioning/holding structure of such a protection cover 2 includes a positioning/holding structure that includes a positioning/holding portion 6 which is disposed in the cover base 3 on the side where the process cartridge 1 is inserted to the image forming apparatus housing body 10 to position and hold-the cover base 3 so as not to be drawn therefrom upon inserting and mounting the process cartridge 1 thereto and to release the positioning/holding state after the process cartridge 1 is inserted and mounted thereto. At this time, the extrusion member 4 releases the holding state of the positioning/holding portion 6 at an extrusion end position at the time the extrusion member 4 ends the inserting/mounting operation of the process cartridge 1.

Such a positioning/holding portion 6 needs to have a positioning function and a holding function, but is not necessarily limited to a positioning/holding portion 6 in which both functions are assigned to the same position. For example, there is a positioning/holding portion in which the positioning portion and the hold portion are separately provided such that a positioning function is realized at the positioning portion and the holding function for preventing a drawing operation is realized at the hold portion, so that both portions realize the positioning function and the holding function. Additionally, of course, a simple positioning portion may be added to the positioning/holding portion 6.

At this time, in the positioning/holding portion 6, "positioning/holding operation to prevent a drawing operation" means a holding state where the cover base 3 cannot be drawn. Meanwhile, "the positioning/holding state can be released after the insertion/mounting of the process cartridge 1" broadly means not only a time point when the insertion/mounting of the process cartridge 1 ends, but also a time point when the holding state can be released afterward. In this case, a desirable example of release means includes release means that carries out a release operation in accordance with an inserting/mounting operation of the process cartridge 1, but also an example thereof includes release means that carries out a release operation independently from the inserting/mounting operation of the process cartridge 1.

A desirable example of the positioning/holding portion 6 includes a positioning/holding portion which carries out both the positioning function and the holding function for preventing a drawing operation of the cover base 3. A typical example includes a positioning/holding portion 6 in which the positioning/holding portion 6 has an elastic hold piece which is elastically deformable so as to be hooked in a positioning hole formed in the image forming apparatus housing body 10 and to thereby be fixed and held therein. However, it is desirable that such a positioning/holding portion 6 has a position regulation mechanism for restricting the extrusion member 4 in the extrusion end position at the time the inserting/mounting operation of the process cartridge 1 ends so as to efficiently prevent a case where the extrusion member 4 is pushed back by a reaction force of the positioning/holding portion 6.

Additionally, in a viewpoint of reducing an extrusion operation force of the extrusion member 4, it is desirable that the restriction portion 5 includes a pair of elastic restriction pieces which are elastically deformable, and the elastic restriction piece is provided with a flange portion which comes into contact with the blocking portion of the cover base 3 so as to elastically deform the pair of elastic restriction pieces to fall inward. At this time, at least two steps of slope guide surfaces are formed in a portion of the flange portion which comes into contact with the blocking portion of the cover base 3. Also, it is desirable that the angle formed between the subsequent slope guide surface and the blocking portion is set to be smaller than that formed between the initial slope guide surface and the blocking portion with respect to the extrusion direction of the extrusion member 4.

At this time, it is desirable that an angle formed between the initial slope guide surface and the blocking portion is set so that a component force can support the self weight of the process cartridge 1.

The embodiment provides not only such a protection cover 2, but also the process cartridge 1 using the protection cover 2 or the image forming apparatus.

Hereinafter, an exemplary embodiment of the invention will be described with reference to the accompanying drawings.

B. Exemplary Embodiment 1

Overall Configuration of Image Forming Apparatus

Figure 2:
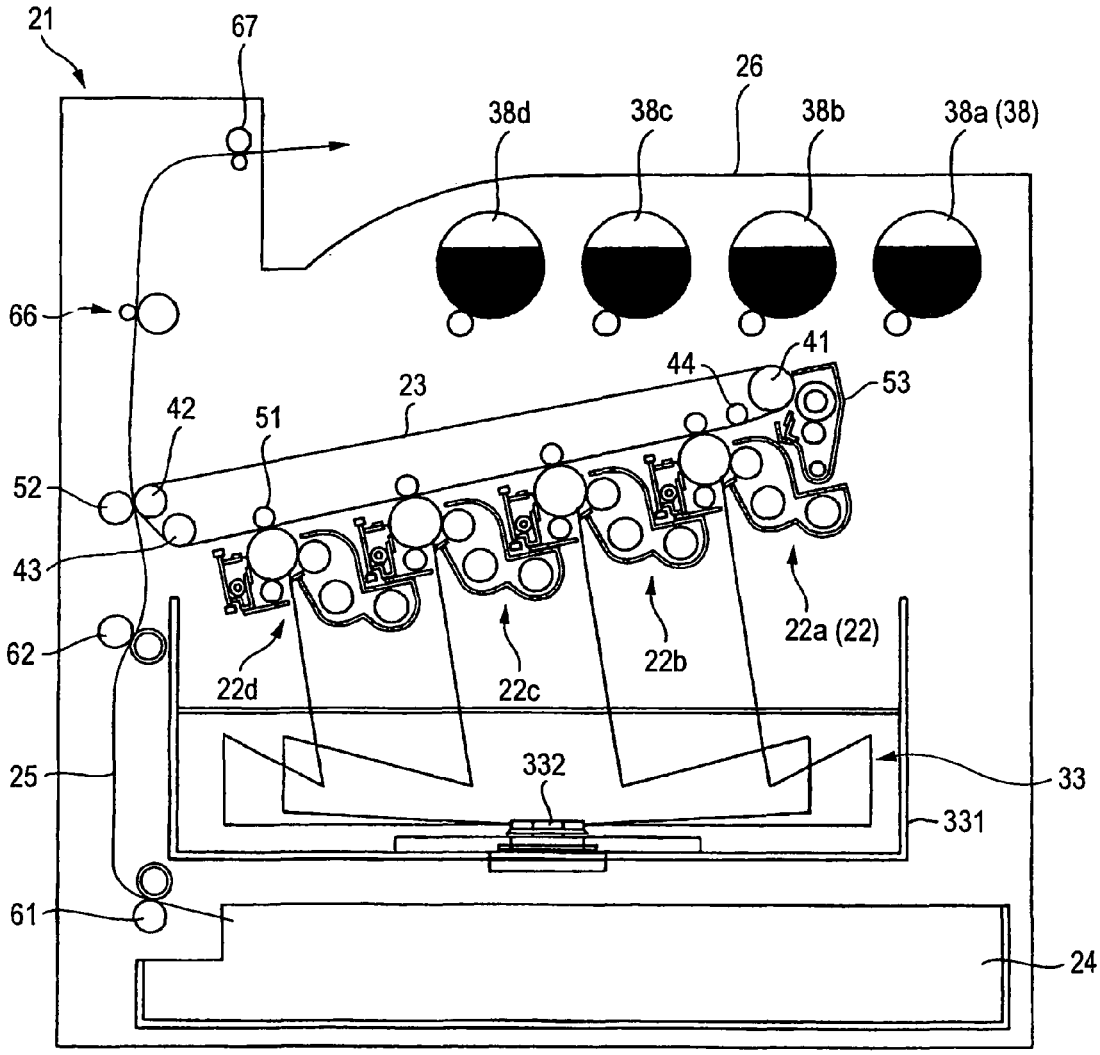
FIG. 2 is a view illustrating an overall configuration of the image forming apparatus according to a first embodiment.

FIG. 2 illustrates an overall configuration of an image forming apparatus according to a first embodiment of the invention.

In the same drawing, in the image forming apparatus, image forming units 22 (specifically, 22*a* to 22*d*) of four colors (in the embodiment, black, yellow, magenta, and cyan) are arranged in the inside of an image forming apparatus housing body (hereinafter, referred to as an apparatus housing body) 21 in the width direction so as to be obliquely upward and slightly inclined. An intermediate transfer belt 23 which moves in circulation in the arrangement direction of the image forming units 22 is disposed thereabove. Additionally, a printing sheet supply unit 24 in which printing sheets to be supplied are received is disposed below the apparatus housing body 21. A printing medium ejection receive unit 26 which receives a printing sheet on which an image forming operation is performed is disposed above the apparatus housing body 21. A printing sheet supplied from the printing sheet supply unit 24 is ejected to the printing medium ejection receive unit 26 through a conveyance passage 25 which extends vertically.

Figure 3B:
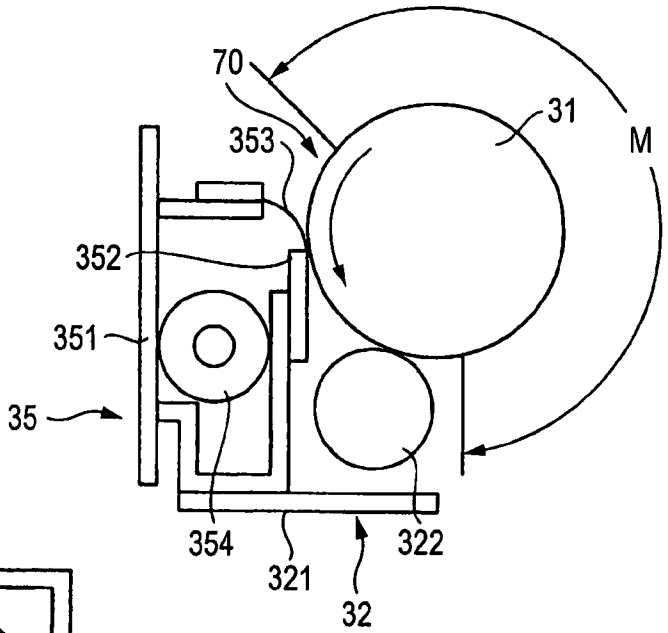
FIG. 3B is a view illustrating the process cartridge.
Figure 3A:
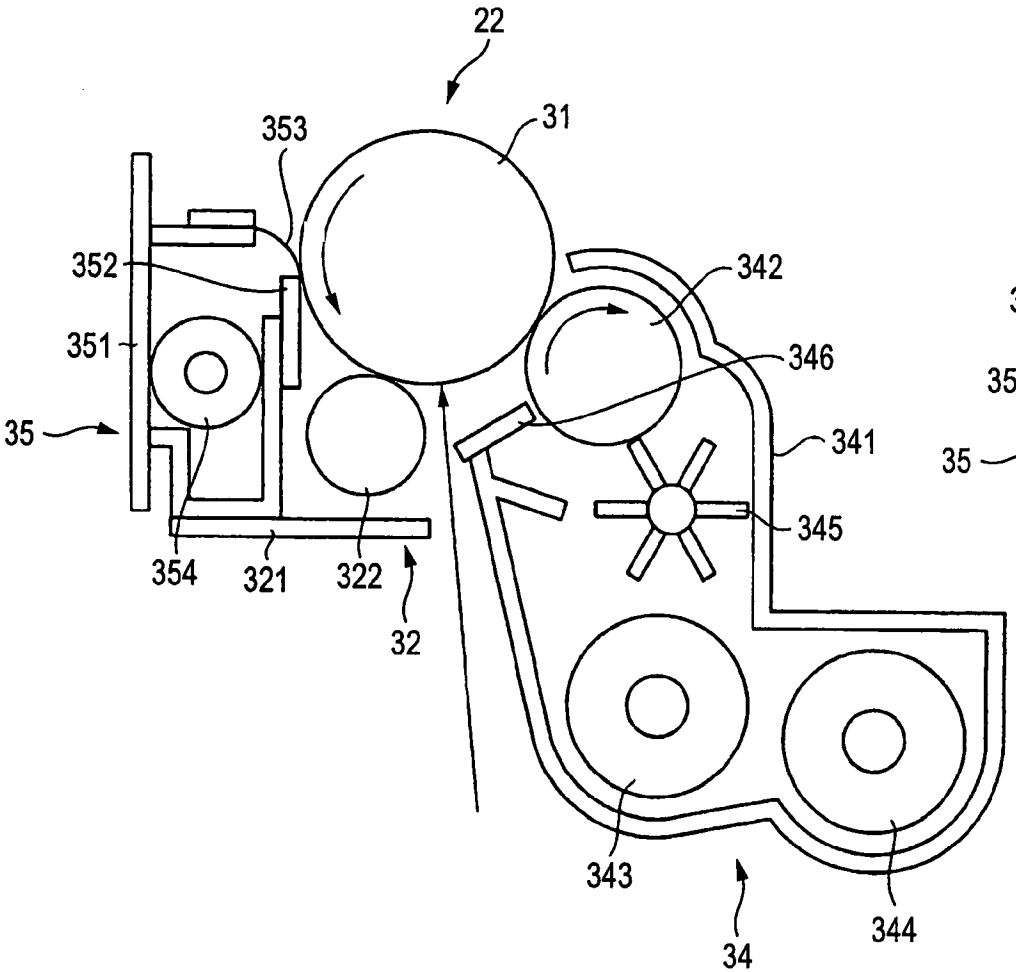
FIG. 3A is a view schematically illustrating image forming units of color components according to the embodiment.

In the embodiment, each of the image forming units 22 (22*a* to 22*d*), as shown in FIGS. 2 and 3A, forms toner images of, for example, black, yellow, magenta, and cyan (the arrangement is not necessarily limited to this sequence) in a sequential manner from the upstream side of the circulation direction of the intermediate transfer belt 23. For example, each of the image forming units 22 includes a photosensitive member 31 with a drum shape, a charger 32 which charges the photosensitive member 31 in advance, an exposure 33 which forms an electrostatic latent image on the photosensitive member 31 charged by the charger 32, a developer unit 34 which visualizes the electrostatic latent image on the photosensitive member 31 with each color toner, and a cleaner 35 which cleans a residual toner on the photosensitive member 31.

At this time, the exposure 33 is common to each of the image forming units 22. Light from a light source such as a semiconductor laser (not shown) of each color component in an exposure container 331 is deflectably radiated by a deflection mirror 332, and then a light image is derived to an exposure position of the corresponding photosensitive member 31 through an imaging lens and a mirror which are not shown.

The intermediate belt 23 is suspended on tight suspension rolls 41 to 44, and for example, the tight suspension roll 41 is configured to be moved in circulation by a drive roll. In the rear surface of the intermediate transfer belt 23 corresponding to each of the photosensitive members 31, a first transfer unit 51 (i.e., a first transfer roll) is disposed. Upon applying a voltage with polarity which is opposite to charge polarity of the toner to the first transfer unit 51, the toner image on the photosensitive member 31 is configured to be electrostatically transferred to the intermediate transfer belt 23

In a position corresponding to the tight suspension roll 42 on the downstream side of the image forming unit 22*d* which is located at the downmost side of the moving direction of the intermediate transfer belt 23, a second transfer unit 52 (i.e., a second transfer roll) is disposed, and a second transfer (one-shot transfer) of the first transfer image on the intermediate transfer belt 23 is configured to be performed on a printing sheet.

In a position corresponding to the tight suspension roll 41 on the downstream side of the second transfer region of the intermediate transfer belt 23, an intermediate cleaner 53 which cleans a residual toner on the intermediate transfer belt 23 is disposed.

At this time, the intermediate transfer belt 23 is formed such that an appropriate amount of a charge prevention material such as a carbon black is contained in resin such as polyimide, polycarbonate, polyester, and polypropylene or various type of rubber so that volume resistivity is in the range of $10^6$ to $10^{14}$·Ωcm.

In the embodiment, a printing sheet supplied from a feeder 61 of the printing sheet supply unit 24 is conveyed to an appropriate number of conveyance rolls (not shown) in the course of the printing sheet conveyance passage 25 and is positioned by a positioning roll 62 Subsequently, the printing sheet passes through the second transfer region of the second transfer unit 52 so that a non-fixed toner image is fixed by a fixing unit 66 under heat and pressurization and then is ejected and received in the printing medium ejection receive unit 26 through an ejection roll 67.

Additionally, in FIG. 2, Reference Numeral 38 (38*a* to 38*d*) denotes a toner supply unit which supplies a new toner to the developer unit 34 of each image forming unit 22 (22*a* to 22*d*).

-Image Forming Unit-

In particular, in the embodiment, as shown in FIGS. 3A and 3B, the photosensitive member 31 includes a process cartridge 70 which is incorporated with the charger 32 and the cleaner 35. The process cartridge 70 is detachably mounted to the apparatus housing body 21 so as to configure a part of the image forming unit 22 of each color component.

At this time, the charger 32 includes a charger container 321 of which a portion opposed to the photosensitive member 31 is opened, and a charge roll 322 which comes into contact with a surface of the photosensitive member 31 or which is close thereto is disposed in the charge container 321.

The cleaner 35 includes a cleaner container 351 of which a portion opposed to the photosensitive member 31 is opened. At this time, in one edge portion in the longitudinal direction of the cleaner container 351, an elastic scrape plate 352 which comes into contact with the photosensitive member 31 is disposed. In the other edge portion in the longitudinal direction of the cleaner container 351, an elastic seal material 353 which comes into contact with the photosensitive member 31 is disposed. In the cleaner container 351, a uniform conveyance member 354 which allows residual materials such as a toner scraped by the elastic scrape plate 352 to be uniform in the longitudinal direction is disposed.

For this reason, in the embodiment, in the process cartridge 70, as shown in FIG. 3B, a part of the vicinity of the photosensitive member 31 is covered with the charger 32 and the cleaner 35, and the rest of the vicinity of the photosensitive member 31 is directly exposed as an exposure portion M.

In the embodiment, the developer 34 is mounted to the apparatus housing body 21 separately from the process cartridge 70, is opposed to the photosensitive member 31 to be opened thereto, and includes a developer container 341 which contains a developer having at least a toner. In the opening of the developer container 341, a developer hold body 342 which can convey a developer toward a developer region located at a position opposed to the photosensitive member 31 is disposed. In the rear surface of the developer hold body 342 of the developer container 341, a pair of developer mix conveyance members 343 and 344 which can convey the developer while being circulated and mixed are disposed. Between the developer hold body 342 and the developer mix conveyance member 343 disposed on the side of the developer hold body 342, a developer supply member 345 which can supply the mixed conveyed developer to the developer hold body 342 is disposed. Also, the developer supplied to the developer hold body 342 is regulated by a layer thickness regulation member 346 to be a predetermined layer thickness, and then is supplied to the developer region.

-Process Cartridge-

Figure 4:
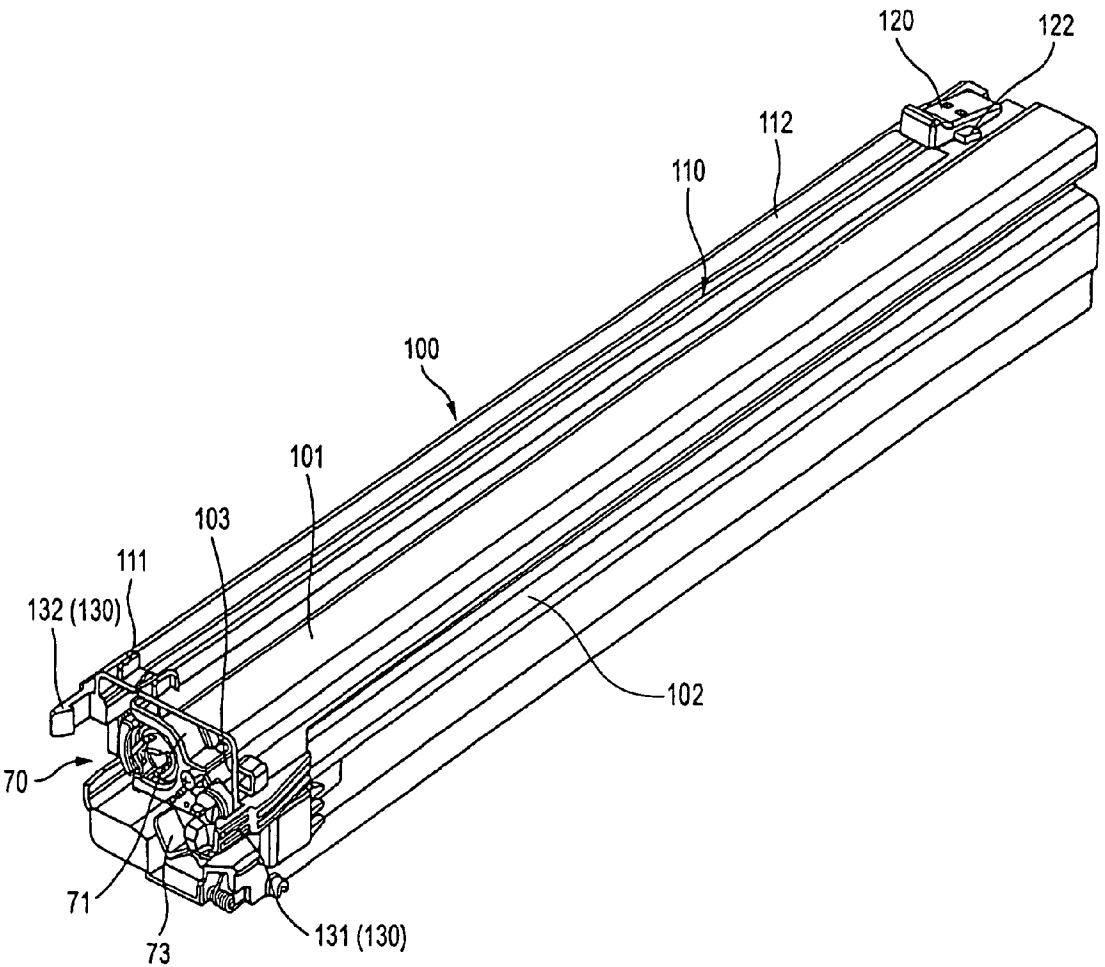
FIG. 4 is a view illustrating the process cartridge before the inserting/mounting operation thereof to an image forming apparatus housing body.
Figure 8:
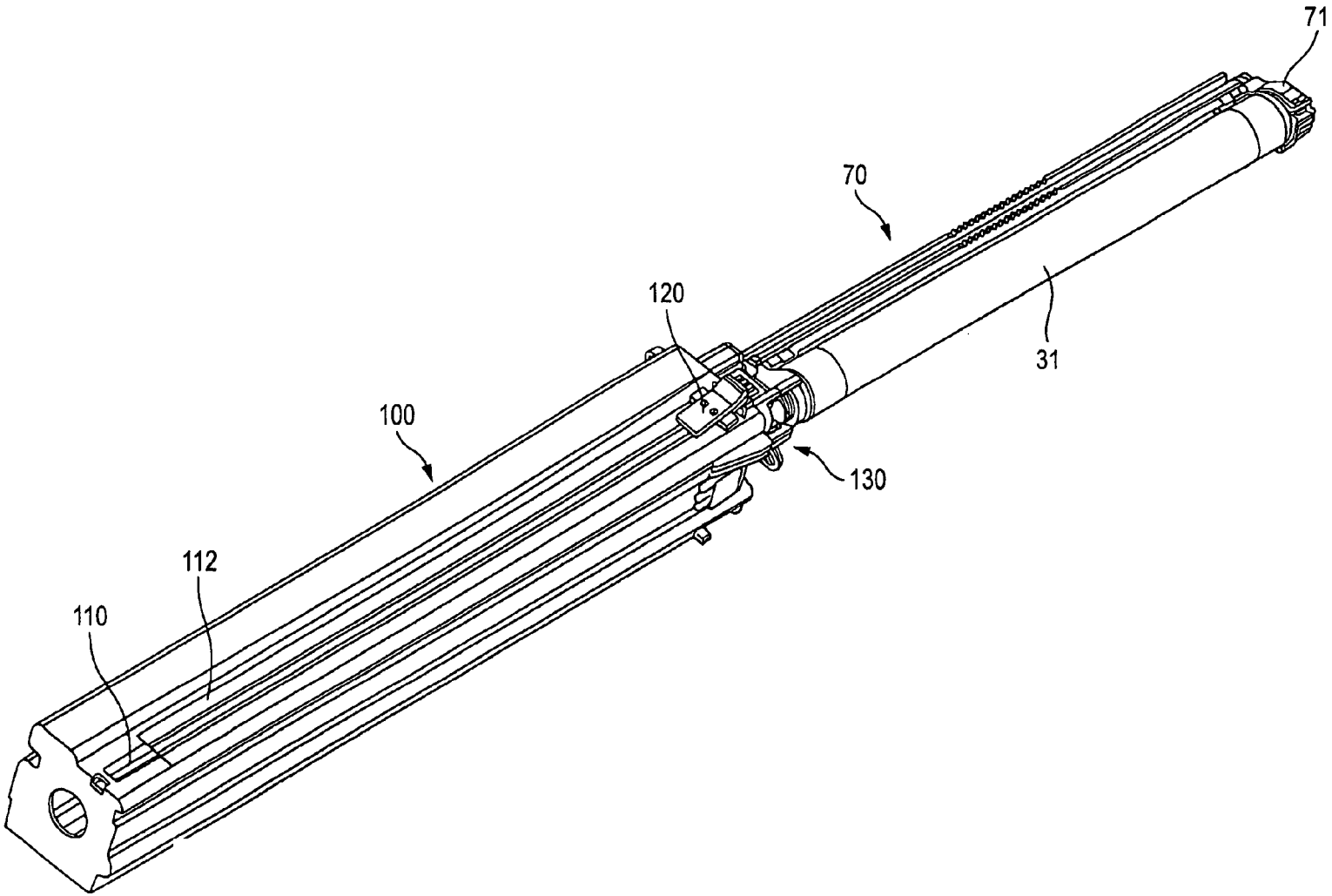
FIG. 8 is a view illustrating a state where the process cartridge is inserted from the protection cover.

In the embodiment, the process cartridge 70, as shown in FIGS. 4 and 8, includes a cartridge frame 71 which is formed of plastic such as ABS resin. The cartridge frame 71 is incorporated with the photosensitive member 31, the charger 32, and the cleaner 35.

The configuration of the process cartridge 70 is not limited to the above-described example, but can be applied to an example in which a monochromatic image is formed.

The example of the process cartridge 70 is not limited to the above-described example, but also includes an example in which only the photosensitive member 31 is in a form of a cartridge, an example in which the photosensitive member 31 and the charger 32 are integrally formed with each other so as to be detachably mounted to the apparatus housing body 21, an example in which the photosensitive member 31 and the developer unit 34 are integrally formed with each other so as to be detachably mounted to the apparatus housing body 21, an example in which the photosensitive member 31 and the cleaner 35 are integrally formed with each other so as to be detachably mounted to the apparatus housing body 21, and an example in which two or more of the photosensitive member 31 and the above-described process device are combined with each other so as to configure a single cartridge and to be detachably mounted to the apparatus housing body 21.

In the embodiment, in the process cartridge 70, the charger 32 and the cleaner 35 are disposed in the lower portion than the horizontal line containing the center of the photosensitive member 31 in the gravity direction. In this manner, since the charger 32 is disposed below the photosensitive member 31, a part of the cartridge frame 71 can be used as a positioning portion for performing a positioning operation to a protection cover 100 described below or a guide portion for performing a guide portion upon being inserted to the apparatus housing body 21. Accordingly, it is possible to reduce the number of the positioning portions and the guide portions which are necessarily provided in addition, and thus it is advantageous to realize a space saving and the reduction in the number of components which have been strongly demanded.

In the embodiment, in the process cartridge 70, the charger 32 and the cleaner 35 are disposed in the lower portion than the horizontal line containing the center of the photosensensitive member 31 in the gravity direction. In this manner, since the charger 32 is disposed below the photosensitive member 31, a part of the cartridge frame 71 can be used as a positioning portion for performing a positioning operation to a protection cover 100 described below or a guide operation for performing a guide operation upon being inserted to the apparatus housing body 21. Accordingly, it is possible to reduce the number of the positioning portions and the guide portions which are necessarily provided in addition, and thus it is advantageous to realize a space saving and the reduction in the number of components which have been strongly demanded.

-Protection Cover-

In the embodiment, as shown in FIGS. 4 and 8, the process cartridge 70 includes the protection cover 100 before the process cartridge 70 is inserted and mounted to the apparatus housing body 21.

The protection cover 100 protects the exposure portion M (see FIG. 3B) of the photosensitive member 31 of the process cartridge 70 and is detachably mounted to the process cartridge 70 so as to be detached therefrom after the process cartridge 70 is inserted and mounted to the apparatus housing body 21.

In the embodiment, the protection cover 100 is formed in a substantially hollow rectangular parallelepiped shape so as to surround the process cartridge 70, and includes a cover base 101 which extends in the longitudinal direction. The cover base 101 is integrally made of plastic such as ABS resin.

Figure 23:
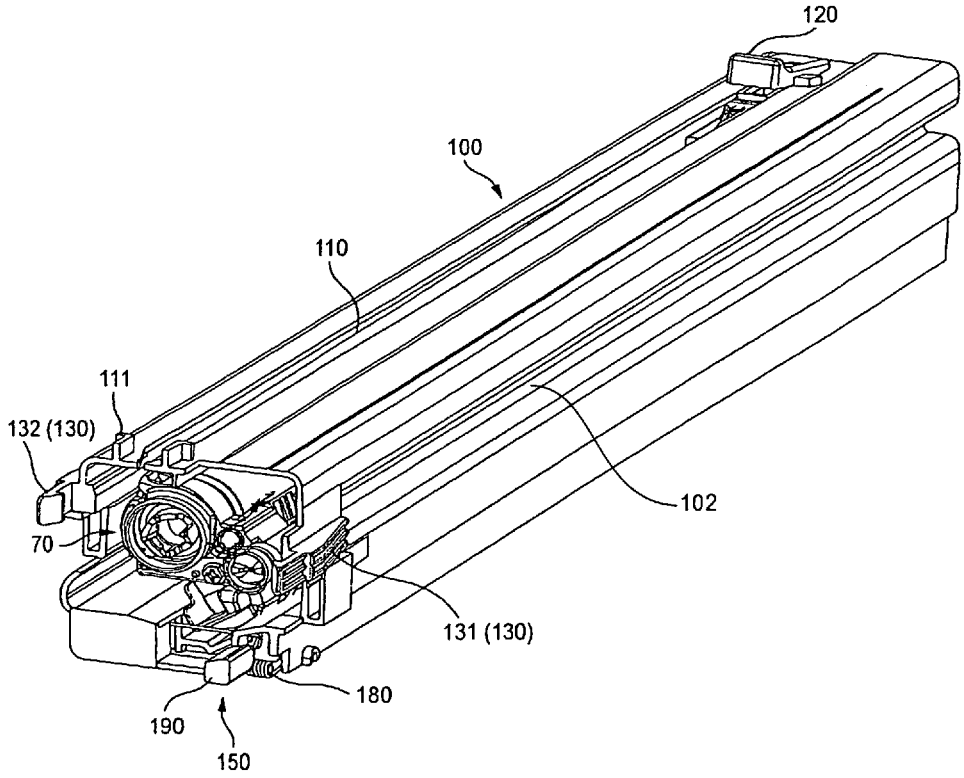
FIG. 23 is a view illustrating another example of the restriction mechanism and a restriction release mechanism of the process cartridge.
Figure 24:
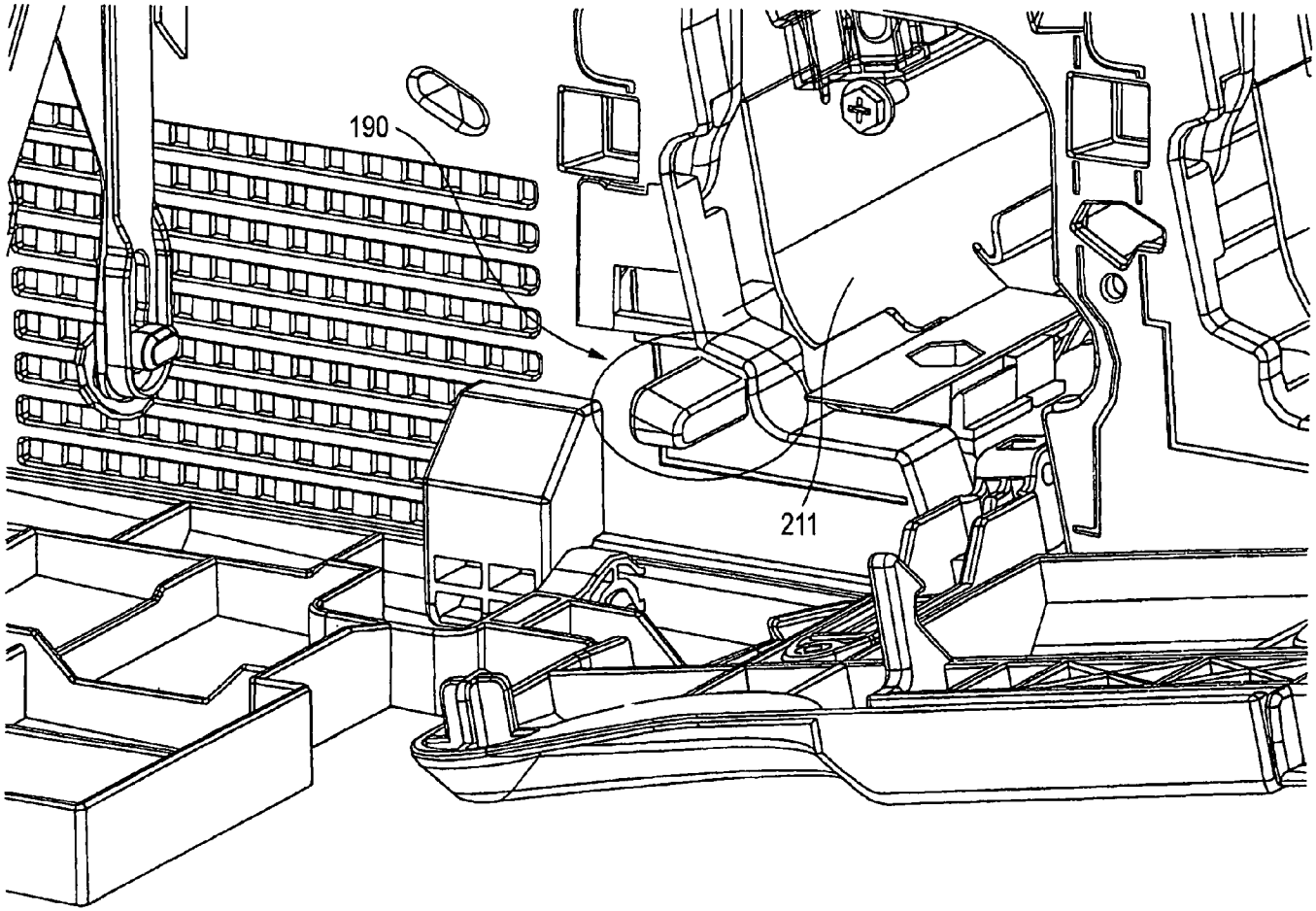
FIG. 24 is a view illustrating an example of the restriction release mechanism shown in FIG. 23.
Figure 25:
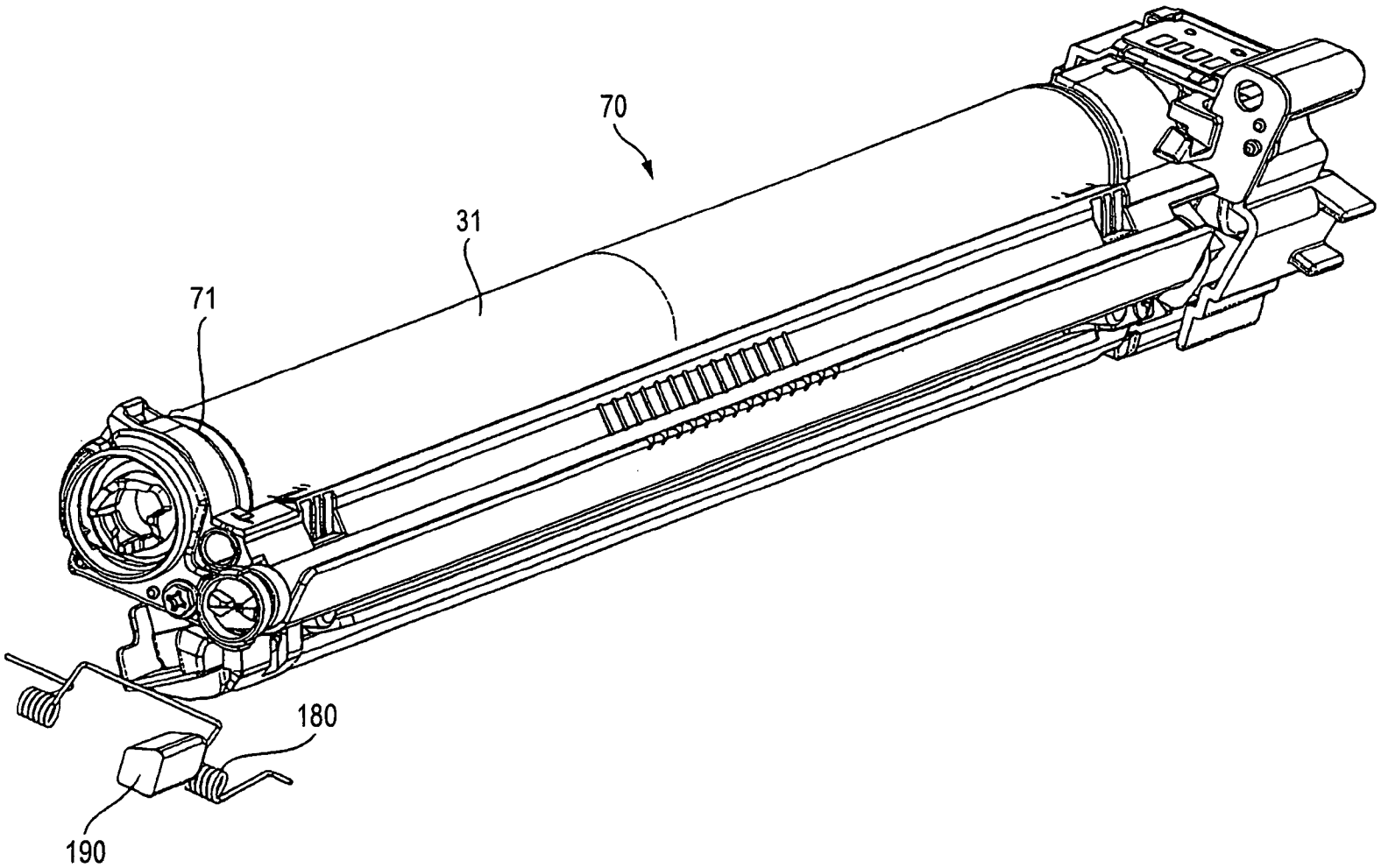
FIG. 25 is a view illustrating a main part of the restriction mechanism and the restriction release member shown in FIG. 23.
Figure 26A:
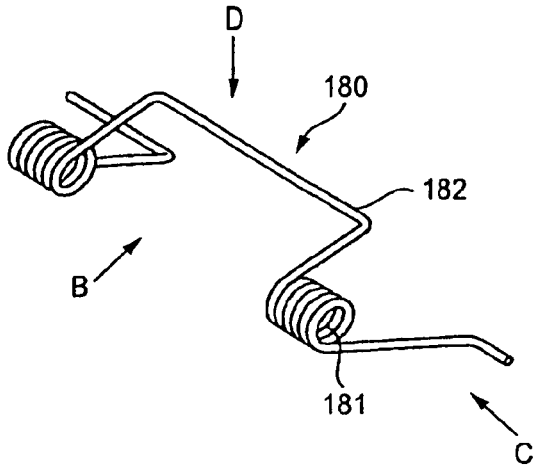
FIG. 26A is a perspective view illustrating a torsion spring as the restriction mechanism.
Figure 26B:
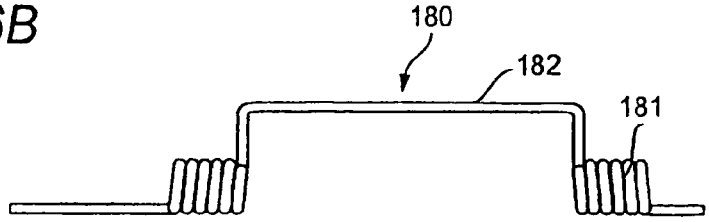
FIGS. 26B to 26D are views when viewed in the arrow B direction, arrow C direction, and arrow D direction shown in FIG. 26A, respectively.
Figure 26C:
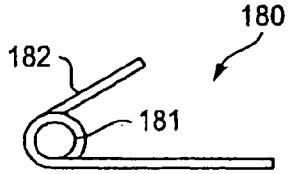
Figure 26D:
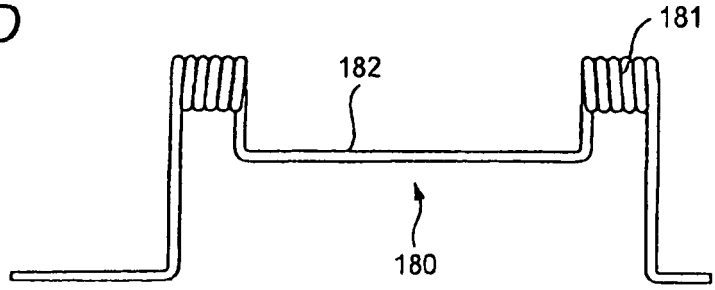
Figure 27A:
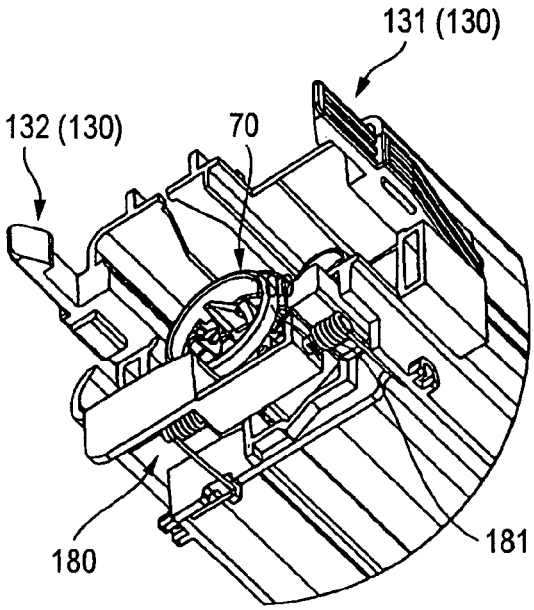
FIG. 27A is a view illustrating a relationship between the restriction release mechanism and the torsion spring as the restriction mechanism.
Figure 27B:
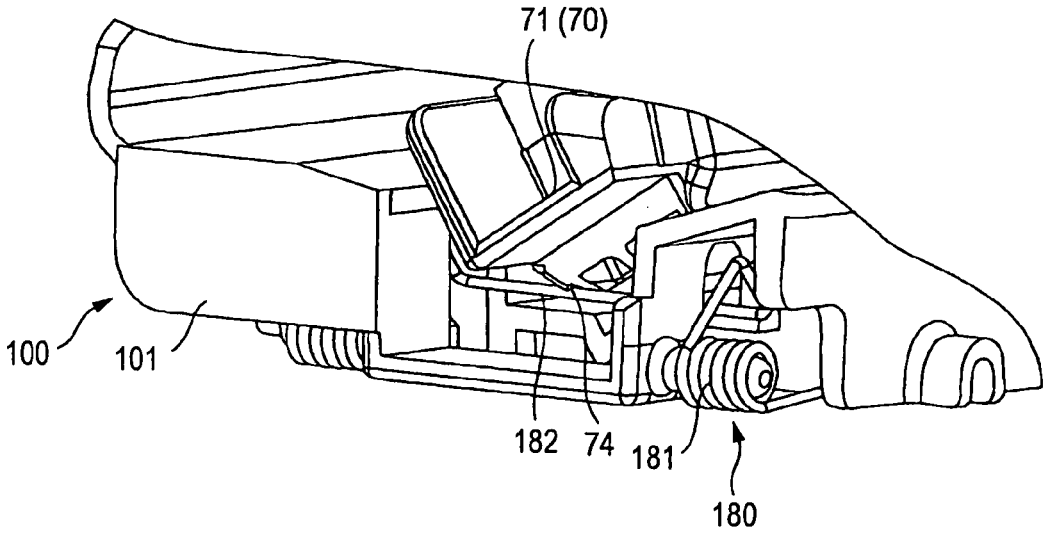
FIG. 27B is a view illustrating a state where the process cartridge is restricted by the torsion spring.

Additionally, the cover base 101 is provided with a guide portion (a guide rail 102 (see FIG. 23) and a guide inner wall 103) in a position corresponding to a guide protrusion 73 of the cartridge frame 71 or the outer wall of the charger container 321 of the charger 32. That is, in the example, the guide rail 102 is disposed in the inner side of the bottom wall of the cover base 101 so as to slidably move the guide protrusion 73 of the cartridge frame 71. Additionally, the guide inner wall 103 is disposed in the inner surface of the side wall of the cover base 101 so as to slidably move the outer wall of the charger container 321 of the charger 32, so that the insertion posture of the process cartridge 70 is regulated.

Figure 7:
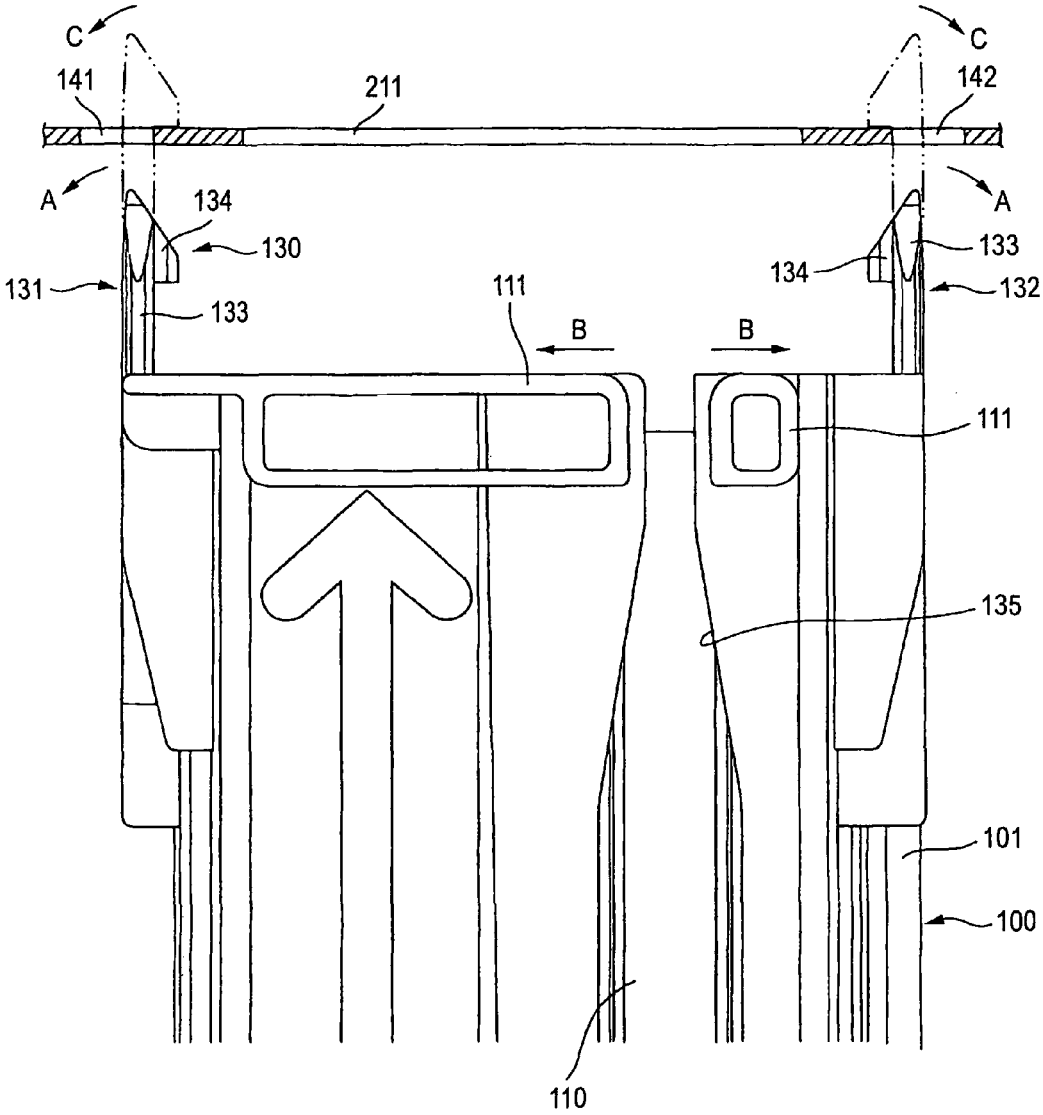
FIG. 7 is a view schematically illustrating a positioning/holding mechanism of the protection cover.

In the embodiment, as shown in FIGS. 4, 7, and 8, the upper wall of the cover base 101 of the protection cover 100 is provided with a guide slit 110 in the longitudinal direction of the cover base 101. The guide slit 110 is formed in a longitudinal shape in which the edge of the cover base 101 on the side of the apparatus housing body 21 is opened. At this time, an operation lever 120 for extruding the process cartridge 70 in the protection cover 100 is configured to be slidably movable in the guide slit 110.

In the embodiment, the operation lever 120 includes a lever main body 121 (see FIGS. 10A and 10B) which can slidably move in the guide slit 110. The lever main body 121 is provided with a stopper 122 with a flange shape which slidably moves along the edge portion of the guide slit 110. Also, the lever main body 121 is provided with a connection piece 123 (i.e., see FIGS. 10A and 10B) which is connectable to a connection receive portion 72 (i.e., see FIG. 11) of the cartridge frame 71 of the process cartridge 70.

Additionally, the vicinity of the end opening of the guide slit 110 is provided with a retaining step member 111 which comes into contact with the stopper 122 of the operation lever 120. Further, the width of the end opening of the guide slit 110 is set to be narrower than that of other slit portions.

In the embodiment, the connection piece 123 of the operation lever 120 restricts the process cartridge 70 at the time the process cartridge 70 is located in the protection cover 100 by the use of a restriction mechanism described below and releases the restriction state between the process cartridge 70 and the connection piece 123 at the time of the inserting/mounting operation of the process cartridge 70 to the cartridge receive portion 211 of the apparatus housing body 21.

In the embodiment, since the guide slit 110 as a gap exists in the protection cover 100, a problem arises in that light from the guide slit 110 is incident to the inside of the protection cover 100 to thereby deteriorate the photosensitive member 31. Accordingly, in the embodiment, the protection cover 100 is additionally provided with a flexible protection sheet 112, and thus it is possible to prevent light from the guide slit 110 from being incident thereto. Like the embodiment, in the case where the charger (charge roll) 32 using a contact charge method is formed in a unit as the process cartridge 70, a problem arises in that the photosensitive member 31 is friction-charged by the charge roll 322 during a conveyance and the like. In this case, since the flexible protection sheet 112 is disposed between the photosensitive member 31 and the charge roll 322, the contact charge is prevented. Since at least a part of the flexible protection sheet 112 is exposed to the outside of the protection cover 100 through the guide slit 110, the deterioration of the photosensitive member 31 is reduced and the friction charge of the photosensitive member 31 is prevented by the charge roll 322. Accordingly, it is possible to easily detach the flexible protection sheet 112 at the time of the inserting operation of the process cartridge 70.

-Positioning/Holding Mechanism-

Additionally, the cover base 101 is provided with a positioning/holding mechanism 130 on the insertion side of the process cartridge 70 to the apparatus housing body 21.

The positioning/holding mechanism 130 positions and holds the cover base 101 so as not to be drawn therefrom at the time of the inserting/mounting operation of the process cartridge 70 and release the positioning/holding state after the inserting/mounting operation of the process cartridge 70.

In the embodiment, as shown in FIGS. 4, 7, and 8, the positioning/holding mechanism 130 includes a pair of positioning/holding pieces 131 and 132 are disposed on both sides of one end in the longitudinal direction of the cover base 101. The positioning/holding pieces 131 and 132 includes an elastic protrusion piece 133 which protrudes from an end portion of the cover base 101 in the longitudinal direction to the apparatus housing body 21 so as to be elastically deformable, and a hook claw 134 with a hook shape is integrally formed with the front end of the elastic protrusion piece 133. At this time, the elastic protrusion piece 133 is formed in a plate shape in which the thickness is thin in the thickness direction (the thickness of the elastic protrusion piece 133 in the arrow A direction), and the free end is movable in the substantially horizontal direction (which corresponds to the arrow A direction).

Figure 5:
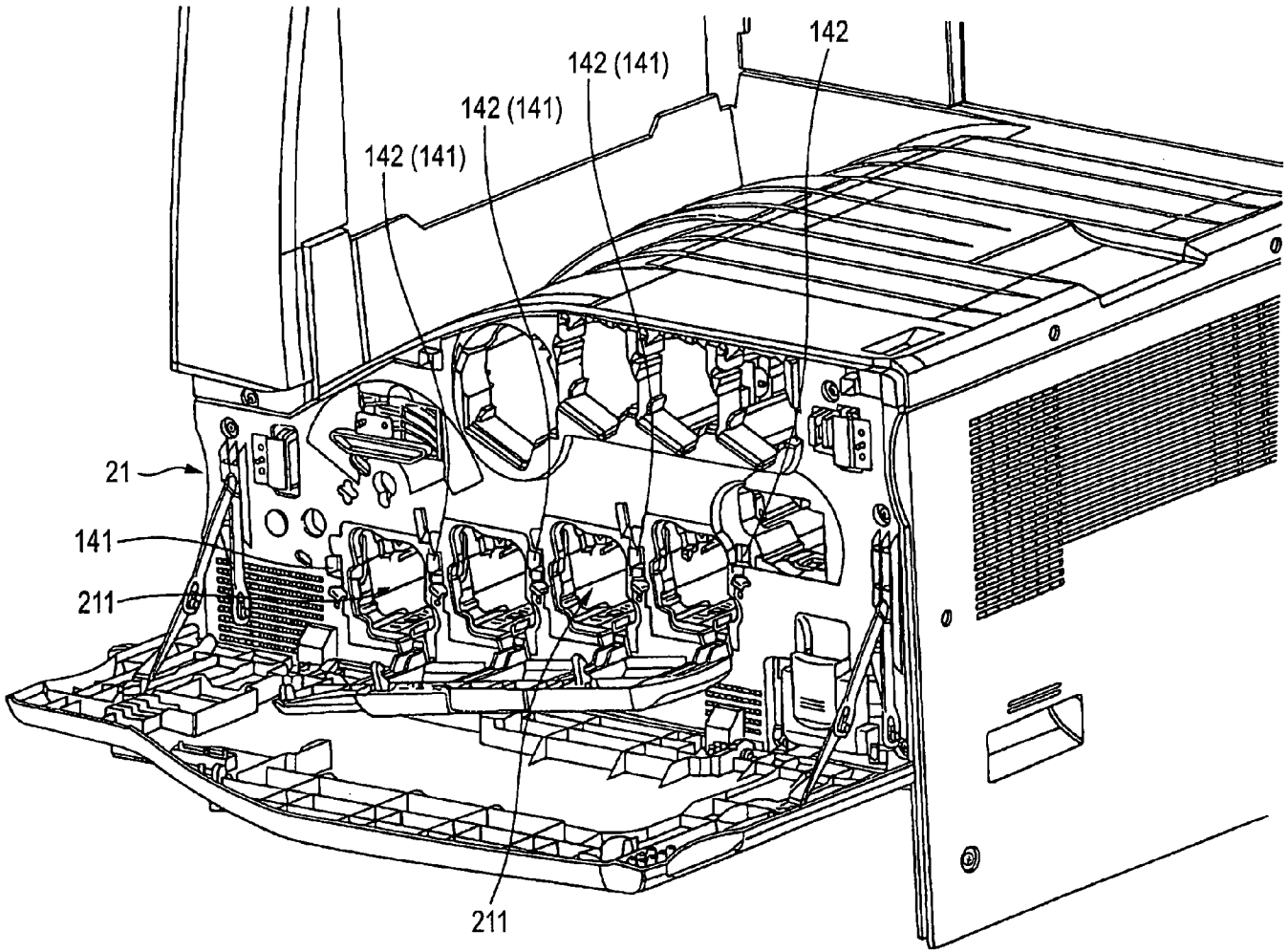
FIG. 5 is a view illustrating an overall configuration of the image forming apparatus housing body according to the embodiment.

Meanwhile, as shown in FIG. 5, a pair of positioning holes 141 and 142 are disposed in the edge of the circumference of the opening of the cartridge receive portion 211 of the apparatus housing body 21. Particularly, in the embodiment, the apparatus housing body 21 includes a plurality of cartridge receive portions 211, and the positioning hole 142 on the other side of the predetermined cartridge receive portion 211 serves as the positioning hole 141 on one side of the cartridge receive portion 211 adjacent thereto.

Additionally, the positioning/holding pieces 131 and 132 of the protection cover 100 is inserted to the positioning holes 141 and 142 of each cartridge receive portion 211 while being elastically deformed in a direction where the positioning/holding pieces 131 and 132 are spaced from each other, so that a positioning operation is carried out. Additionally, the hook claws 134 of the positioning/holding pieces 131 and 132 are held in the edge of the positioning holes 141 and 142 so as not to be drawn therefrom. At this time, the elastic deformation means a degree how the positioning/holding pieces 131 and 132 of the protection cover 100 are deformed by a mounting force occurring when being mounted to the positioning holes 141 and 142.

In the embodiment, particularly as shown in FIG. 7, the guide slit 110 has a taper portion 135 of which the opening width sequentially becomes smaller toward the end opening in front of the retaining step member 111. As shown by the arrow B in FIG. 7, the taper portion 135 serves to widen outwardly the protection cover 100 with the guide slit 110 interposed therebetween at the time the operation lever 120 reaches the taper portion 135, and as described below, to release the holding state between the positioning holes 141 and 142 and the positioning/holding pieces 131 and 132.

Next, a mounting method of the process cartridge 70 using the positioning/holding mechanism 130 will be described below.

Figure 6:
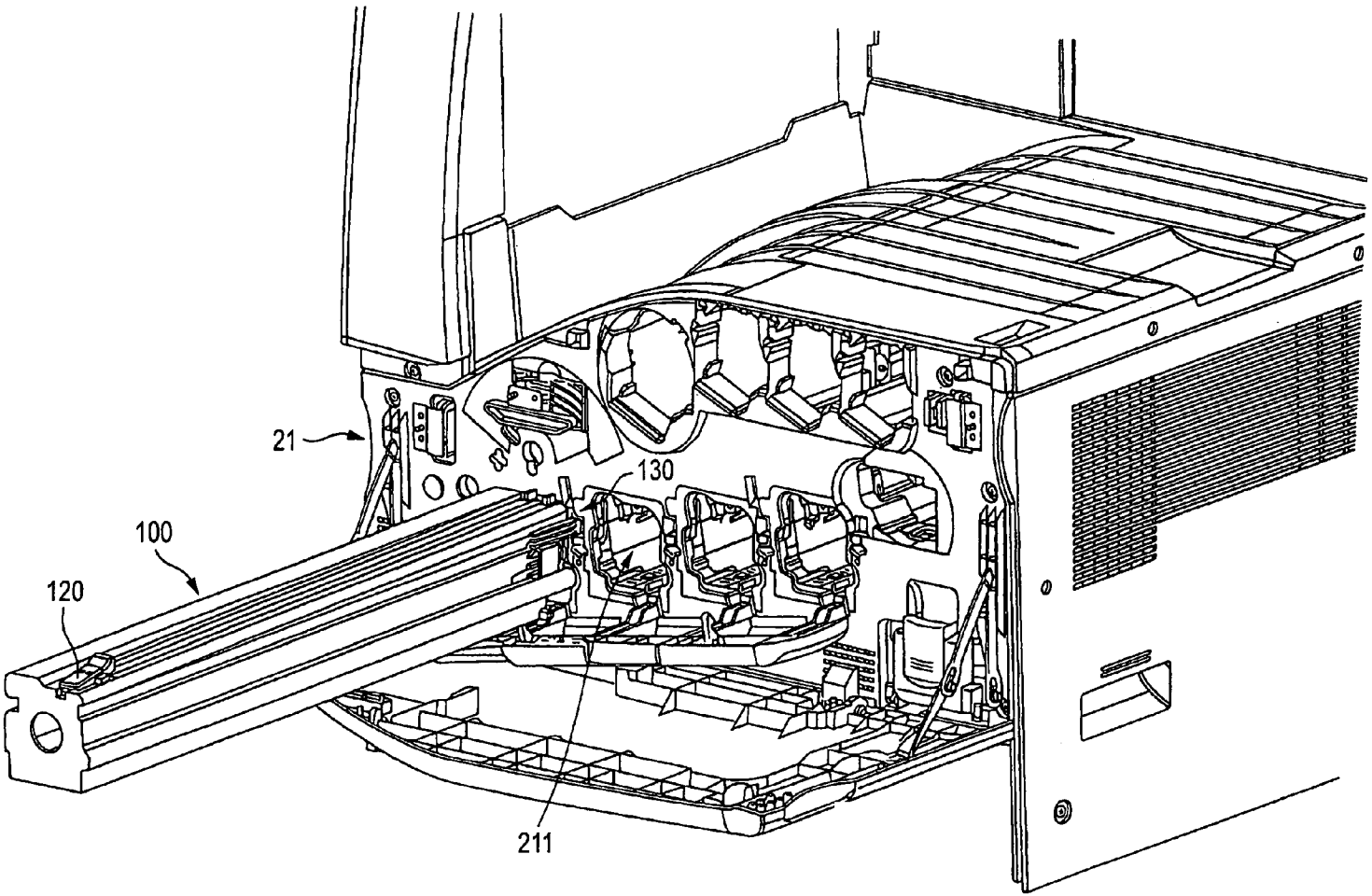
FIG. 6 is a view illustrating a positioning/holding state of the protection cover at the time of a start of the inserting/mounting operation of the process cartridge relative to the image forming apparatus housing body.

First, the positioning/holding pieces 131 and 132 disposed in the protection cover 100 are inserted to the positioning holes 141 and 142 in the edge of the opening of the cartridge receive portions 211 of the apparatus housing body 21 (see FIGS. 4 to 6).

At this time, as shown in FIGS. 5 and 7, the positioning/holding pieces 131 and 132 are inserted to the positioning holes 141 and 142 while being elastically deformed as shown by the arrow A, and then are hooked by the hook claw 134. Subsequently, the protection cover 100 and the process cartridge 70 are positioned and held to the apparatus housing body 21 so as not be drawn therefrom.

In this state, the protection cover 100 is positioned to the apparatus housing body 21. Also, even when a hand is detached from the protection cover 100, the protection cover 100 is fixed thereto so as not to be drawn therefrom at the time of the inserting operation of the process cartridge 70.

In the embodiment, the positioning/holding pieces 131 and 132 are fitted to the positioning holes 141 and 142 on the side of the apparatus housing body 21. Additionally, the end portion of the protection cover 100 comes into contact with the opening protrusion portion of the cartridge receive portion 211 of the apparatus housing body 21. Accordingly, even when a hand is detached from the protection cover 100 at the time of the inserting operation of the process cartridge 70, it is possible to reduce a slope in the insertion direction where the process cartridge 70 is inserted to the apparatus housing body 21.

Afterward, as shown in FIGS. 6 and 8, when the operation lever 120 is extruded in the insertion direction of the process cartridge 70 so as to follow the guide slit 110 disposed in the protection cover 100, the guide portion (guide protrusion and guide outer wall) disposed in the process cartridge 70 is guided by the guide rail 102 and the guide inner wall 103 disposed in the protection cover 100 and the guide portion (guide rail and guide inner wall) disposed in the apparatus housing body 21 to be thereby inserted to the apparatus housing body 21.

In the embodiment, as shown in FIG. 7, the guide slit 110 includes the taper portion 135 in front of the retaining step member 111 of which the gap is narrowed. When the operation lever 120 is extruded to a position of the taper portion 135 of which the gap is narrowed, as shown by B in FIG. 7, the protection cover 100 is widened outwardly with the guide slit 110 interposed therebetween. Accordingly, the positioning/holding pieces 131 and 132 hooked by the positioning holes 141 and 142 are widened outwardly as shown by the arrow C in FIG. 7. As a result, in accordance with the inserting operation of the process cartridge 70, it is possible to release the positioning/holding state where the drawing operation is not permitted by the positioning/holding pieces 131 and 132.

In particular, in the embodiment, since the positioning/holding pieces 131 and 132 are fixed to the apparatus housing body 21 by the use of the hook claw 134 therein, it is possible to carry out the detaching operation when the fixation of the protection cover 100 is released.

Figure 9:
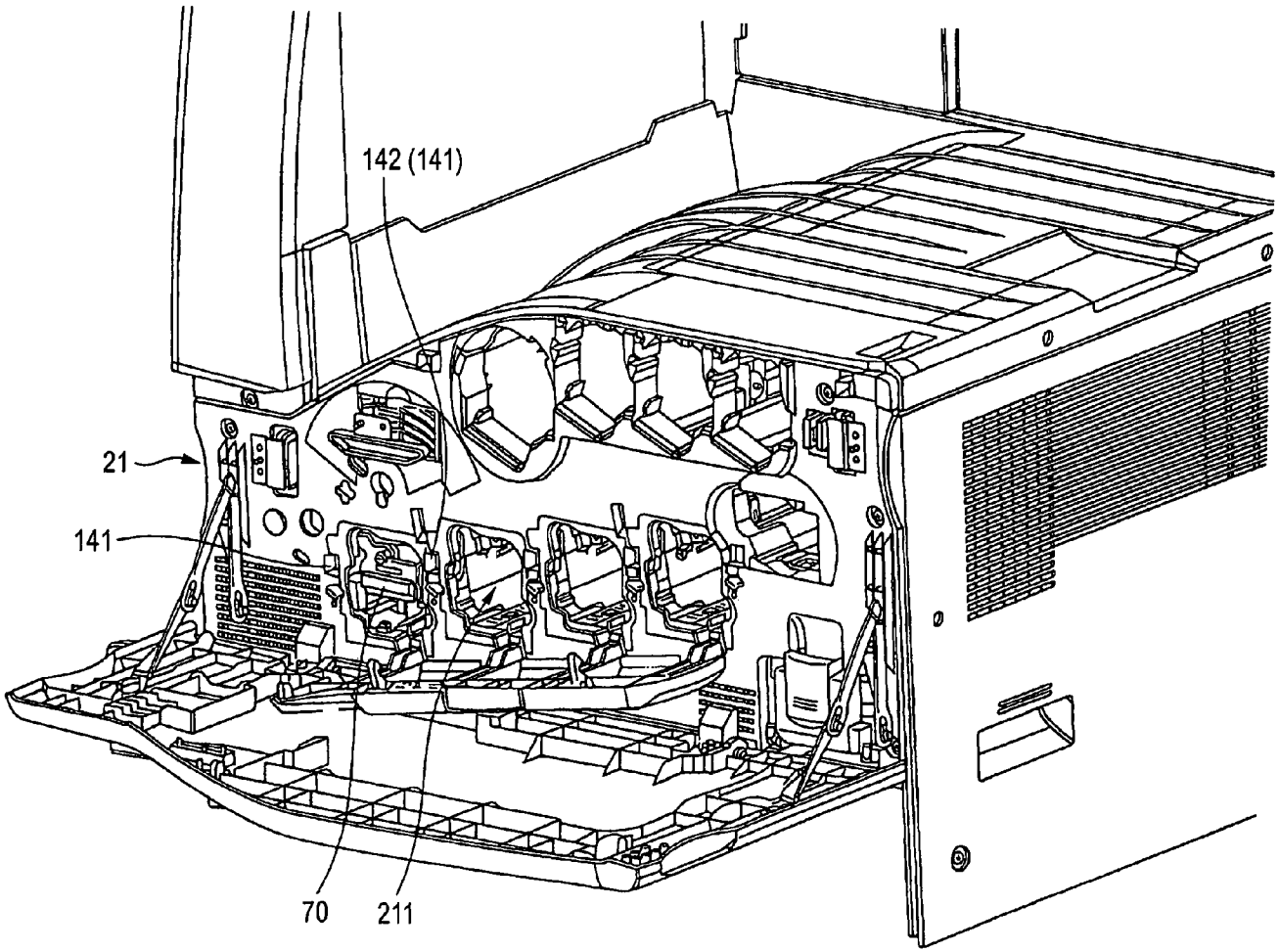
FIG. 9 is a view illustrating a state where the process cartridge is completely inserted and mounted to the image forming apparatus housing body.

Likewise, since the taper portion 135 for releasing the holding state of the positioning/holding pieces 131 and 132 is disposed in the vicinity of the guide slit 110 on the side of the apparatus housing body 21, as shown in FIG. 9, the fixation state (positioning state) of the protection cover 100 with respect to the apparatus housing body 21 is released after the process cartridge 70 is mounted to the apparatus housing body 21.

Accordingly, the process cartridge 70 is slidably guided by the guide rail 102 and the guide inner wall 103 of the protection cover 100 in the longitudinal direction, and thus the process cartridge 70 is inserted to the inside of the apparatus housing body 21.

-Restriction Mechanism-

In the embodiment, a restriction mechanism 150 (see FIGS. 10A and 10B) for restricting the process cartridge 70 in the protection cover 100 is provided.

The restriction mechanism 150 is provided so that the process cartridge 70 is restricted in the cover base 101 in the state where the process cartridge 70 is located in the cover base 101 and the process cartridge 70 is released from the cover base 101 in the state where the process cartridge 70 is inserted and mounted to the apparatus housing body 21.

Hereinafter, typical examples 1 to 5 of the restriction mechanism 150 will be described.

TYPICAL EXAMPLE 1 OF RESTRICTION MECHANISM: SEE FIGS. 10A TO 13

Figure 10A:
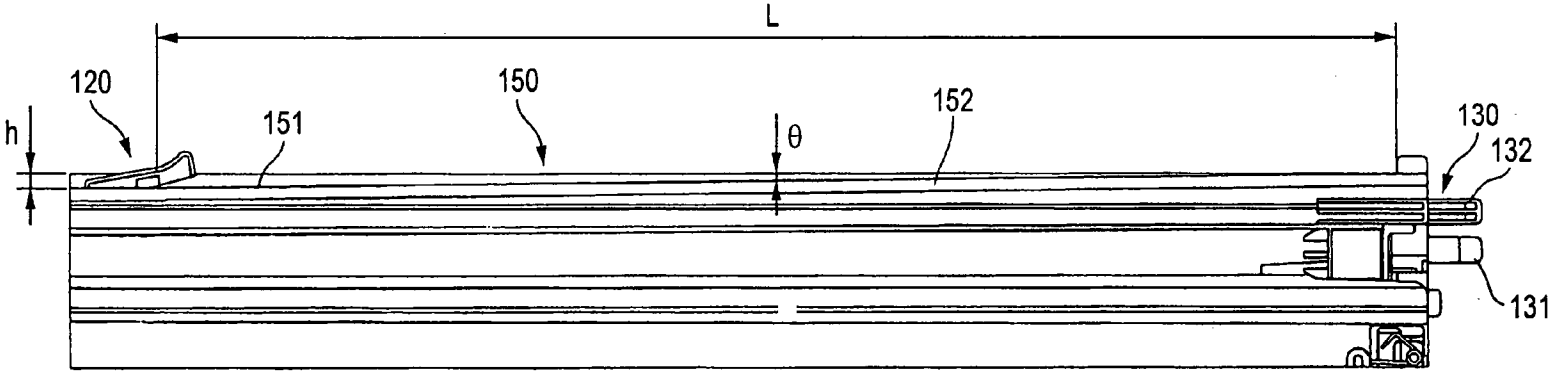
FIG. 10A is a view illustrating an example of a restriction mechanism of the process cartridge.
Figure 10B:
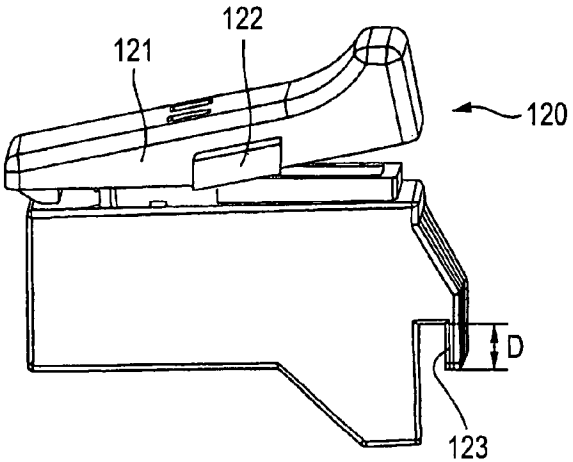
FIG. 10B is a view illustrating a configuration example of an operation lever.
Figure 11:
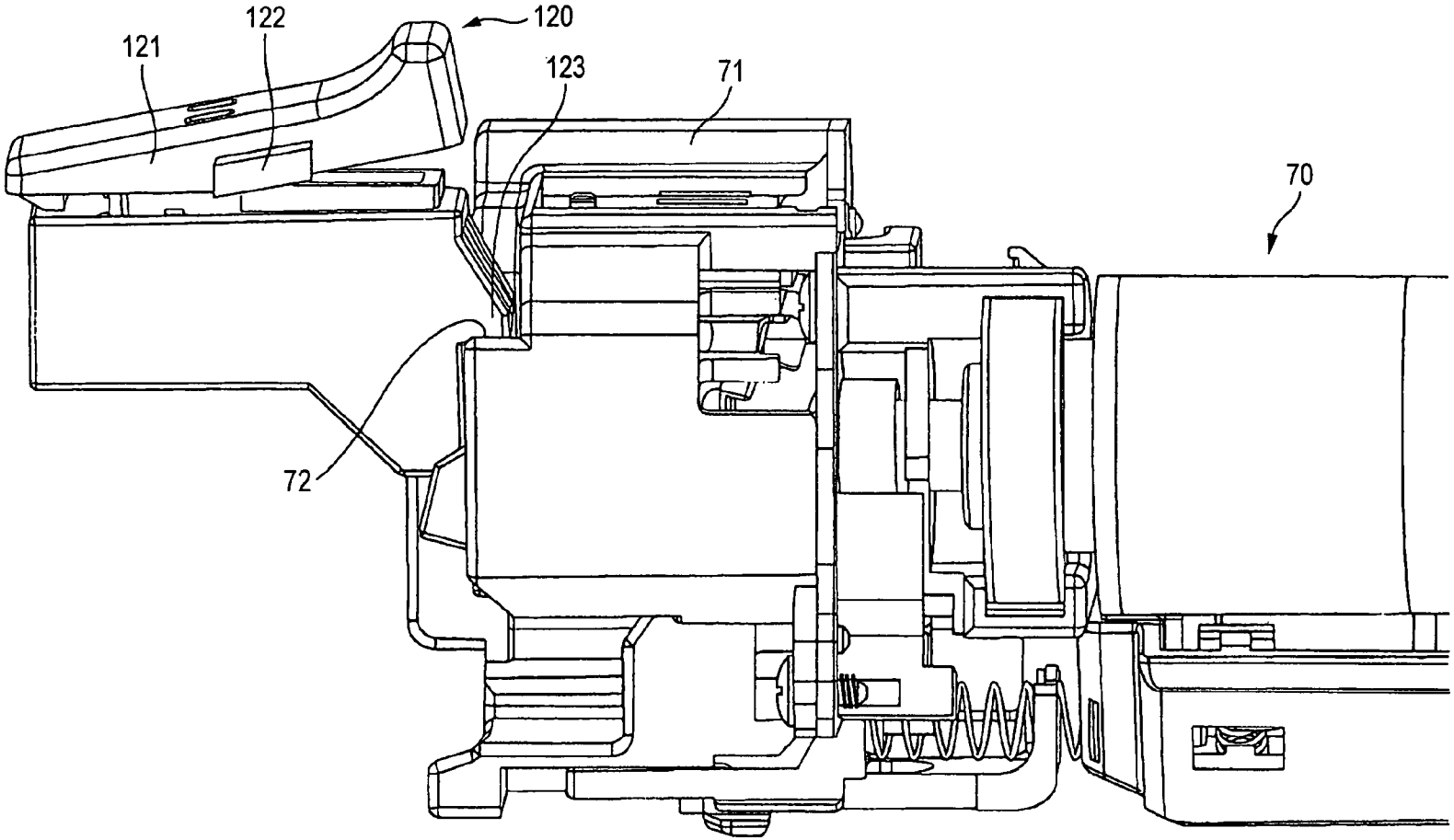
FIG. 11 is a view illustrating a relationship between the operation lever and the process cartridge shown in FIG. 10A.

In this example, as shown in FIGS. 10A and 10B, the operation lever 120 includes the stopper 122 and the connection piece 123 in the lever main body 121. Meanwhile, as shown in FIG. 11, the cartridge frame 71 of the process cartridge 70 is provided with the connection receive portion 72 with a concave shape to which the connection piece 123 can be fitted.

At this time, the restriction mechanism 150 used in the example fitly connects the connection piece 123 of the operation lever 120 to the connection receive portion 72 of the process cartridge 70 and restricts the process cartridge 70 in the protection cover 100 in the state where the operation lever 120 is located at the initial position of the protection cover 100.

In particular, in the embodiment, the operation lever 120 is disposed so as to be slidably movable along the guide slit 110 of the protection cover 100, and the stopper 122 with a flange shape is configured to be slidably movable in the edge of the opening of the guide slit 110 of the protection cover 100 through the guide surface 151.

The guide surface 151 includes the slope portion 152 which is upwardly inclined toward the insertion direction where the process cartridge 70 is inserted to the apparatus housing body 21. The slope portion 152 is inclined by q so that the height dimension is displaced by h with respect to a distance L where the operation lever 120 is pushed from the initial position to the extrusion end position.

In this example, the height dimension is expressed by $h=L\times\tan\theta$, but the height dimension h is set to be larger than a hook degree D how the connection piece 123 of the operation lever 120 is hooked by the connection receive portion 72 of the process cartridge 70.

Figure 12:
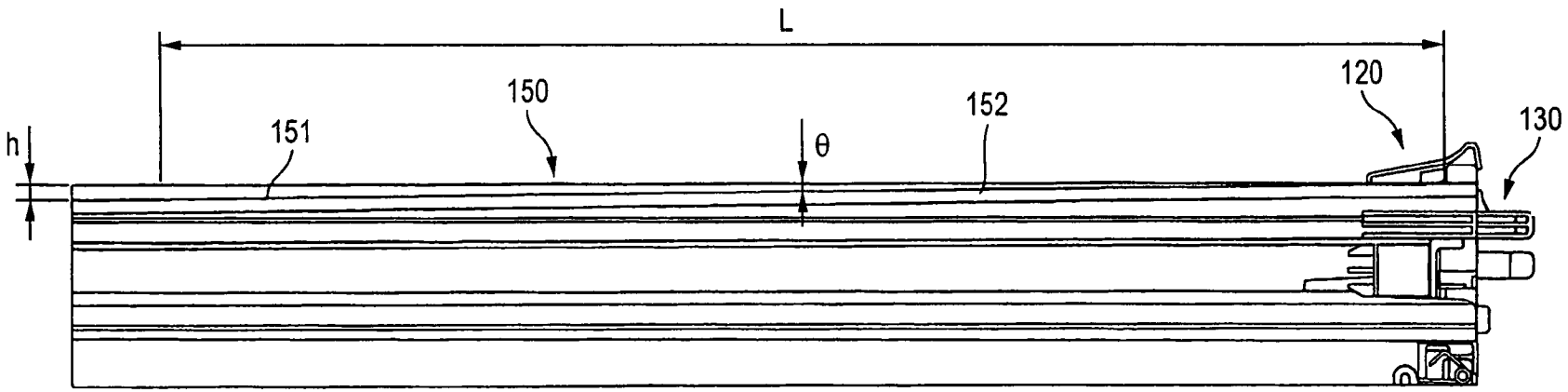
FIG. 12 is a view illustrating a state where the operation lever of the protection cover is pushed to a push end point.
Figure 13:
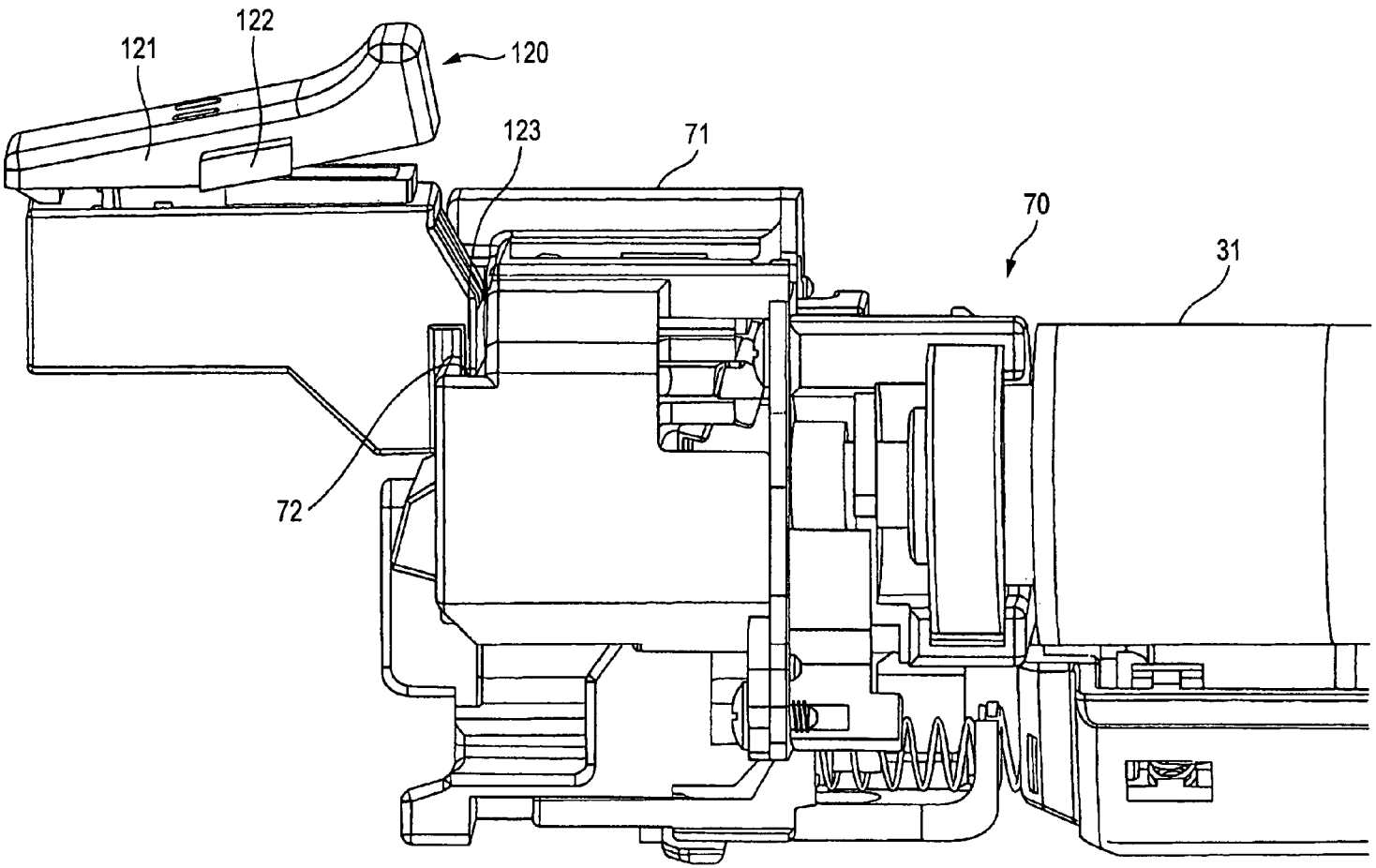
FIG. 13 is a view illustrating a relationship between the operation lever and the process cartridge shown in FIG. 12.

Accordingly, in the embodiment, as shown in FIGS. 10A, 10B and 12, in the restriction mechanism 150, when the operation lever 120 is moved by L from the initial position to the extrusion end position, a relative position of the operation lever 120 with respect to the process cartridge 70 is changed by the slope portion 152 of the guide surface 151. Accordingly, as shown in FIG. 13, the connection piece 123 of the operation lever 120 is detached from the connection receive portion 72 of the process cartridge 70, and thus the connection state therebetween is released.

For this reason, as shown in FIG. 12, when the operation lever 120 reaches the extrusion end position, the restriction state where the process cartridge 70 is restricted in the protection cover 100 by the restriction mechanism 150 is released. Accordingly, the process cartridge 70 is detached from the protection cover 100, and thus is inserted and mounted to the cartridge receive portion 211 of the apparatus housing body 21.

TYPICAL EXAMPLE 2 OF RESTRICTION MECHANISM: SEE FIGS. 14 TO 21

The restriction mechanism 150 in the example has substantially the same configuration as that of the typical example 1 shown in FIGS. 10A and 10B, but is different in that an initial position restriction mechanism 160 (see FIG. 16) restricts the movement of the operation lever 120 in the operation direction when the operation lever 120 is located at the initial position.

The initial position restriction mechanism 160 includes blocking ribs 161 (see FIG. 18) on both sides of the guide slit 110 of the protection cover 100 in a position corresponding to the initial position of the operation lever 120, and hooks a part of the operation lever 120 on the blocking rib 161 to restrict the movement of the operation lever 120.

Figure 14:
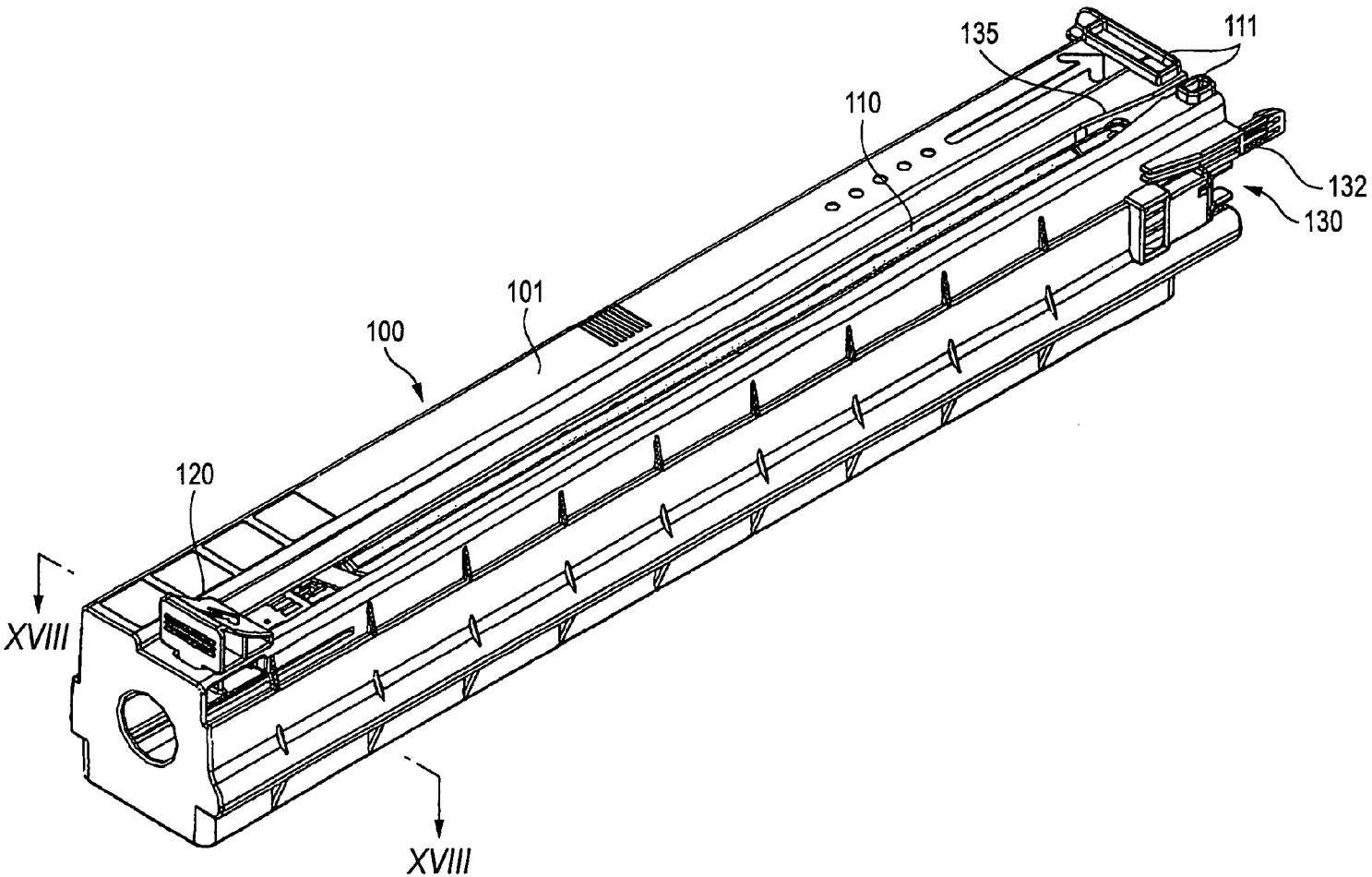
FIG. 14 is a view illustrating another example of the restriction mechanism of the process cartridge.
Figure 15:
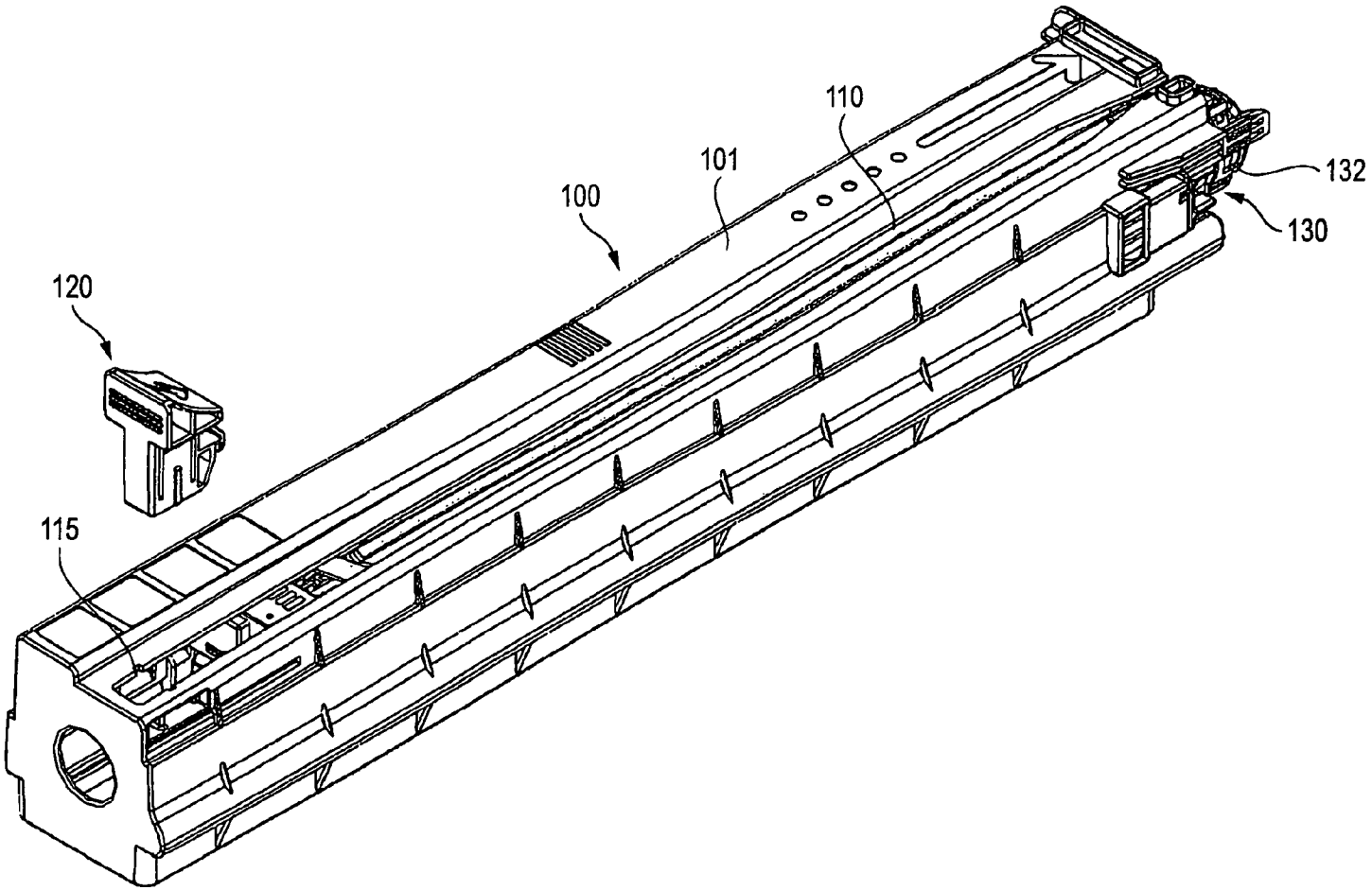
FIG. 15 is a view illustrating a state where the operation lever is detached from the protection cover shown in FIG. 14.
Figure 16:
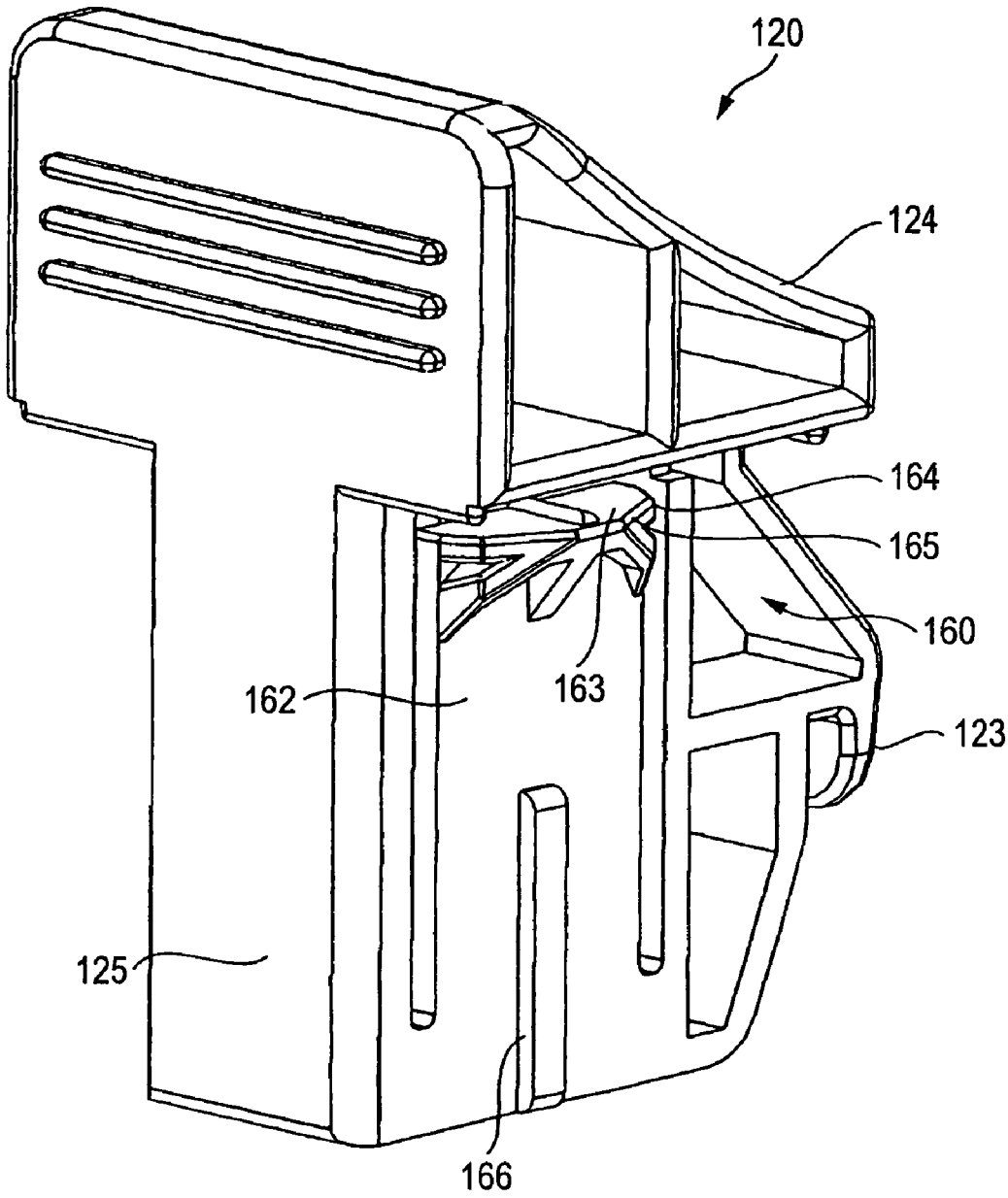
FIG. 16 is a view schematically illustrating the operation lever shown in FIG. 14.
Figure 17A:
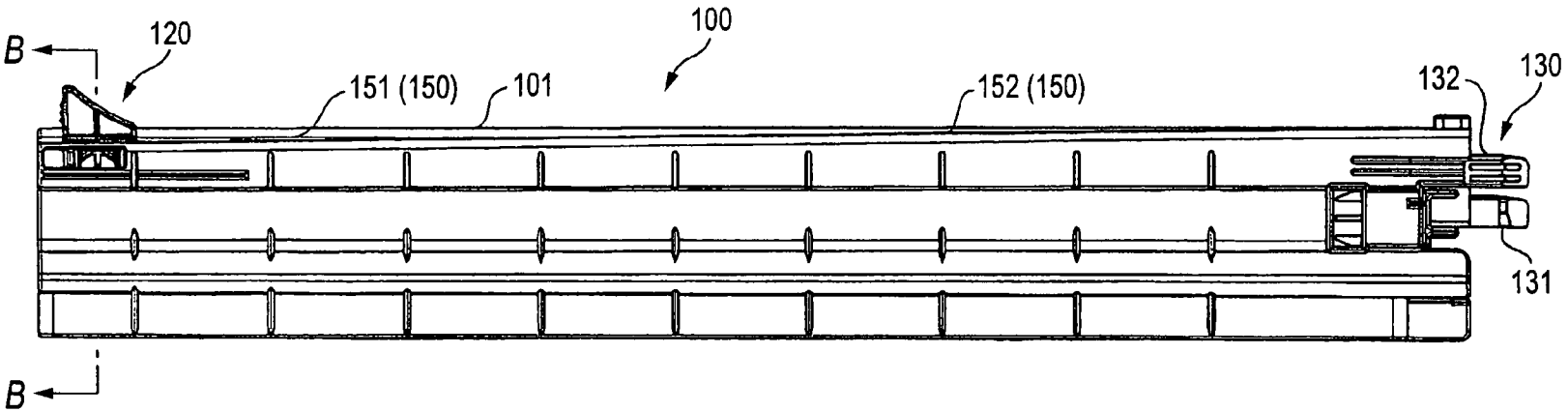
FIG. 17A is a front view illustrating the protection cover and the operation lever at the time of a start of the inserting/mounting operation of the process cartridge.
Figure 17B:
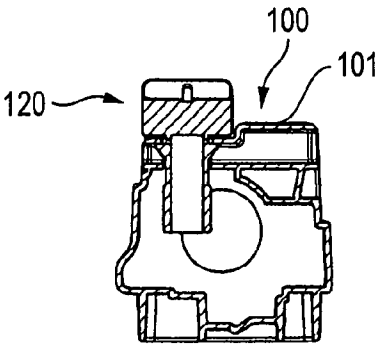
FIG. 17B is a sectional view taken along the line B-B shown in FIG. 17A.

As shown in FIGS. 14 to 16, in the operation lever 120 used in the example, a leg portion 125 which is fitted to the guide slit 110 is disposed in the lower portion of a gripper portion 124, and the connection piece 123 which is fitted to a connection receive portion of the process cartridge 70 is disposed in a part of the leg portion 125.

The leg portion 125 of the operation lever 120 includes a pair of elastic restriction pieces 162 which are fitted to the guide slit 110. The lower portion of the elastic restriction piece 162 is formed in an elastically deformable plate shape at a cantilever point. In the outside of the free end of the elastic restriction piece 162, a flange portion 163 which comes into contact with the blocking rib 161 to elastically deform the pair of elastic restriction pieces 162 so as to fall inward is disposed. In a portion of the flange portion 163 which comes into contact with the blocking rib 161, at least two steps of slope guide surfaces 164 and 165 are disposed.

Figure 18:
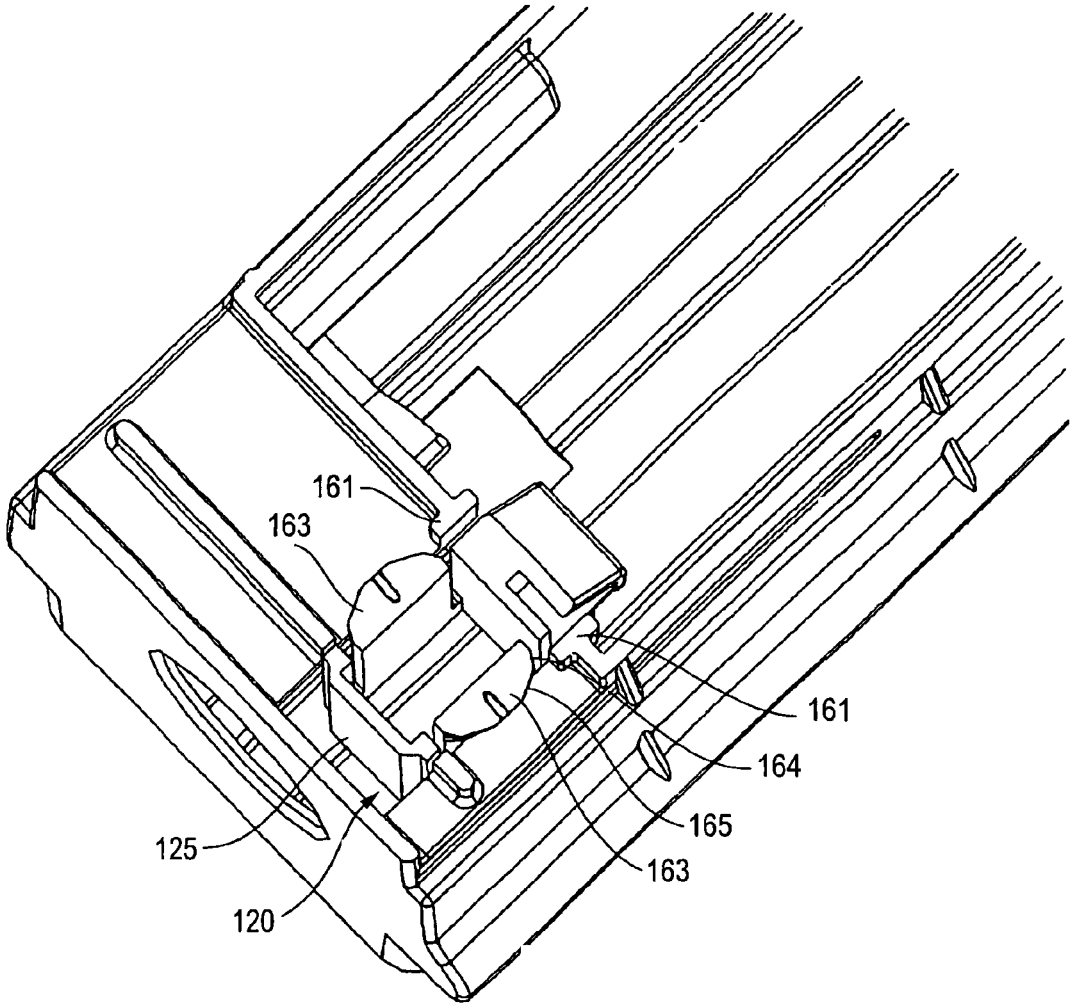
FIG. 18 is a sectional view taken along the line XVIII-XVIII shown in FIG. 14.
Figure 21:
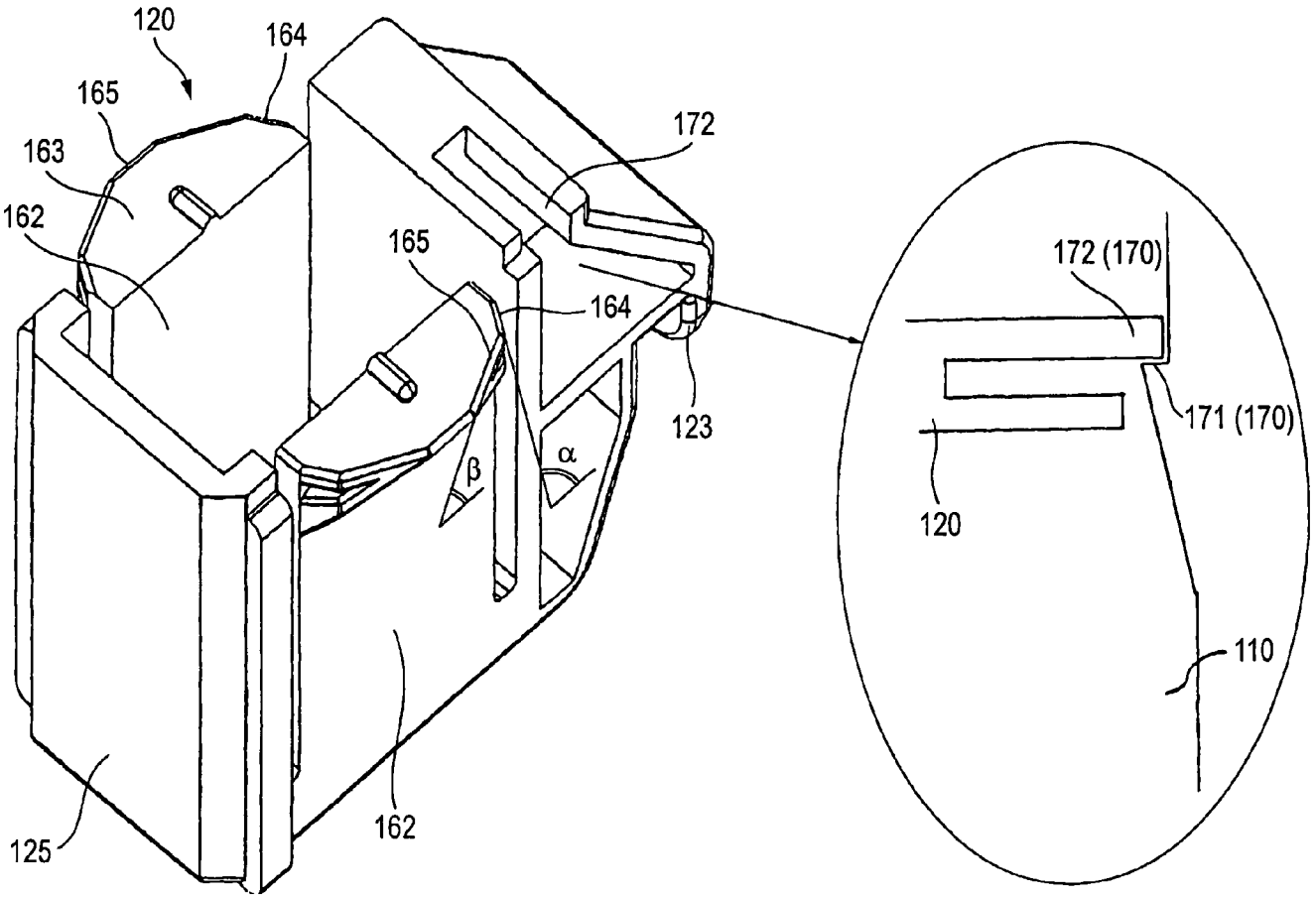
FIG. 21 is a view schematically illustrating a main part of the operation lever.

At this time, as shown in FIGS. 18 and 21, an angle $\alpha$ formed between the initial slope guide surface 164 and the blocking rib 161 is set to be larger than an angle $\beta$ formed between the subsequent slope guide surface 165 and the blocking rib 161 with respect to the operation direction (extrusion direction) of the operation lever 120.

More specifically, the angle α of the initial slope guide surface 164 of the flange portion 163 is set in consideration of bend rigidity of the elastic restriction piece 162 so as to receive a component force which can support the self weight of the process cartridge 70. The angle β of the subsequent slope guide surface 165 of the flange portion 163 is set in a direction where the component force can be lower than that of the component force of the angle α.

In the embodiment, the operation lever 120 is detachably mounted to the initial position of the guide slit 110. In the outer surface of the elastic restriction piece 162, a guide protrusion portion 166 which is fitted to a guide groove portion 115 formed in the initial position of the guide slit 110 is provided.

Accordingly, in the embodiment, for example, even when the process cartridge 70 is loaded in the protection cover 100 and the opening of the protection cover 100 faces the downside, since the initial slope guide surface 164 of the flange portion 163 of the operation lever 120 comes into contact with the blocking rib 161 by the initial position restriction mechanism 160, the operation lever 120 is restricted by the blocking rib 161 so as not to move.

In the embodiment, since the initial position restriction mechanism 160 includes two steps of slope guide surfaces 164 and 165 formed in the flange portion 163, it is possible to reduce the extrusion operation force of the operation lever 120 at the time of carrying out an extrusion operation of the operation lever 120.

In the embodiment, a position regulation mechanism 170 for restricting a position of the operation lever 120 at the extrusion end position is provided.

Figure 19:
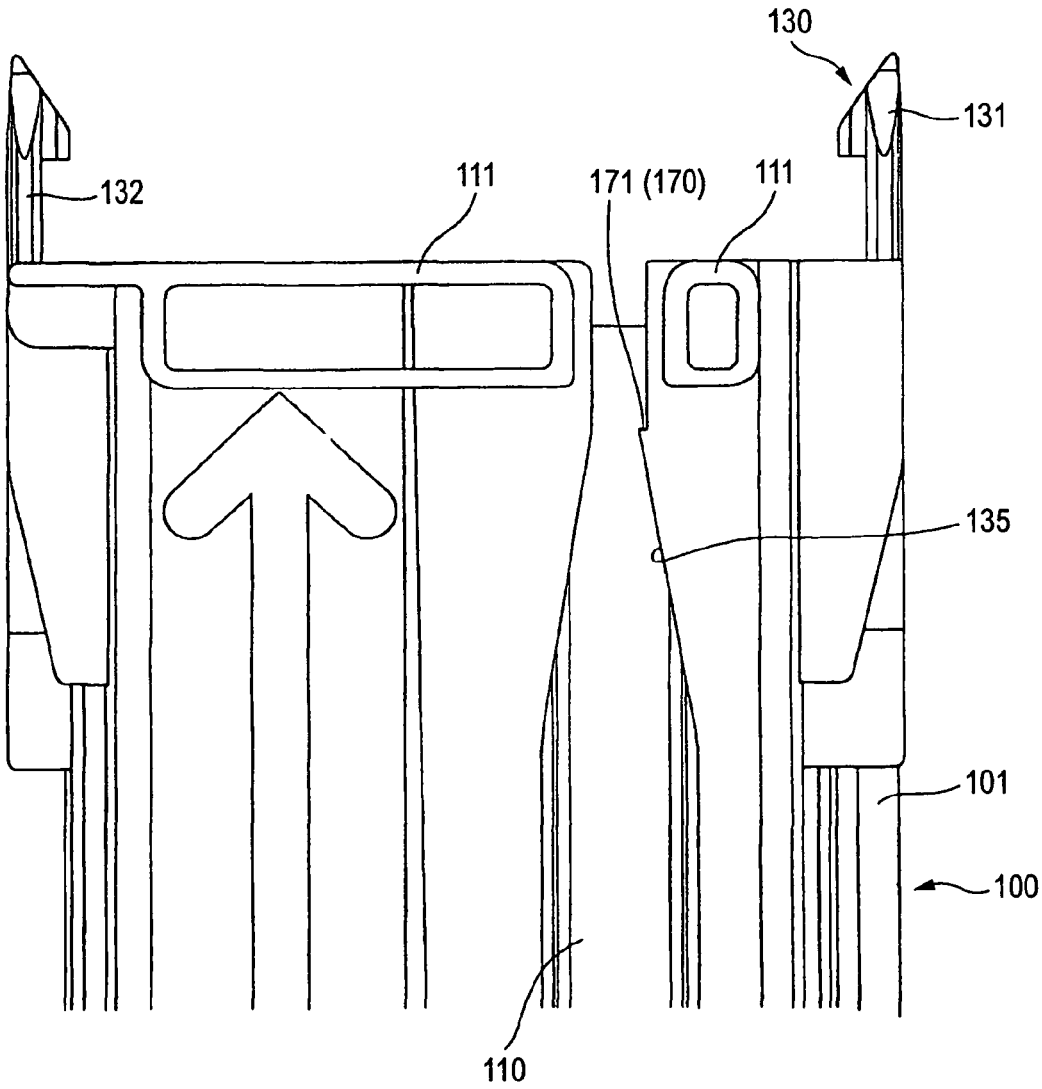
FIG. 19 is a view illustrating an example of a position regulation mechanism of the protection cover shown in FIG. 14.
Figure 20:
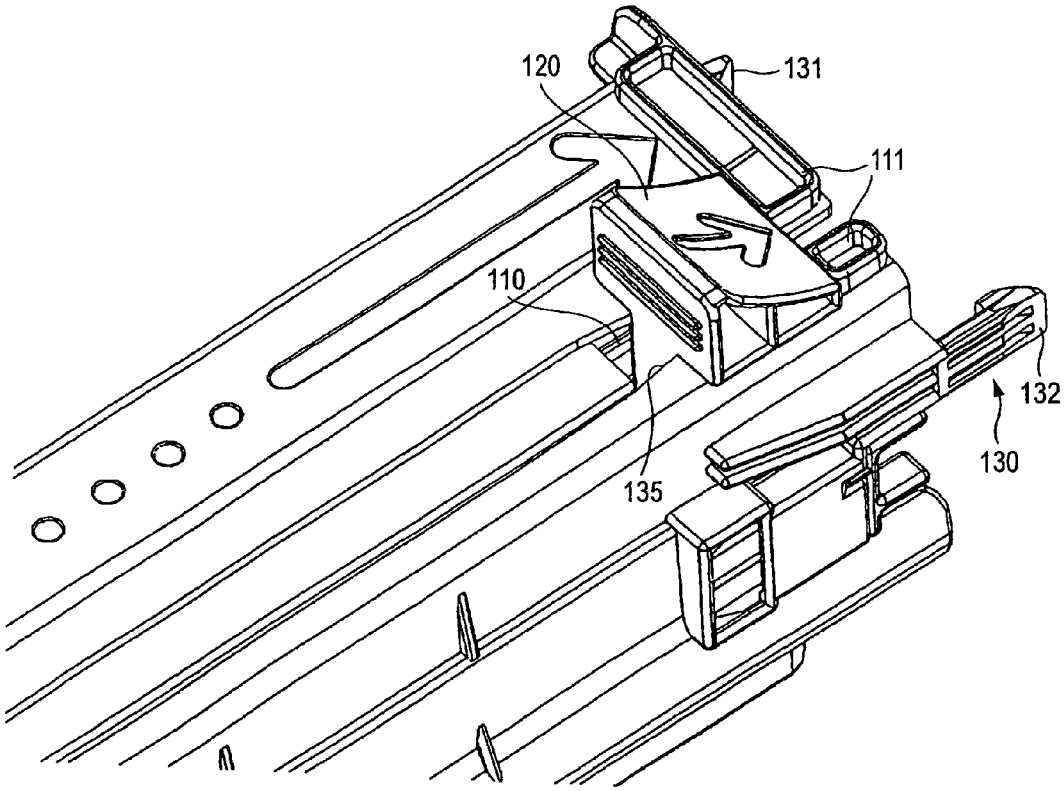
FIG. 20 is a view illustrating a state where the operation lever shown in FIG. 14 is pushed to the push end position.

As shown in FIG. 19, the position regulation mechanism 170 includes a step portion 171 provided on the side of the opening of the taper portion 135 of the guide slit 110 of the protection cover 100. When the operation lever 120 is pushed to the extrusion end position, as shown in FIGS. 19 to 21, a notch end portion 172 provided in a part of the leg portion 125 of the operation lever 120 is hooked on the step portion 171.

In the embodiment, in the positioning/holding mechanism 130, when the operation lever 120 reaches the extrusion end position, the operation lever 120 moves while widening the taper portion 135 of the guide slit 110. Accordingly, when the protection cover 100 is elastically deformed in accordance with an operation for widening the taper portion 135, a problem arises in that the operation lever 120 is pushed back by a reaction force of the protection cover 100 caused by an elastic deformation.

At this time, when the operation lever 120 is pushed back from the extrusion end position, a problem arises in that the positioning/holding state of the positioning/holding mechanism 130 cannot be released.

In the example, the operation lever 120 is restricted at the extrusion end position by the position regulation mechanism 170.

TYPICAL EXAMPLE 3 OF RESTRICTION MECHANISM: SEE FIGS. 22A AND 22B

Figure 22A:
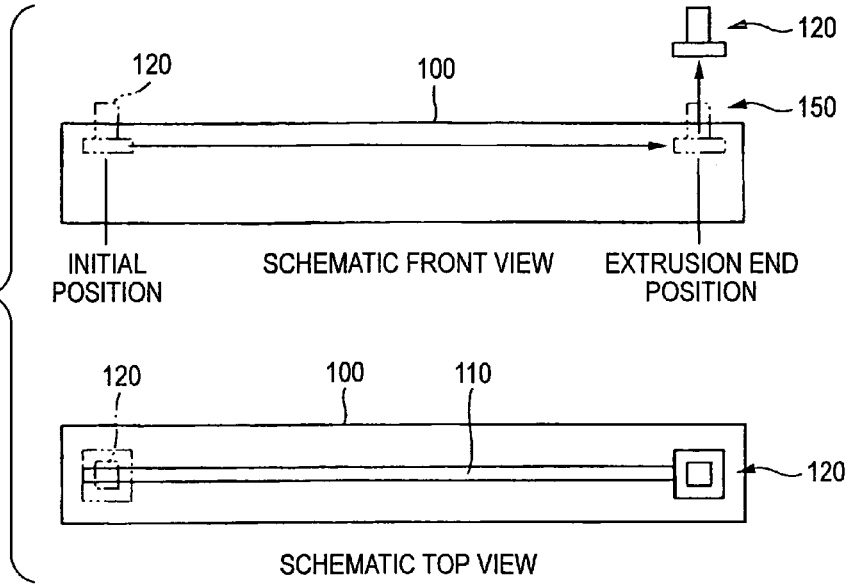
FIG. 22A is a schematic front view and a schematic top view illustrating another example of the restriction mechanism of the process cartridge.

In FIG. 22A, the restriction mechanism 150 allows the operation lever 120 to move from the initial position of the protection cover 100 to the extrusion end position, and allows the operation lever 120 to be detached from the protection cover 100 at the extrusion end position.

In the example, until the operation lever 120 is detached from the protection cover 100, the process cartridge 70 is restricted by the operation lever 120. When the operation lever 120 is detached from the protection cover 100, the restriction state of the process cartridge 70 by the operation lever 120 is released.

Figure 22B:
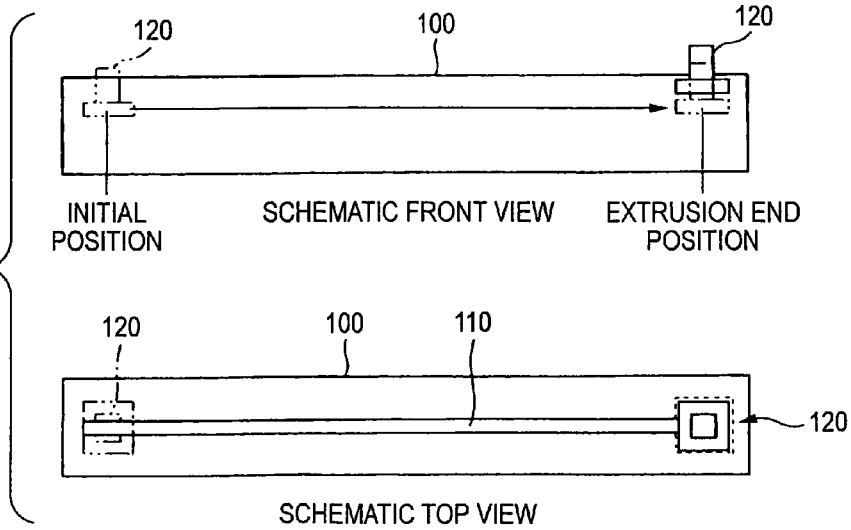
FIG. 22B is a schematic front view and a schematic top view illustrating a modified example of the restriction mechanism shown in FIG. 22.

As a modified example of the example, there is an example shown in FIG. 22B. The restriction mechanism 150 allows the operation lever 120 to move from the initial position of the protection cover 100 to the extrusion end position, and then allows the operation lever 120 to move to the upside within a state where the operation lever 120 is not detached therefrom at the extrusion end position, so that the restriction state of the process cartridge 70 by the operation lever 120 is released.

TYPICAL EXAMPLE 4 OF RESTRICTION MECHANISM: SEE FIGS. 23 TO 29C

The restriction mechanism 150 in the example is provided in the protection cover 100 on the insertion side of the process cartridge 70 to the apparatus housing body 21.

As shown in FIGS. 23 to 27B, the restriction mechanism 150 includes a torsion spring 180 which is elastically deformable and which corresponds to an elastic restriction portion for maintaining a restriction position where the process cartridge 70 in the protection cover 100 comes into contact therewith to be restricted. The torsion spring 180 is provided with a push portion 182 to which a twisting force is applied about a rotation point 181. The push portion 182 is hooked on a hook fixation concave portion 74 formed in a part of the cartridge frame 71 of the process cartridge 70, and then the process cartridge 70 is pushed into the protection cover 100 so as not to be detached therefrom by the use of the push portion 182.

Meanwhile, in the example, as shown in FIGS. 23 to 27B, the apparatus housing body 21 includes a protrusion member 190 serving as a restriction release member which is opposed to the torsion spring 180 serving as an elastic restriction portion. The protrusion member 190 is opposed to the push portion 182 of the torsion spring 180 at the time of the inserting operation of the process cartridge 70 to the apparatus housing body 21, and then allows the push portion 182 to move from the restriction position to the restriction release position in the direction against the twisting force at the time coming into contact with the push portion 182.

Figure 28:
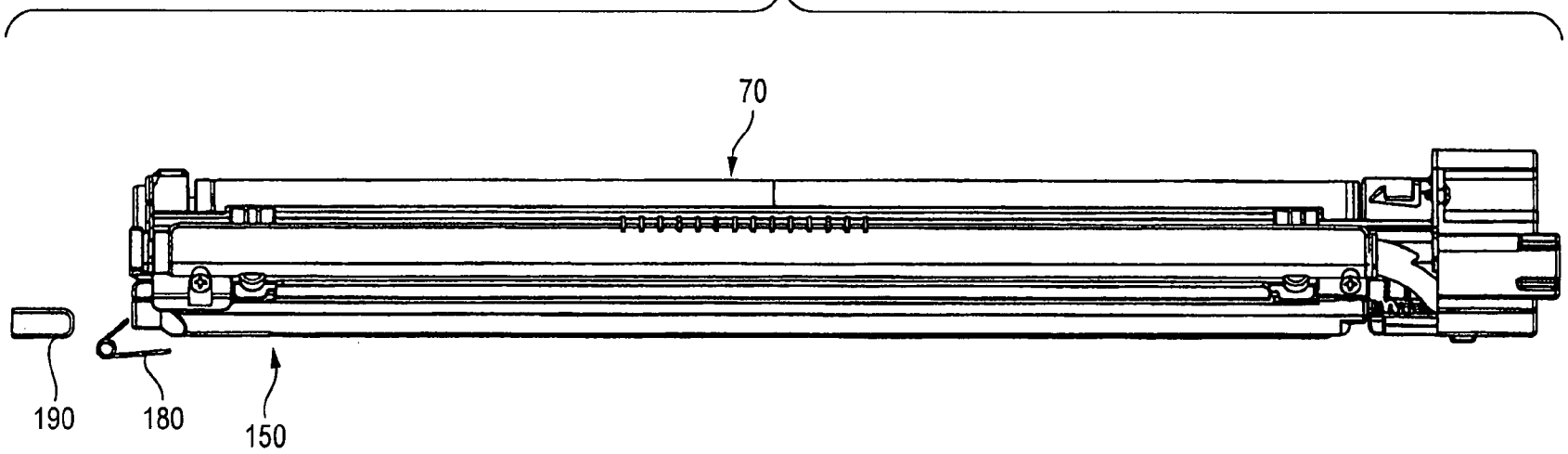
FIG. 28 is a view illustrating a relative position relationship between the restriction mechanism and the restriction release mechanism shown in FIG. 23.
Figure 29A:
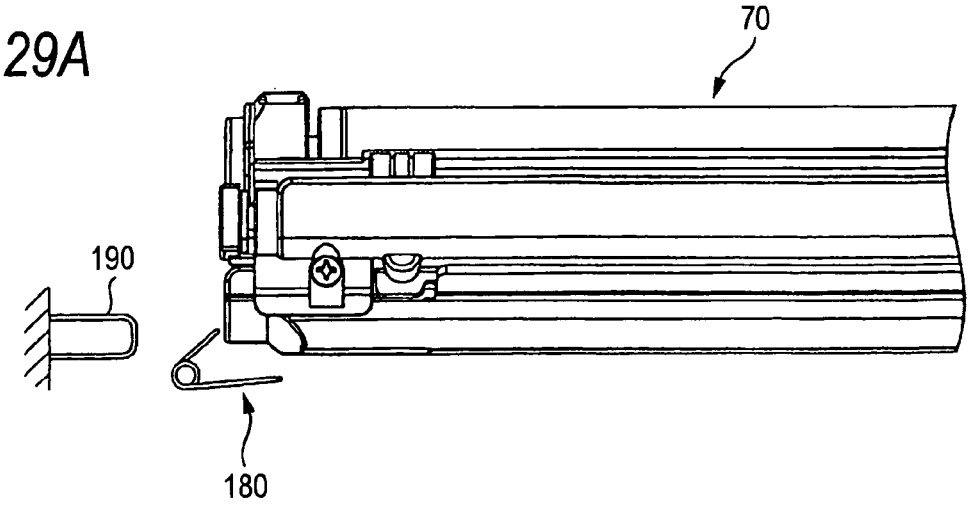
FIGS. 29A, 29B and 29C are views illustrating processes of a restriction operation state by the restriction mechanism shown in FIG. 23 and a restriction release operation by the restriction release mechanism.
Figure 29B:
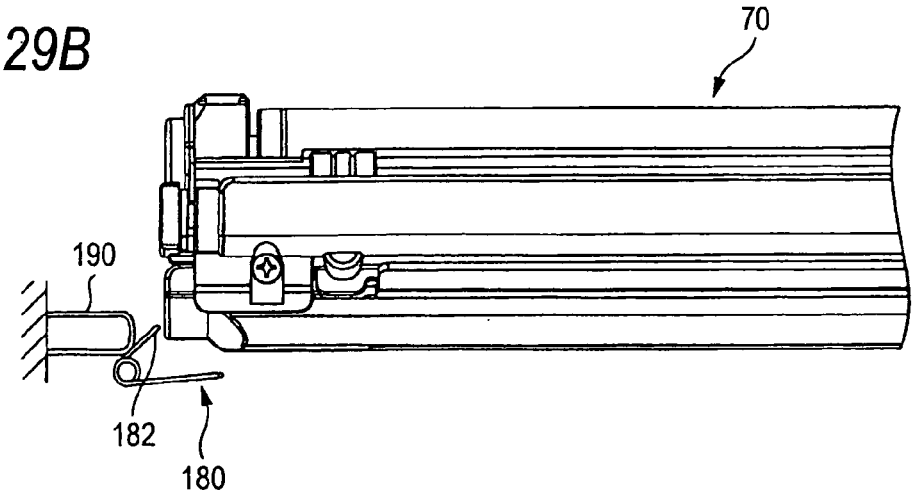
Figure 29C:
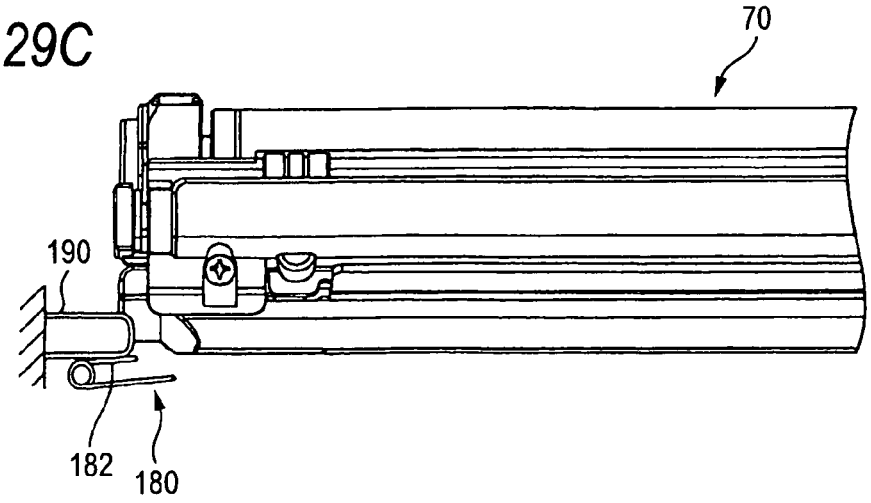
Figure 30B:
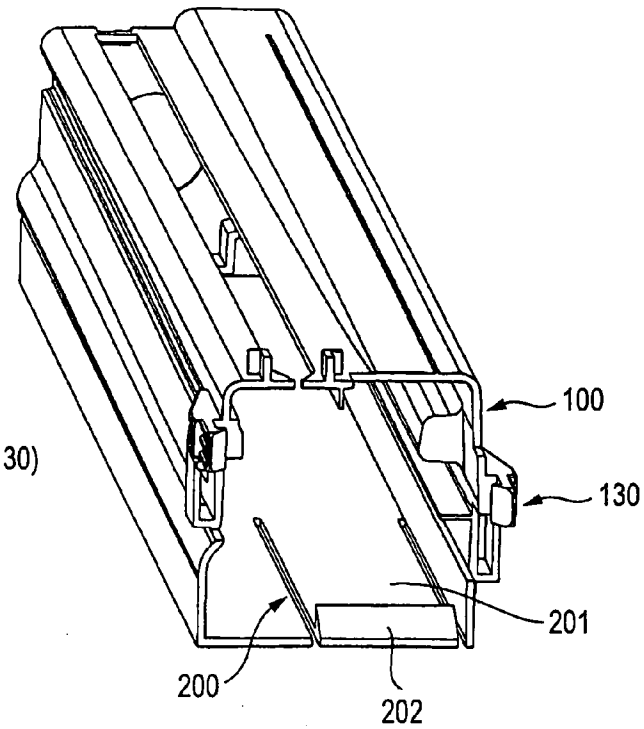
FIG. 30A is a view illustrating another example of the restriction mechanism of the process cartridge and FIG. 30B is a view illustrating a main part of the restriction mechanism disposed in the protection cover.
Figure 30A:
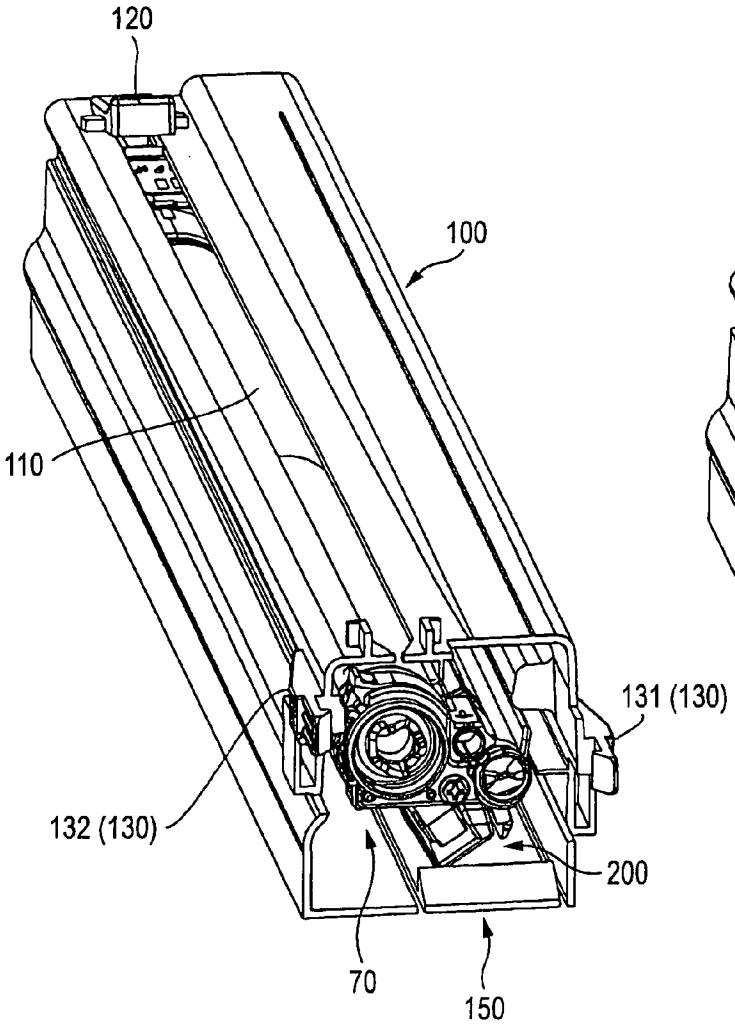

Therefore, according to the restriction mechanism 150 in the example, as shown in FIGS. 28 and 29C, the push portion 182 of the torsion spring 180 surrounds and restricts the process cartridge 70 in the protection cover 100 before the process cartridge 70 is inserted to the apparatus housing body 21.

Meanwhile, when the process cartridge 70 is inserted to the apparatus housing body 21 and the protection cover 100 needs to be positioned and held with respect to the apparatus housing body 21 using the positioning/holding mechanism 130, the protrusion member 190 comes into contact with the push portion 182 of the torsion spring 180 so as to release the restriction state of the process cartridge 70 by the push portion 182. Accordingly, when the extrusion operation of the operation lever 120 is carried out, the process cartridge 70 is extruded from the protection cover 100, and then is inserted and mounted to the apparatus housing body 21.

TYPICAL EXAMPLE 5 OF RESTRICTION MECHANISM: SEE FIGS. 30A TO 23C

The restriction mechanism 150 in the example includes an elastic restriction piece 200 which is disposed in the protection cover 100 on the insertion side of the process cartridge 70 to the apparatus housing body 21. The elastic restriction piece 200 includes an elastic piece 201 which swings about one end of a part of the protection cover 100 and a hook portion 202 by which the process cartridge 70 is restricted at the front end of the elastic piece 201.

Meanwhile, the protrusion member 190 serving as a restriction release member is disposed on the side of the apparatus housing body 21. The protrusion member 190 moves the elastic piece 201 from the restriction position to the restriction release position when the protrusion member 190 is opposed to the hook portion 202 of the elastic restriction piece 200 and comes into contact with the hook portion 202.

Figure 31:
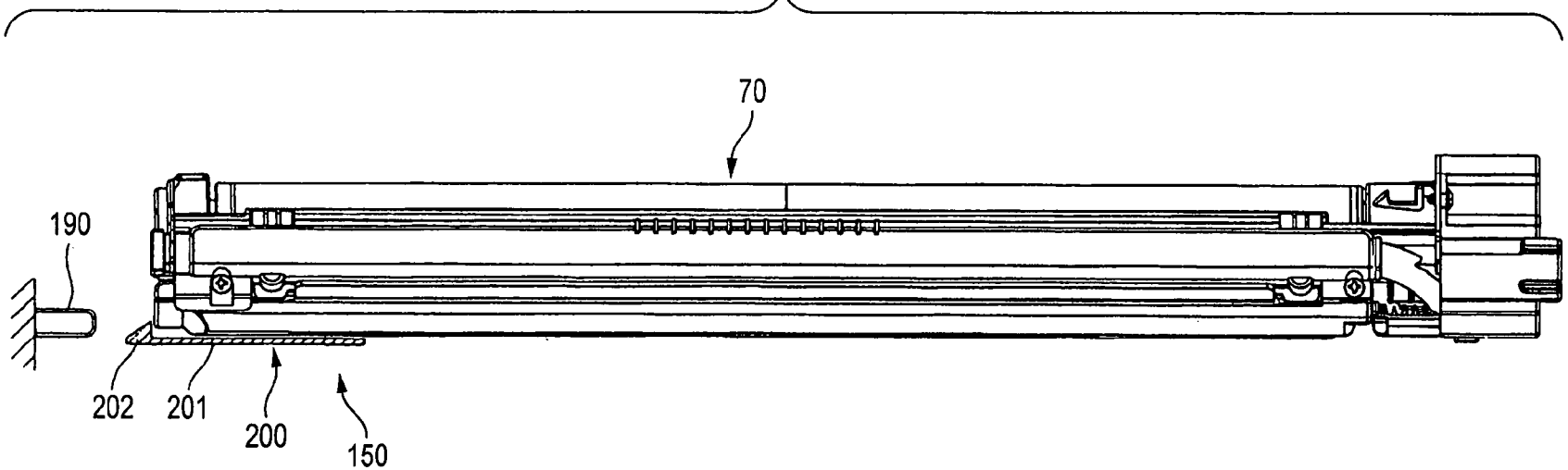
FIG. 31 is a view illustrating a relative position relationship between the restriction mechanism and the restriction release mechanism.
Figure 32A:
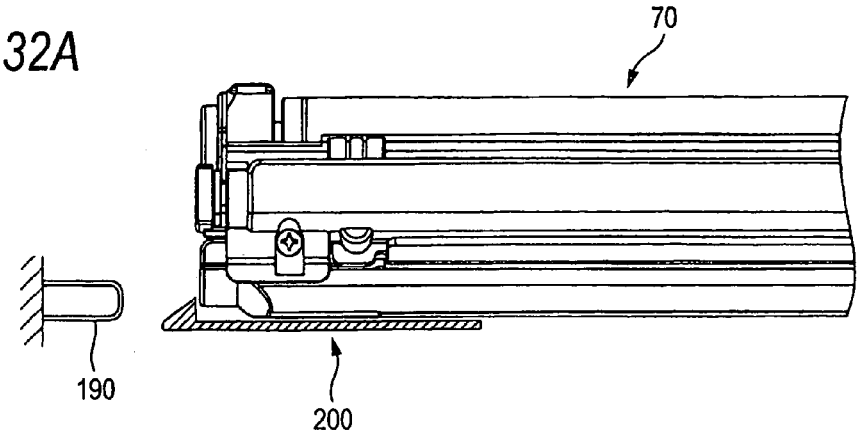
FIGS. 32A, 32B and 32C are views illustrating a process of the restriction operation by the restriction mechanism shown in FIGS. 30A and 30B and the restriction release operation by the restriction release mechanism.
Figure 32B:
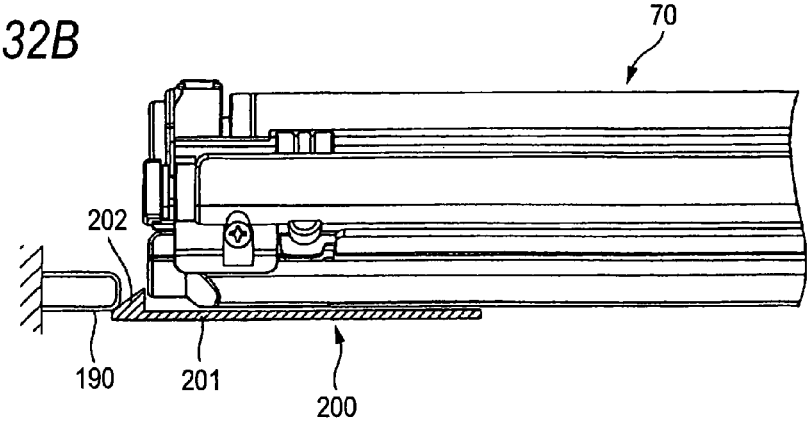
Figure 32C:
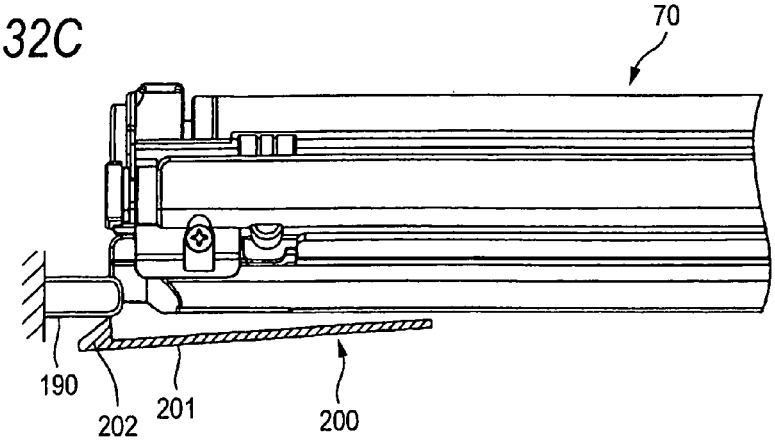

Accordingly, according to the restriction mechanism 150 related to the example, as shown in FIGS. 31 and 32C, the hook portion 202 of the elastic restriction piece 200 surrounds and restricts the process cartridge 70 in the protection cover 100 before the process cartridge 70 is inserted and mounted to the apparatus housing body 21.

Meanwhile, when the process cartridge 70 is inserted to the apparatus housing body 21 and the protection cover 100 needs to be positioned and held with respect to the apparatus housing body 21 using the positioning/holding mechanism 130, the protrusion member 190 comes into contact with the hook portion 202 of the elastic restriction piece 200 so as to release the restriction state of the process cartridge 70 by the hook portion 202. Accordingly, when the extrusion operation of the operation lever 120 is carried out, the process cartridge 70 is extruded from the protection cover 100, and then is inserted and mounted to the apparatus housing body 21.

Additionally, as the restriction mechanism 150, a plurality of examples may be appropriately selected. In the case where a plurality of restriction mechanisms 150 are selected, it is possible to increase restriction performance of the process cartridge 70 in the protection cover 100.

-Process Cartridge Identification Structure-

In general, since the type (i.e., specification and shipping information) of the process cartridge 70 is different in accordance with the type of the image forming apparatus, it is necessary to insert and mount the appropriate process cartridge 70 to the image forming apparatus.

The embodiment provides a process cartridge identification structure which is necessary for appropriately mounting the process cartridge 70 protected by the protection cover 100, in accordance with the type of the image forming apparatus.

Hereinafter, typical examples 1 and 2 of the process cartridge identification structure will be described.

TYPICAL EXAMPLE 1 OF PROCESS CARTRIDGE IDENTIFICATION STRUCTURE: SEE FIGS. 33 TO 36

In the example, an identification component 210 is disposed in the protection cover 100 on the insertion side of the process cartridge 70 to the apparatus housing body 21. The identification component 210 may have an arbitrary shape and may be formed integrally with the protection cover 100 or may be provided as an additional component so long as the relationship between the identification component 210 and a mounting determination component 230, which is described below and disposed in the apparatus housing body 21, allows a non-interference between the identification component 210 and the mounting determination component 230 so as to permit a positioning operation of the protection cover 100 with respect to a regulation position or an interference between the identification component 210 and the mounting determination component 230 so as to prevent a positioning operation thereof with respect to the regulation position.

Figure 33:
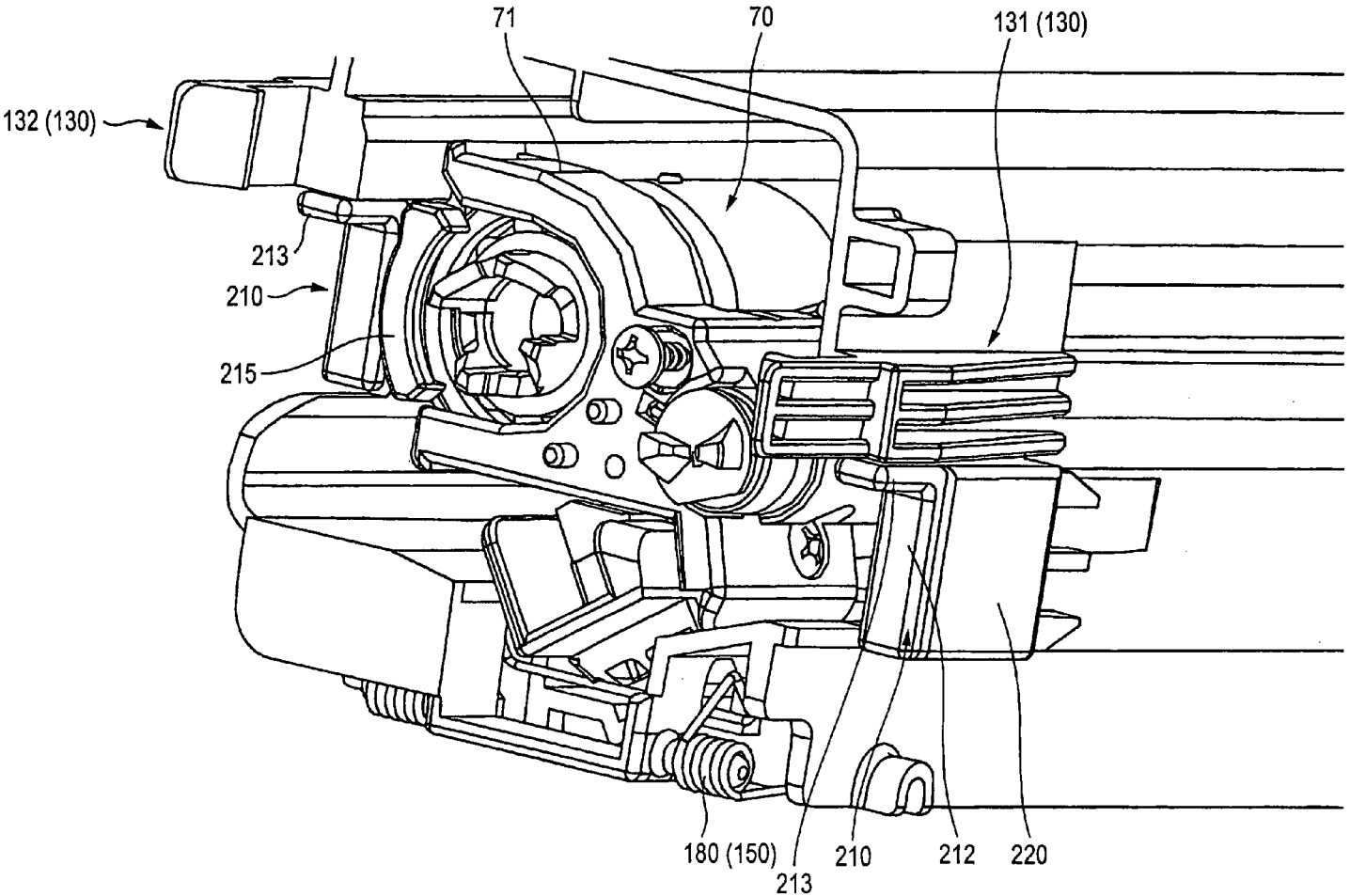
FIG. 33 is a view illustrating an example of a process cartridge identification structure according to the embodiment.
Figure 34:
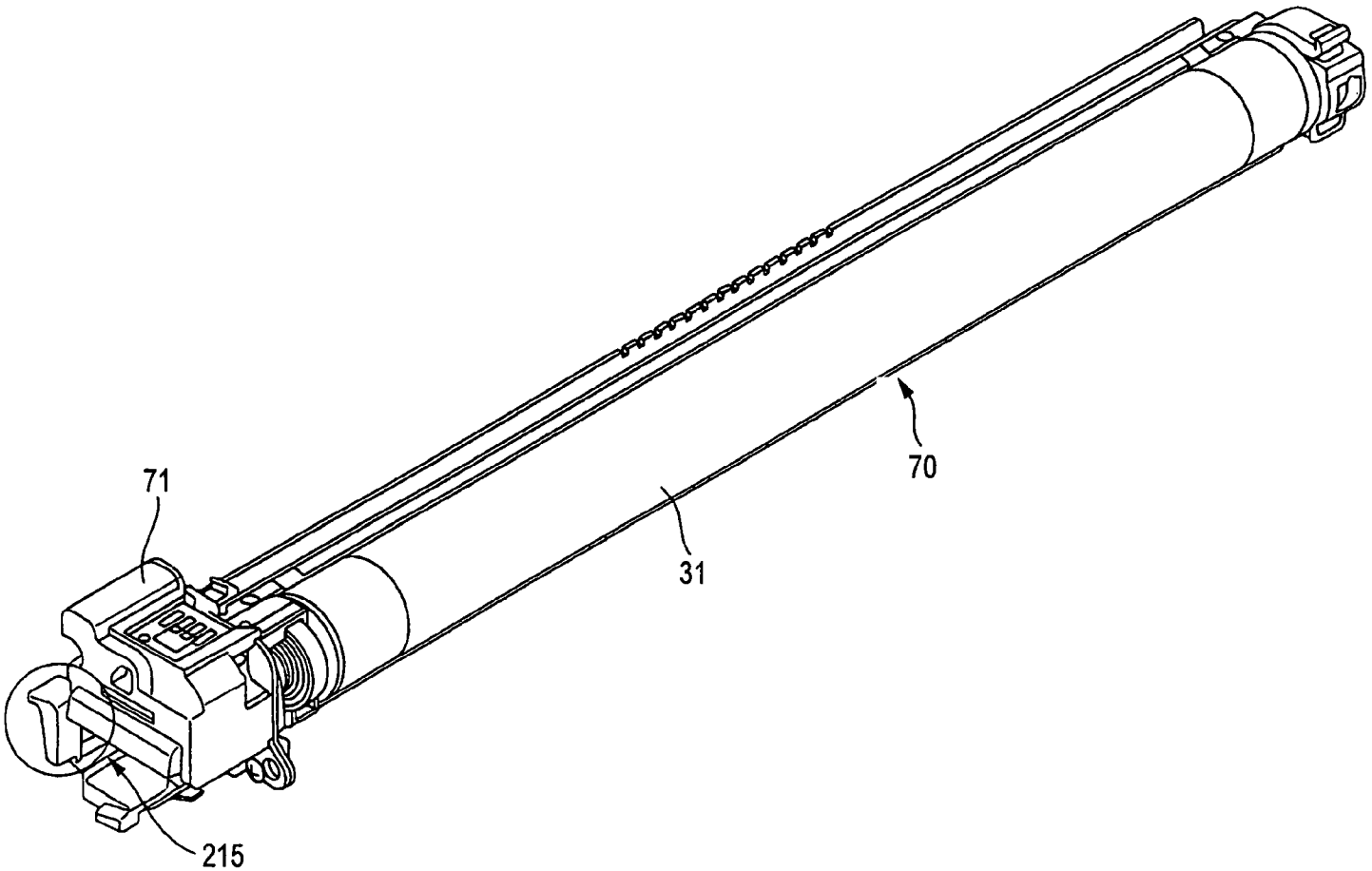
FIG. 34 is a view illustrating an example of an identification member disposed in the process cartridge.
Figure 35:
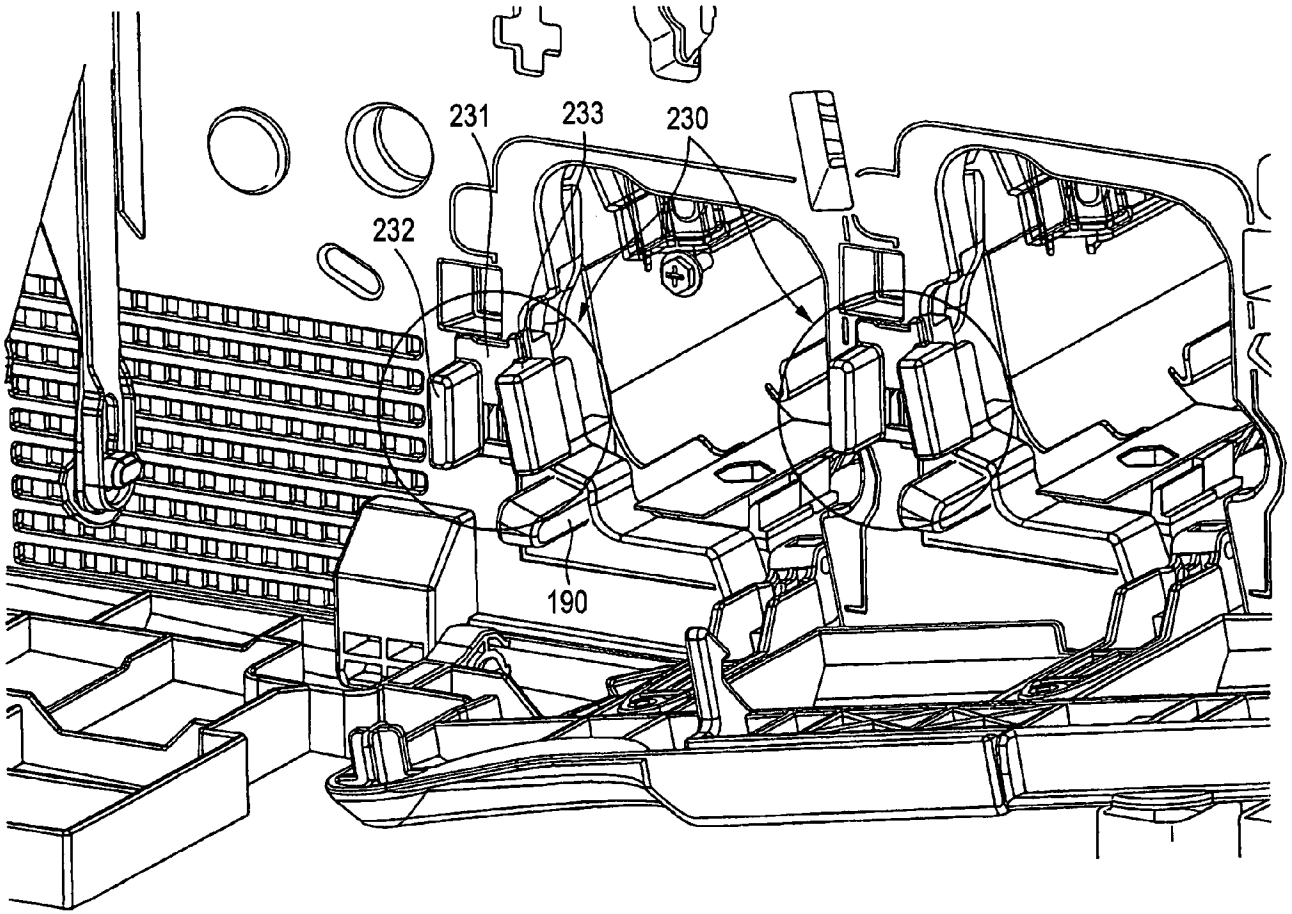
FIG. 35 is a view illustrating an example of a mounting determination member disposed in the image forming apparatus housing body.

In this example, as shown in FIGS. 33 and 34, the identification component 210 is detachably mounted to, for example, a pair of component receive portions 220 which are disposed in advance on both sides of the cover base 101 of the protection cover 100.

At this time, the identification component 210 includes a component main body 212 which is fitted to the component receive portion 220. In the component main body 212, an identification protrusion 213 which is determined in advance in accordance with the type of the process cartridge 70 is disposed in a protruding manner on the side of the apparatus housing body 21.

In particular, in the example, the identification component 210 is asymmetrically disposed on both sides of the protection cover 100, and uniformly regulates the insertion direction of the process cartridge 70.

In this example, an identification component 215 for identifying the type of the process cartridge 70 is disposed on the insertion side of the process cartridge 70 to the apparatus housing body 21. The identification component 215, for example, is formed integrally with a part of the cartridge frame 71 or is provided as an additional component.

As shown in FIG. 34, the mounting determination component 230 for determining whether the identification components 210 and 215 of the protection cover 100 and the process cartridge 70 are correct is disposed on the side of the apparatus housing body 21.

The mounting determination component 230 is disposed on both sides of the cartridge receive portion 211 of the apparatus housing body 21, and determines whether three of identification components 210 and 215, that is, a pair of identification components 210 of the protection cover 100 and the identification component 215 of the process cartridge 70 are appropriate.

Additionally, the mounting determination component 230 may be formed integrally with the apparatus housing body 21, but in the example, includes a component main body 231 which can be mounted or detached to or from the apparatus housing body 21. At this time, a pair of determination blocks 232 and 233 are formed integrally with the component main body 231.

When the process cartridge 70 is appropriate and the protection cover 100 is positioned and held to the apparatus housing body 21, the determination blocks 232 and 233 of the mounting determination component 230 are disposed so as not to interfere with the identification components 210 and 215. On the other hand, when the process cartridge 70 is not appropriate and the protection cover 100 is positioned and held to the apparatus housing body 21, the determination blocks 232 and 233 of the mounting determination component 230 are disposed so as to interfere with the identification components 210 and 215.

Figure 36:
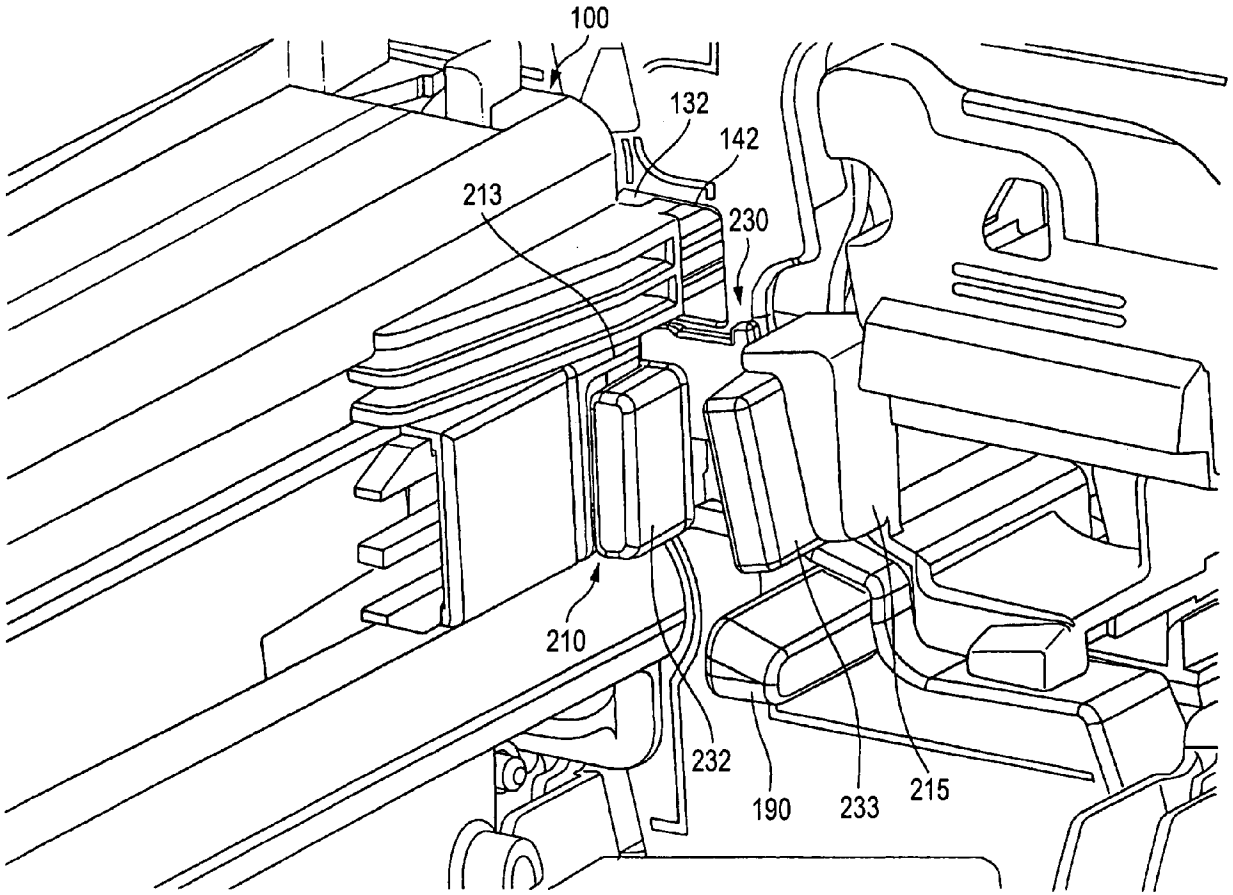
FIG. 36 is a view illustrating an effect of the process cartridge identification structure shown in FIG. 33.

Accordingly, in the example, when the process cartridge 70 is inserted and mounted, as shown in FIG. 36, since the identification components 210 and 215 on the side of the protection cover 100 and the process cartridge 70 are disposed so as not to interfere with the determination blocks 232 and 233 of the mounting determination component 230 on the side of the apparatus housing body 21 at the time the protection cover 100 is positioned and held to the apparatus housing body 21, the protection cover 100 is positioned and held to the apparatus housing body 21. In this state, the process cartridge 70 is inserted and mounted to the apparatus housing body 21.

TYPICAL EXAMPLE 2 OF PROCESS CARTRIDGE IDENTIFICATION STRUCTURE: SEE FIGS. 37 TO 48

Figure 37:
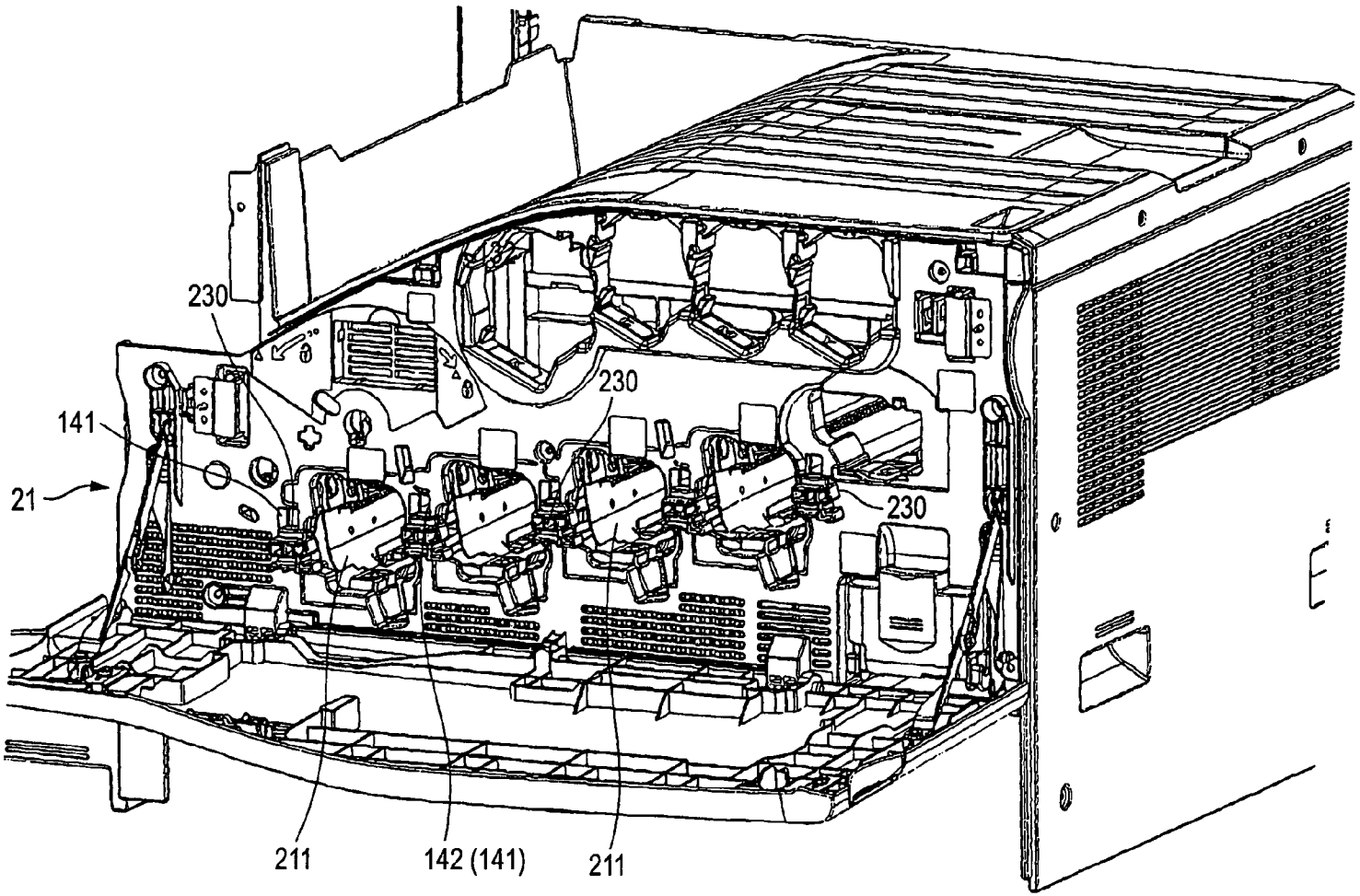
FIG. 37 is a view illustrating a mounting determination member of another example of the process cartridge identification structure according to the embodiment.
Figure 38:
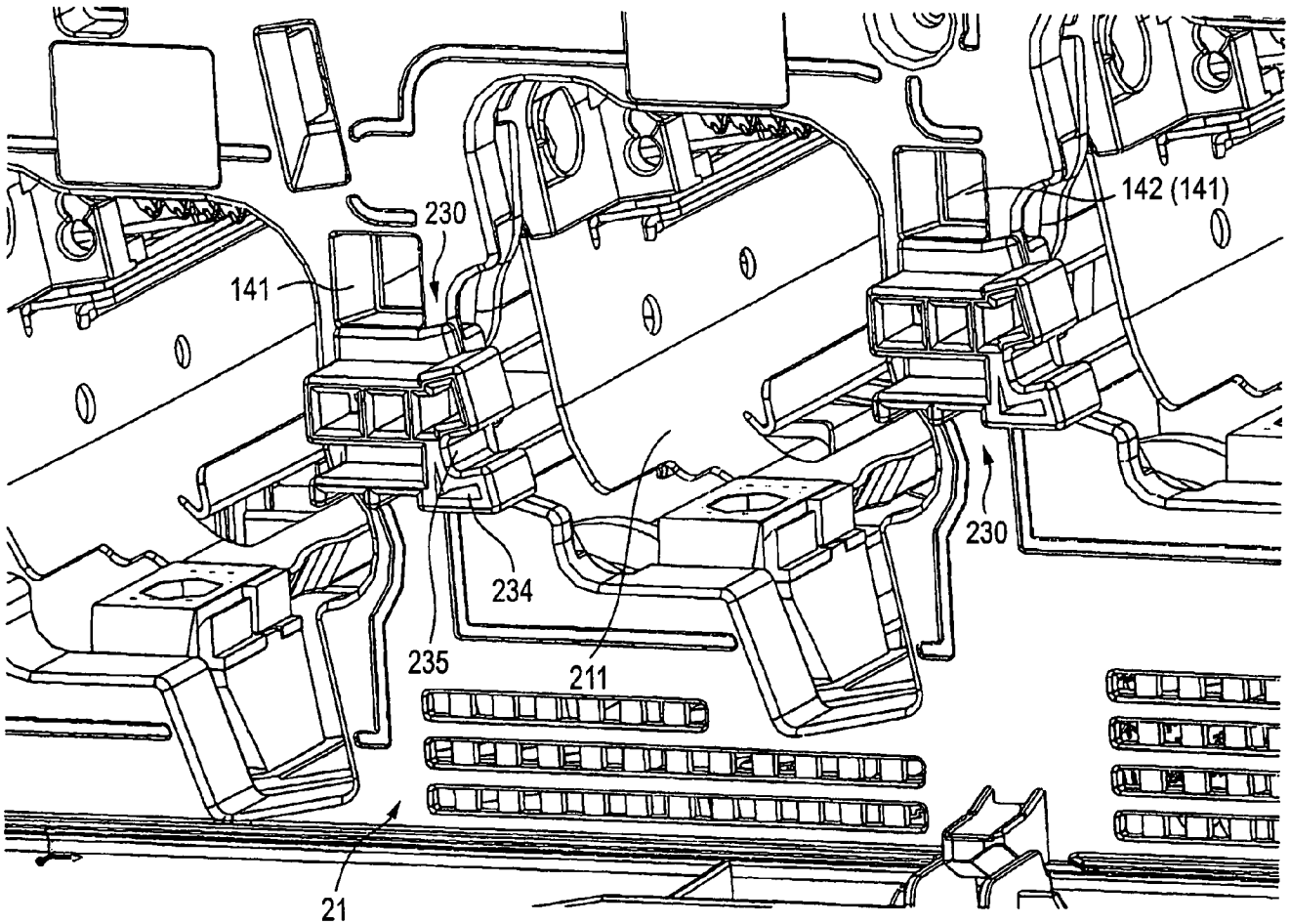
FIG. 38 is a view schematically illustrating the mounting determination member of the process cartridge identification structure shown in FIG. 37.
Figure 39A:
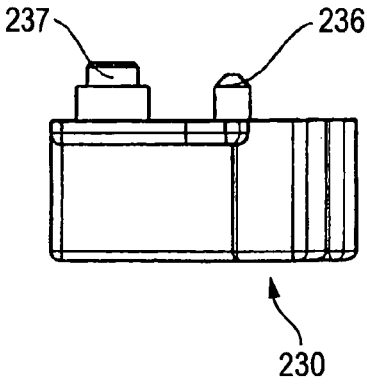
FIGS. 39A, 39B, 39C, 39D and 39E are a top view, a perspective view in an obliquely front side, a front view, a side view, and a perspective view in an obliquely back side illustrating a configuration component example of the mounting determination member shown in FIG. 37, respectively.
Figure 39B:
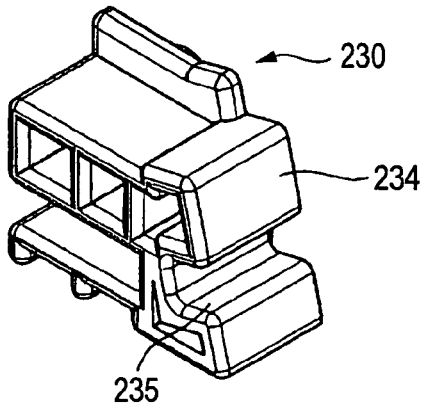
Figure 39C:
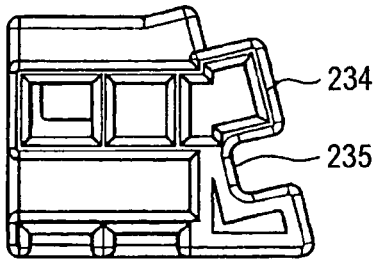
Figure 39D:
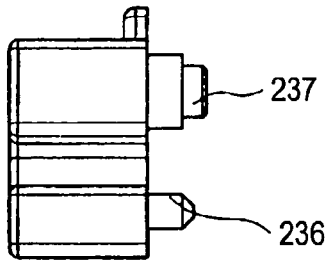
Figure 39E:
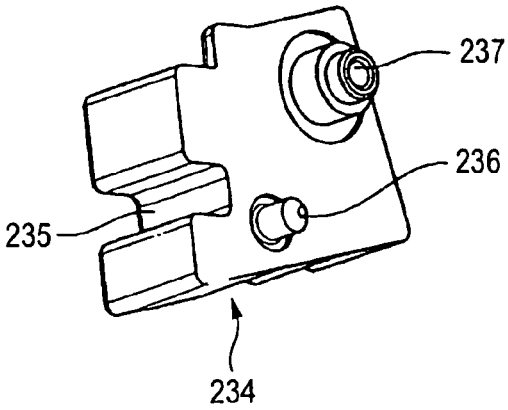
Figure 40A:
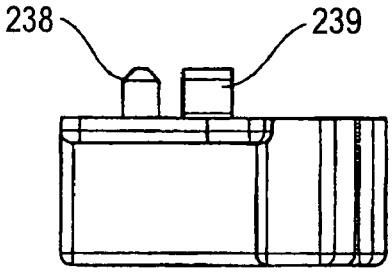
FIGS. 40A, 40B, 40C, 40D and 40E are a top view, a perspective view in an obliquely front side, a front view, a side view, and a perspective in an obliquely back side illustrating another configuration component example of the mounting determination member shown in FIG. 37, respectively.
Figure 40B:
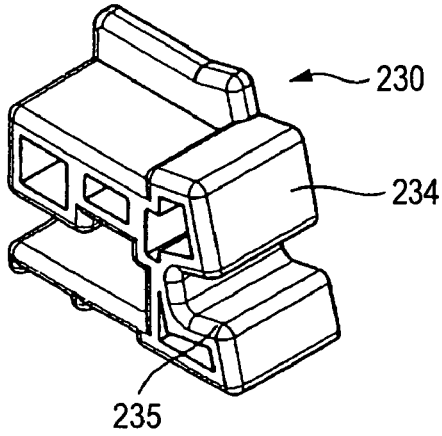
Figure 40C:
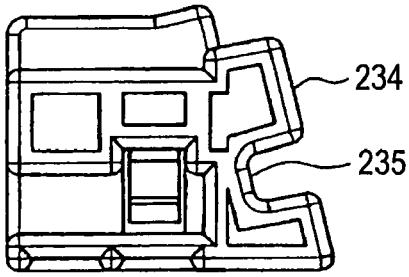
Figure 40D:
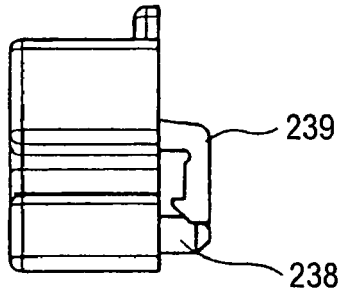
Figure 40E:
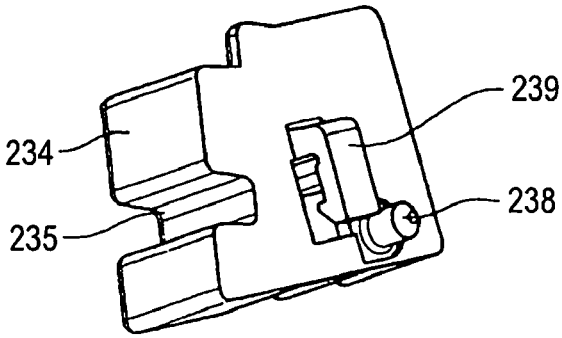

As shown in FIGS. 37 and 38, the example uses the mounting determination component 230 different from that of the typical example 1.

The mounting determination component 230 includes a determination block 234 with a substantially U shape on the side of the component main body 231 facing the cartridge receive portion 211. A concave portion 235 with a U shape of the determination block 234 is used as a guide groove at the time of the inserting operation of the process cartridge 70.

As a mounting structure of the mounting determination component 230, as shown in FIGS. 39A to 39E, a positioning boss 236 and a screw hole portion 237 maybe formed in the rear surface of the component main body 231 so as to be fixed to the apparatus housing body 21 by the use of a screw. Alternatively, as shown in FIGS. 40A to 40E, a positioning boss 238 and an elastic attachment piece 239, which is elastically deformable, may be formed in the rear surface of the component main body 231 so as to hook the elastic attachment piece 239 in an attachment hole (not shown) of the apparatus housing body 21 to be thereby fixed thereto.

Figure 41:
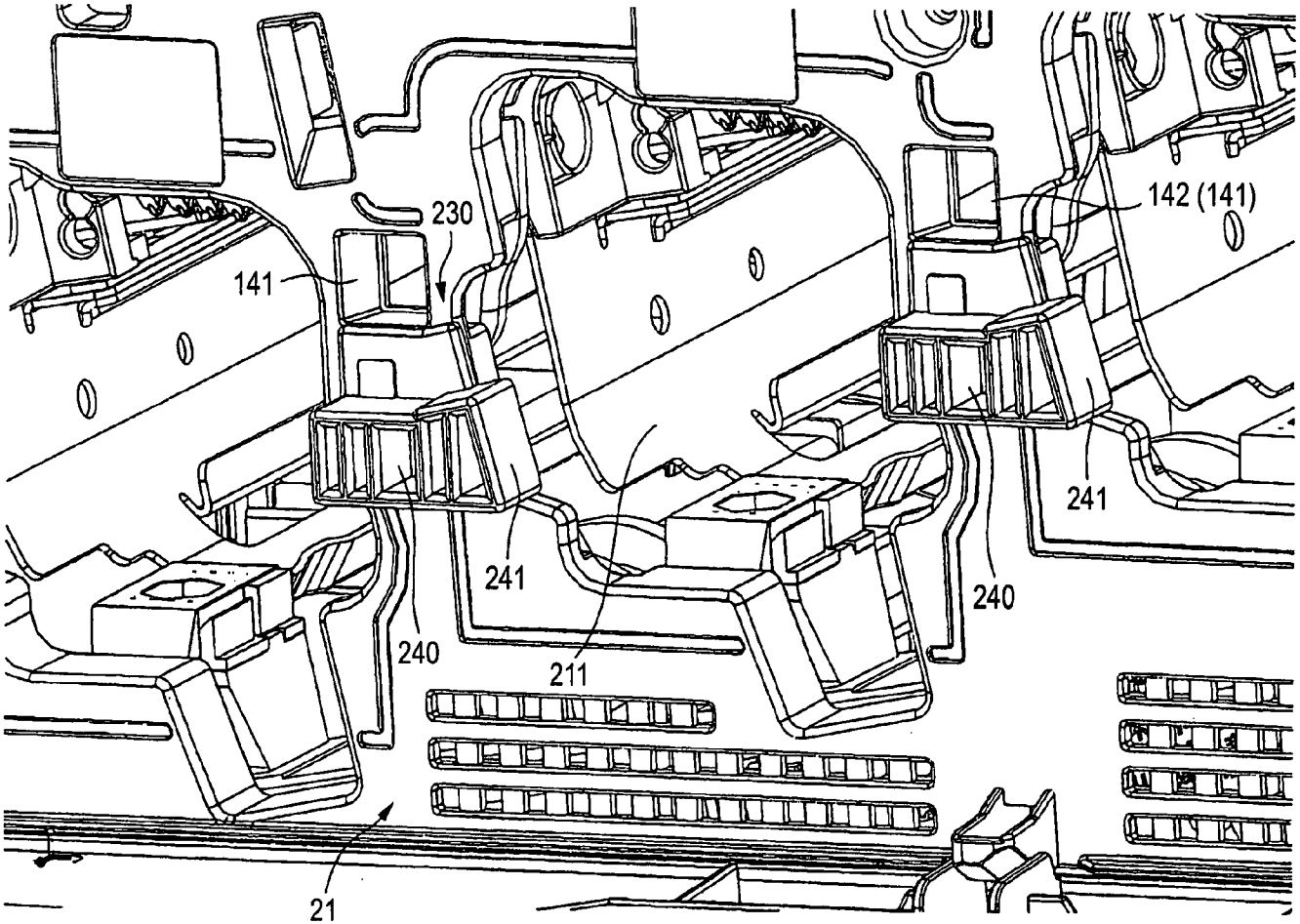
FIG. 41 is a view illustrating an example of a mounting determination member corresponding to a different type of process cartridge according to the embodiment.
Figure 42A:
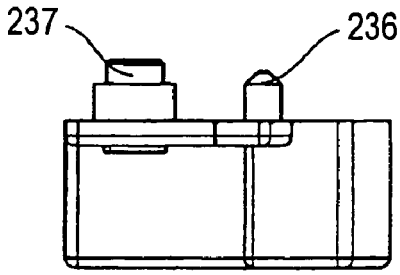
FIGS. 42A, 42B, 42C, 42D and 42E are a top view, a perspective view in an obliquely front side, a front view, a side view, and a perspective view in an obliquely back side illustrating a configuration component example of the mounting determination member shown in FIG. 41, respectively.
Figure 42B:
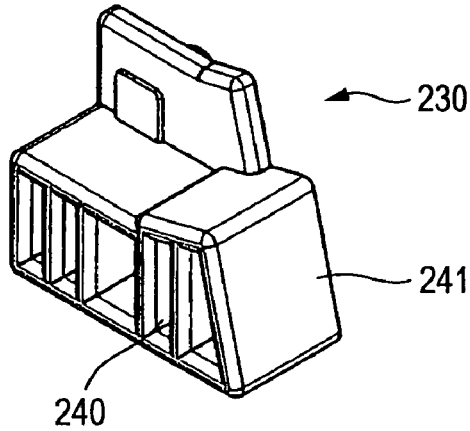
Figure 42C:
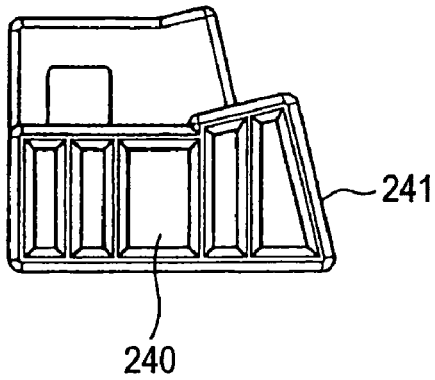
Figure 42D:
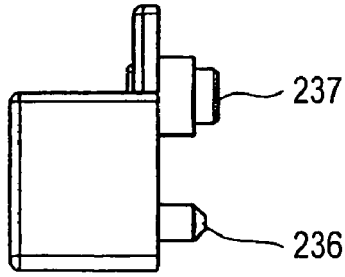
Figure 42E:
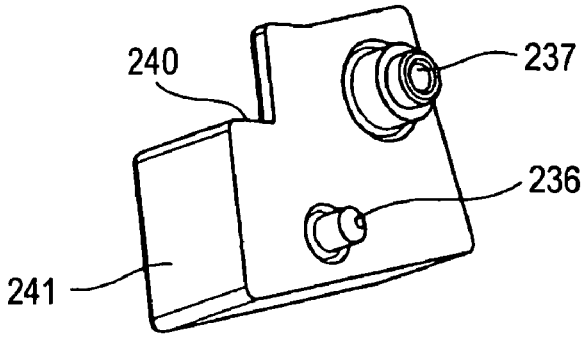
Figure 43A:
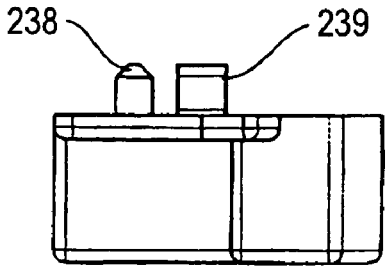
FIGS. 43A, 43B, 43C, 43D and 43E are a top view, a perspective view in an obliquely front side, a front view, a side view, and a perspective view in an obliquely back side illustrating another configuration component example of the mounting determination member shown in FIG. 41, respectively.
Figure 43B:
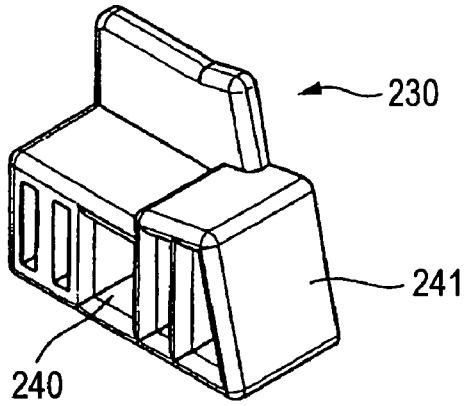
Figure 43C:
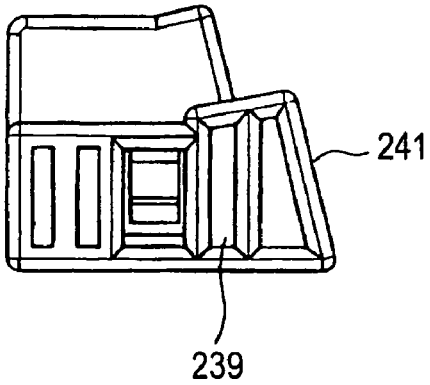
Figure 43D:
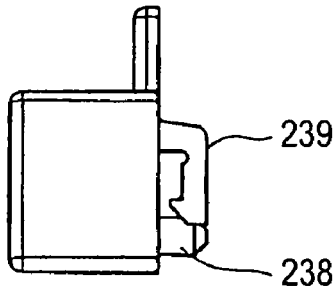
Figure 43E:
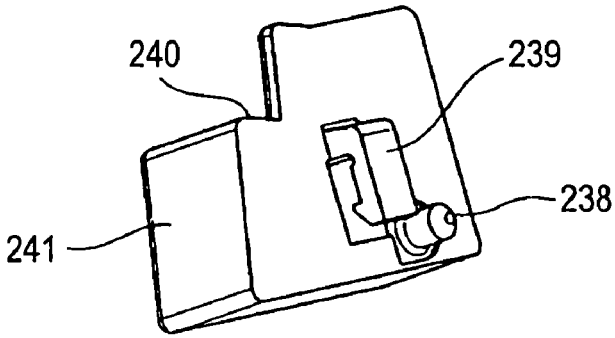

Additionally, FIG. 41 illustrates another type of mounting determination component 230.

In the same drawing, the mounting determination component 230 includes a determination block 240 in the lower region of the component main body 231. At this time, a slope surface portion 241 of the determination block 240 facing the cartridge receive portion 211 is used as a guide groove at the time of the inserting operation of the process cartridge 70.

As an attachment structure of the mounting determination component 230, as shown in FIGS. 42A to 42E, the positioning boss 236 and the screw hole portion 237 may be fixed in the rear surface of the component main body 231 so as to be fixed to the apparatus housing body 21 by the use of a screw. Alternatively, as shown in FIGS. 43A to 43E, the positioning boss 238 and the elastic attachment piece 239, which is elastically deformable, may be formed in the rear surface of the component main body 231 so as to hook the elastic attachment piece 239 in an attachment hole (not shown) of the apparatus housing body 21 to be thereby fixed thereto.

Figure 44:
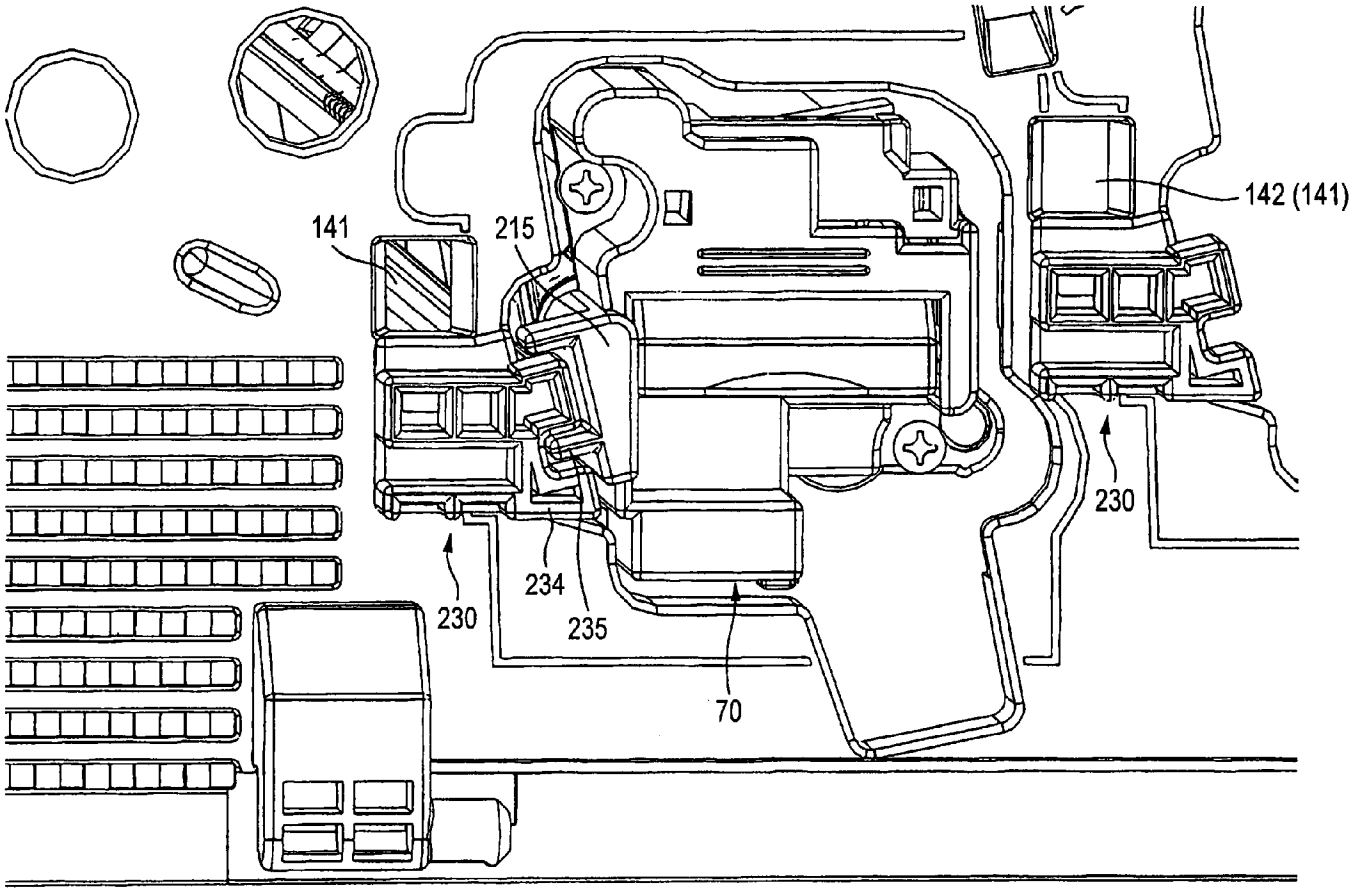
FIG. 44 is a view illustrating a state where an appropriate process cartridge is mounted, in the process cartridge identification structure shown in FIG. 37.

At this time, when the appropriate process cartridge 70 is inserted and mounted to the apparatus housing body 21 shown in FIG. 38, for example, as shown in FIG. 44, the identification component 215 of the process cartridge 70 does not interfere with the mounting determination component 230. Accordingly, the process cartridge 70 is inserted and mounted to the apparatus housing body 21.

At this time, the concave portion 235 with a U shape of the mounting determination component 230 is used as a guide groove at the time of the inserting/mounting operation of the process cartridge 70 to the apparatus housing body 21.

Figure 45:
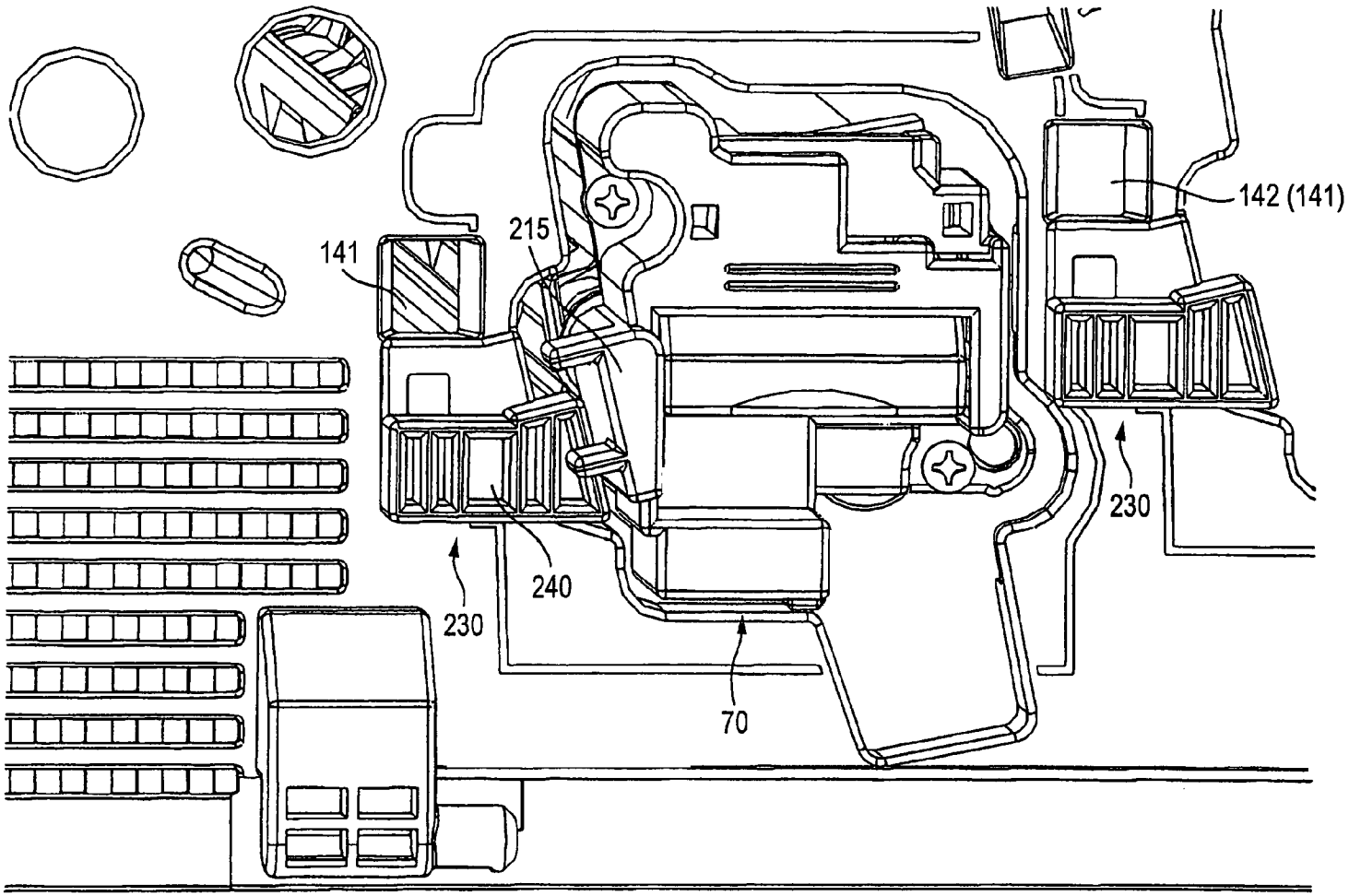
FIG. 45 is a view illustrating a state where an inappropriate process cartridge is mounted, in the process cartridge identification structure shown in FIG. 37.

Meanwhile, when the inappropriate process cartridge 70 is inserted and mounted to the apparatus housing body 21 shown in FIG. 38, for example, as shown in FIG. 45, the identification component 215 of the process cartridge 70 interferes with the mounting determination component 230. Accordingly, the process cartridge 70 is not inserted and mounted to the apparatus housing body 21 by mistake.

Figure 46:
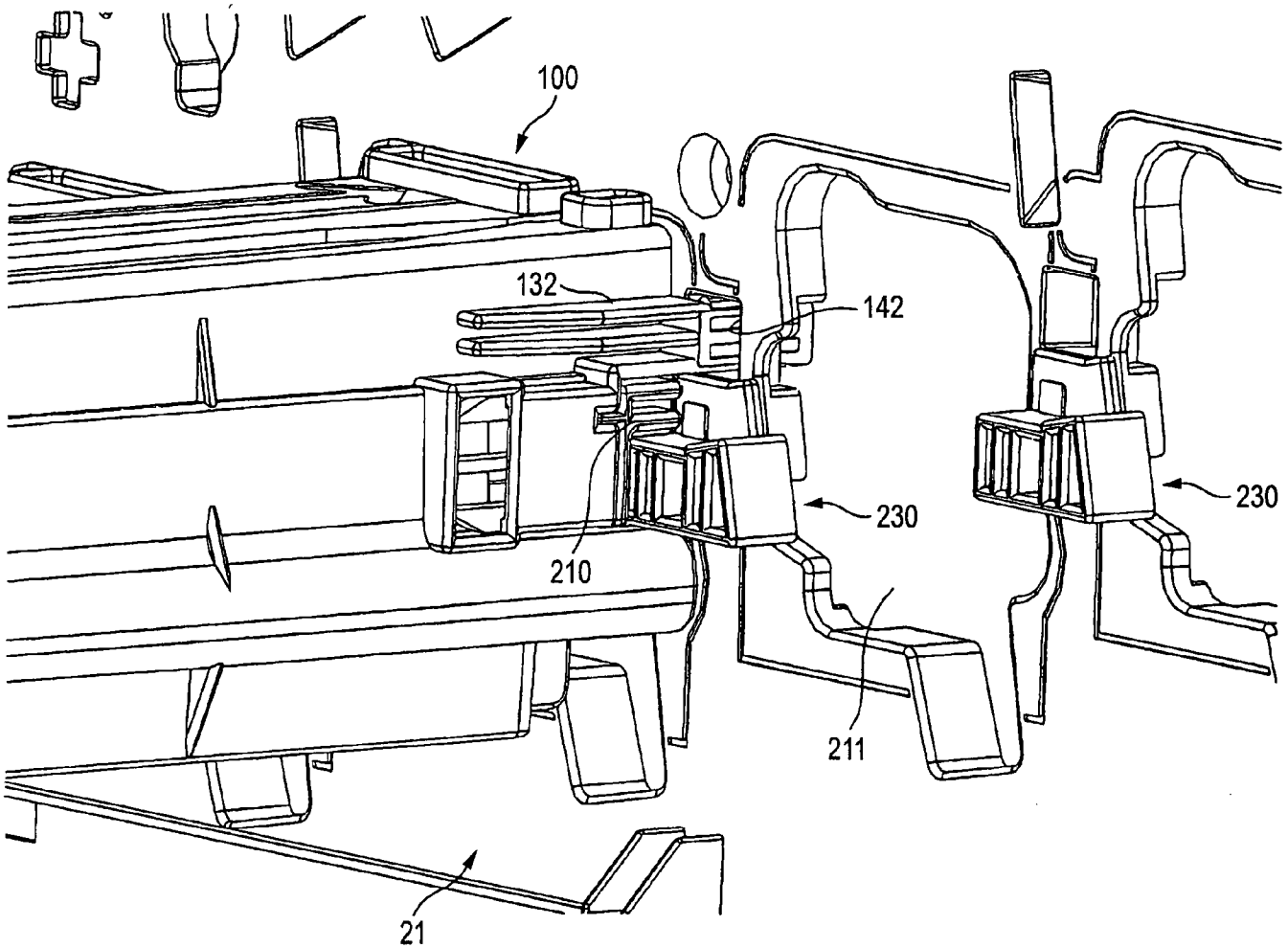
FIG. 46 is a view illustrating a state where an appropriate protection cover is mounted, in the process cartridge identification structure shown in FIG. 41.

When the appropriate process cartridge 70 is inserted and mounted to the apparatus housing body 21 shown in FIG. 41, for example, as shown in FIG. 46, the identification component 210 of the protection cover 100 does not interfere with the mounting determination component 230. Accordingly, the protection cover 100 is positioned and held to the apparatus housing body 21, and then the process cartridge 70 is inserted and mounted to the apparatus housing body 21.

Figure 47:
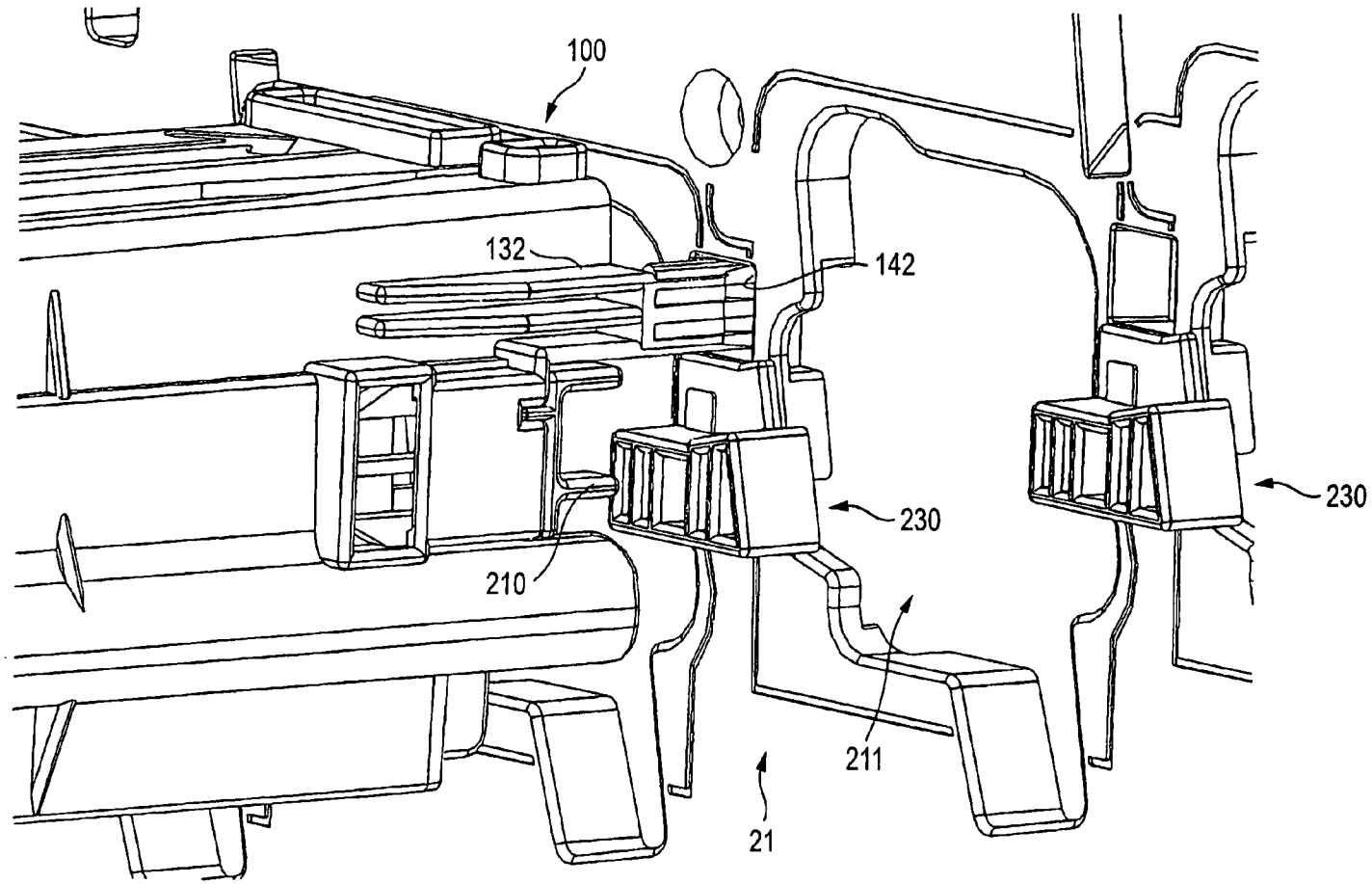
FIG. 47 is a view illustrating a state where an inappropriate protection cover is mounted, in the process cartridge identification structure shown in FIG. 41.

Meanwhile, when the inappropriate process cartridge 70 is inserted and mounted to the apparatus housing body 21 shown in FIG. 46, for example, as shown in FIG. 47, the identification component 210 of the protection cover 100 interferes with the mounting determination component 230. Accordingly, the protection cover 100 is not positioned and held to the apparatus housing body 21.

Figure 48:
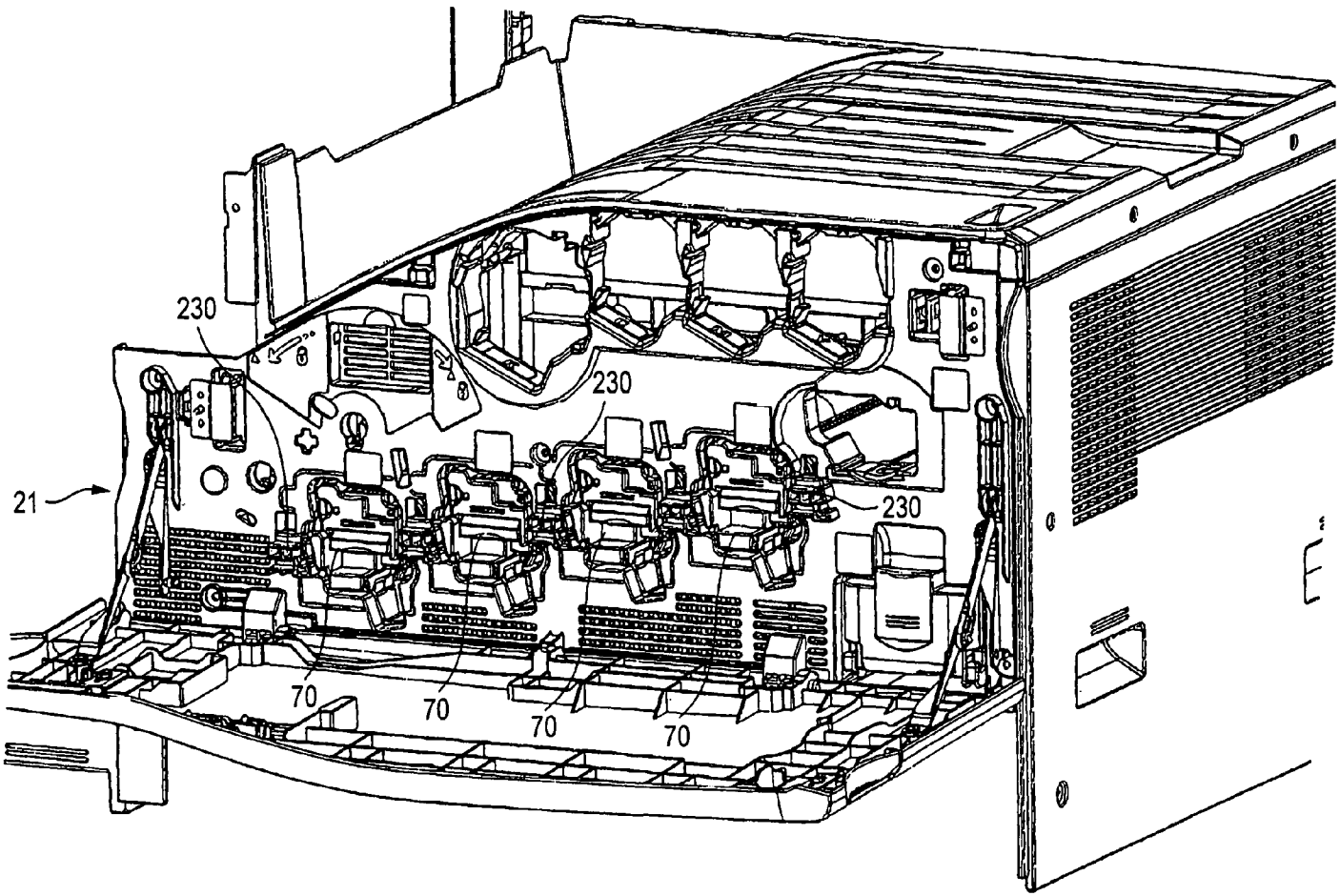
FIG. 48 is a view illustrating a state where all of appropriate process cartridges are mounted, in the process cartridge identification structure shown in FIG. 37.

When the appropriate process cartridges 70 are inserted and mounted to all cartridge receive portions 211 of the apparatus housing body 21 shown in FIG. 48, the process cartridge 70 may be sequentially inserted and mounted to each cartridge receive portion 211.

What is claimed is:

1. A protection cover, which is detachably disposed in a process cartridge that is detachably inserted and mounted to an image forming apparatus housing body and that comprises a photosensitive member; protects an external exposure portion of the photosensitive member before the process cartridge is inserted and mounted to the image forming apparatus housing body; and which detaches from the process cartridge with the process cartridge being inserted and mounted to the image forming apparatus housing body, the protection cover comprising:

a cover base that covers and protects the external exposure portion of the photosensitive member and that comes into contact with the image forming apparatus housing body to movably guide the process cartridge at the time the process cartridge is inserted to the image forming apparatus housing body;

an extrusion member that is disposed in the cover base on a side opposite to an insertion direction of the process cartridge to the image forming apparatus housing body and that moves in the insertion direction of the process cartridge to extrude the process cartridge from the cover base; and a restriction portion that is disposed in the extrusion member to restrict the process cartridge in the cover base in a state where the process cartridge is located in the cover base and to release the process cartridge from the cover base in a state where the process cartridge is inserted and mounted to the image forming apparatus housing body.

2. The protection cover according to claim 1, wherein the cover base comprises a guide surface that guides the extrusion member, and at least a part of the guide surface has an ascending slope portion in the insertion direction of the process cartridge to the image forming apparatus housing body so as to change a relative position between the restriction portion and the process cartridge.

3. The protection cover according to claim 1, wherein the extrusion member moves to release the restriction state between the process cartridge and the restriction portion at a position where the process cartridge is inserted and mounted to the image forming apparatus housing body.

4. The protection cover according to claim 1, further comprising:

a positioning/holding portion that is disposed in the cover base on a side in the insertion direction of the process cartridge to the image forming apparatus housing body, positions and holds the cover base so as to prevent the process cartridge from being drawn at the time of inserting and mounting the process cartridge, and that is capable of releasing the positioning/holding state after the process cartridge is inserted and mounted, wherein the extrusion member releases the holding state of the positioning/holding portion at an extrusion end position at the time the extrusion member ends the inserting/mounting operation of the process cartridge.

5. The protection cover according to claim 4, wherein the positioning/holding portion comprises an elastic hold piece, which is elastically deformable, and is hooked in a positioning hole formed in the image forming apparatus housing body to be fixed and held therein, and the protection cover has a position regulation mechanism which regulates the extrusion member in the extrusion end position at the time the inserting/mounting operation of the process cartridge ends.

6. The protection cover according to claim 1, wherein the restriction portion comprises a pair of elastic restriction pieces that are elastically deformable, the elastic restriction piece comprises a flange portion that comes into contact with a blocking portion of the cover base and that elastically deforms the pair of elastic restriction pieces to enable the pair of elastic restriction pieces to fall inward, and the flange portion comprises, at a portion which comes into contact with the blocking portion of the cover base, at least two steps of slope guide surfaces so that an angle between a first slope guide surface, with respect to the extrusion direction of the extrusion member, and the blocking portion is set to be bigger than that between a subsequent slope guide surface and the blocking portion.

7. A process cartridge, which is detachably inserted and mounted to an image forming apparatus housing body, the process cartridge comprising:

a photosensitive member; and a cartridge frame in which the photosensitive member is disposed, wherein the cartridge frame is held by a protection cover which protects an external exposure portion of the photosensitive member before the cartridge frame is inserted and mounted to the image forming apparatus housing body and which is detached with the cartridge frame being inserted and mounted to the image forming apparatus housing body, and the protection cover comprises:

a cover base that is detachably disposed in the cartridge frame to protect the external exposure portion of the photosensitive member and that comes into contact with the image forming apparatus housing body to movably guide the cartridge frame at the time the cartridge frame is inserted to the image forming apparatus housing body;

an extrusion member that is disposed in the cover base on a side opposite to an insertion direction of the cartridge frame to the image forming apparatus housing body and that moves in the insertion direction of the cartridge frame to extrude the cartridge frame from the cover base; and a restriction portion that is disposed in the extrusion member to restrict the cartridge frame in the cover base in a state where the cartridge frame is located in the cover base and to release the cartridge frame from the cover base in a state where the cartridge frame is inserted and mounted to the image forming apparatus housing body.

8. An image forming apparatus comprising:

an image forming apparatus housing body to which a process cartridge comprising a photosensitive member is detachably inserted and mounted; and a protection cover that protects an external exposure portion of the photosensitive member before the process cartridge is inserted and mounted to the image forming apparatus housing body and that is detached from the process cartridge with the process cartridge being inserted and mounted to the image forming apparatus housing body, wherein the protection cover comprises:

a cover base that covers and protects the external exposure portion of the photosensitive member and that comes into contact with the image forming apparatus housing body to movably guide the process cartridge at the time the process cartridge is inserted to the image forming apparatus housing body;

an extrusion member that is disposed in the cover base on a side opposite to an insertion direction of the process cartridge to the image forming apparatus housing body and that moves in the insertion direction of the process cartridge to extrude the process cartridge from the cover base; and a restriction portion that is disposed in the extrusion member to restrict the process cartridge in the cover base in a state where the process cartridge is located in the cover base and to release the process cartridge from the cover base in a state where the process cartridge is inserted and mounted to the image forming apparatus housing body.

* * * * *